US006545205B2

(12) United States Patent
Chono

(10) Patent No.: US 6,545,205 B2
(45) Date of Patent: Apr. 8, 2003

(54) KEYBOARD MUSICAL INSTRUMENT

(76) Inventor: Yasuhiro Chono, Room No. 201, Rose Mension 30-21, Takadanobaba 4-chome, Shinjuku-ku, Tokyo 169-0075 (JP)

( * ) Notice: Subject to any disclaimer, the term of this patent is extended or adjusted under 35 U.S.C. 154(b) by 0 days.

(21) Appl. No.: 09/978,313

(22) Filed: Oct. 15, 2001

(65) Prior Publication Data

US 2002/0073825 A1 Jun. 20, 2002

Related U.S. Application Data

(63) Continuation-in-part of application No. 09/701,959, filed as application No. PCT/JP00/01174 on Feb. 29, 2000, now Pat. No. 6,329,585.

(51) Int. Cl.[7] ..... G10C 3/12
(52) U.S. Cl. ..... 84/423 R; 84/433
(58) Field of Search ..... 84/423 R, 424, 84/425, 432, 433, 434, 435, 436

(56) References Cited

U.S. PATENT DOCUMENTS 5,557,052 A * 9/1996 Hayashida et al. ..... 84/221
5,652,403 A * 7/1997 Sugiyama et al. ..... 84/171
5,949,013 A * 9/1999 Satoshi ..... 84/171
6,329,585 B1 * 12/2001 Chono ..... 84/423 R

* cited by examiner

*Primary Examiner*—Kim Lockett
(74) *Attorney, Agent, or Firm*—Hogan & Hartson, LLP

(57) ABSTRACT

An action mechanism is provided in which the longitudinal direction of a keyboard body having a keyboard portion at its one end, a middle part or the other end thereof is swingably held and, at the same time, a base of a hammer body is pivotally attached to the opposite side or the same direction side of the keyboard portion across the holding point of the keyboard body. A beak-like projecting piece is protrudingly provided in a base end of the hammer body, and at the same time, an engaging stepped portion is formed in an escapement member that is always biased toward the beak-like projecting piece of the hamner body. The pivotally attached portion of the hammer body pivots in accordance with a movement of the keyboard body by a key striking operation of the keyboard portion. At the same time, the beak-like projecting piece of the hammer body and the engaging stepped portion of the escapement member engage with each other so that the hammer body performs a pivotal operation. In at least one of the hammer body and the escapement member, a pushing-out member for pushing out the escapement member to the opposite side with respect to the hammer body in accordance with the pivotal operation of the hammer body to let off the beak-like piece of the hammer body from the engaging stepped portion is provided. A pivotal member that is made engageable and disengageable to and from the hammer body is pivotally attached to the escapement member. Biasing mechanism for pivotally biasing the pivotal member in a fixed direction is provided. The hammer body which has started returning after the pivotal operation is locked by the pivotal member, whereby the engaging stepped portion can re-engage with said beak-like projecting piece before the keyboard portion returns to an initial position of the keyboard portion before the key striking operation.

12 Claims, 53 Drawing Sheets

KEYBOARD MUSICAL INSTRUMENT

CROSS-REFERENCE TO RELATED APPLICATIONS

The present application is a continuation-in-part of U.S. patent application Ser. No. 09/701,959, having a filing date of Feb. 28, 2001, now U.S. Pat. No. 6,329,585 which claims priority to PCT Patent Application No. PCT/JP00/01174, having an international filing date of Feb. 29, 2000, and claiming priority to Japanese Patent Application No. 11-136124, filed on Apr. 8, 1999.

TECHNICAL FIELD

The present invention relates to a keyboard musical instrument for striking a sound generating body in response to key striking operation on a keyboard portion, and is particularly preferable when applied to a keyboard musical instrument having an action mechanism called the jumping-up style.

BACKGROUND ART

Currently, action mechanisms of the same style are mounted in keyboard musical instruments for performing a hammer action, such as a piano, although the action mechanisms are somewhat different from one keyboard musical instrument to another concerning a standard. That is, an English style action mechanism called the pushing-up style is employed in a modem piano.

However, in the nineteenth century, an action mechanism of the German style or the Viennese style called the jumping-up style was widely known as other mechanisms aside from this pushing-up style. Such a mechanism in the past, the historical transition of the jumping-up style to be described later, and the like are discussed in a book entitled "Vom Hammer" written by Walter Pfeiffer and published in 1979 (third edition). Further, the inventor of the present invention was interested in a keyboard musical instrument of this style and was inspired to start the manufacture of such a keyboard musical instrument by seeing photographs of a musical instrument Orphica, before confirming the contents of this book (approximately fifteen years ago).

Basic characteristics of this jumping-up style is that a rotational central axis of a hammer is attached to a key. The most important progress in an action mechanism of this jumping-up style was made in the eighteenth century. That is, Johann Andoreas Stein (1728 to 1792) devised excellent touch of playing by mounting tongue-like components independent for each key instead of parts to which beak-like protrusions of hammers existing in the rearward of keys that were arranged in a fixed rail shape hook on. This was the most important advance of the jumping-up style action mechanism, and determined the jumping-up style action mechanism.

The Stein's action mechanism did not have a back-check (an object serving to stop the motion of a hammer that strikes a string and jumps back after striking the string). However, it may be considered that it was Stein's achievement to have created the basic form of the German style action mechanism and have determined a final form of the jumping-up style action mechanism.

The world famous Viennese style action mechanism was taken over by Nanette who was Stein's daughter, and by her husband Johann Andoreas Streicher who was a manufacturer of keyboard musical instruments, and its originality was further developed. Therefore, the action mechanism was called the Viennese style instead of the German style when Stein's daughter Nanette got married to the Viennese man, and the action mechanism is often written as "the German Viennese style action mechanism" because both the German and Viennese styles have the same roots.

The improvement of Stein's style having the tongue-like components independent for each key has very light touch (feeling of play), does not cause any sense of increased pressure by let-off (motion or function for separating the motion of a key and the motion of a hammer before the hammer and a string collide with each other) to a player, and is easy to repeat striking keys. A key has the depth of approximately 6 millimeters and the heaviness (a value in grams at which a key is depressed) of 30 grams in bass range and 20 grams in treble range.

On the other hand, when a key is depressed, a current piano experiences increase of relatively large resistance, i.e., force of a key to push back at the time of let-off. The depth of a key is 9.5 to 10 millimeters. A grand piano of Steinway is a typical one of the few pianos whose heaviness of a key is low at approximately 47 grams in average.

Although such an improvement was added to the jumping-up style action mechanism, the trend of the world was in favor of the pushing-up style. This is because a decisive improvement, which is now practical, was added to the English style action mechanism which is a pushing-up style. That is the repetition action mechanism, which was invented in 1821 and then was evolved into the current grand piano action mechanism by further improvement in 1840.

A piano action cannot be prepared for the next string striking unless a key rises to "a certain height" by a performer lifting a finger after the key is depressed to generate sound (a string is struck) once. The repetition action mechanism is a mechanism that is devised such that "a certain height" required for preparation of string striking is as low as possible. With this mechanism, the function of repeated striking (to make repeated striking easy) can be improved.

As far as the inventor of the present invention knows, upright pianos except limited models of two manufacturing companies in the world do not have this function. Therefore, this function is a point for comparing performability of an upright piano and a grand piano. This is called "Kurzhubwerk" in German, which means "the lifting height lowering function".

Moreover, the jumping-up style (the Vienna style) action mechanism had a critical structural problem. The inventor of the present invention also noticed the problem when the inventor tried to manufacture a keyboard musical instrument once approximately fifteen years ago, but did not notice that this problem is discussed in the literature "Vom Hammer" until recently. The structural problem that the Vienna style action mechanism has is namely that the rotational central axis of a hammer portion shifts in accordance with the movement of a key. This causes inconveniences described below.

Usually, it is common to assume the state in which a key is depressed to the lowest point when a string is struck, but a different state may be assumed, for example, a state in which a string is struck by instantly hitting a key with strong force. In other words, this state corresponds to staccato of forte.

In this case, although a hammer jumps up by the reaction of instant hit of a key with strong force to strike a string, the key is not in a state that it is fully depressed to the lowest point, but is somewhere on its way to the lowest point. In the Vienna style action mechanism, since the rotational central axis of the hammer is attached to the key, the position of the rotational central axis of the hammer at that time is in the position lower than the state where the key depressed is to the lowest point. As a result, since the positions of the rotational central axis of the hammer are different respectively in each of the above-mentioned two states, the hammer reaches the string forming different tracks in each state, and parts of the hammer head contacting the string are also different respectively.

Since a dislocation of the string striking point (the point where the hammer head contacts the string) arises in the longitudinal direction viewed from a performer, if strings are stretched in rows to cross the direction to which keys extend, the hammer not only does not strike an aimed string but may strike another string or a plurality of unnecessary strings of different sounds simultaneously. In addition, in the hammer side, since the large area of the hammer head contacts the strings at unspecified points, tones also become unstable and sound quality cannot be adjusted.

A Vienna style action mechanism 373 that adopts the above-mentioned jumping-up style is illustrated in FIGS. 54 through 57. As shown in FIG. 54, a keyboard body 305 having a keyboard portion (not shown) in the right side (in the figure) is swingably held by a pin 313 and a pedestal 315. A supporting pole 375 is provided at the other end portion of the keyboard body 305, and a base portion of a hammer body 377 is pivotally supported by a rotational central axis 378 at the top end of the supporting pole 375 to strike a string 307.

A beak-like projecting piece 379 is mounted on the base end portion of the hammer body 377. An engaging stepped portion 383 is formed in an escapement member 381 that is always biased toward this beak-like projecting piece 379 of the hammer body 377 by a spring bar 380. On the other hand, a back-check 389 is mounted on a frame 385 along the rotational track of the hammer portion 387 of the hammer body 377, and a sliding member such as leather is stuck on the surface of the back-check 389.

In a performance, as shown in FIGS. 55 and 56, the supporting pole 375 in the other end of the keyboard body 305 rises toward the string 307, and at the same time, the beak-like projecting piece 379 of the hammer body 377 and the engaging stepped portion 383 of the escapement member 381 are engaged, in accordance with the key striking operation of the keyboard portion. In this way, the hammer body 377 performs a striking pivotal operation against the string 307.

The engagement of the beak-like projecting piece 379 of the hammer body 377 and the engaging stepped portion 383 of the escapement member 381 is designed to be let off as shown in FIG. 56 immediately before the striking operation of the hammer body 377. The timing of this let-off can be adjusted exactly by an adjustment screw 391. When the performer sets the keyboard portion free, the let off beak-like projecting piece 379 descends while sliding against a return sliding surface 393 of the escapement member 381 as shown in FIG. 57, and returns to the state shown in FIG. 54. In addition, a hammer body 377, after striking the string 307, is caused to return in the direction of its original position by strong repulsion of the string 307, but the force of the movement is reduced by sliding friction between the hammer portion 387 of the hammer body 377 and the back-check 389, and the hammer body 377 stops. Therefore, the hammer body 377 does not rebound to strike the string 307 again.

The let-off of the Viennese style action mechanism 373 utilizes the shift of the rotational central axis 378 of the hammer body 377 in the longitudinal direction viewed from the performer by swinging movement of the keyboard body 305. That is, let-off is effected when the top end of the beak-like projecting piece 379 in the opposite side of the hammer portion 387 moves as if it is pulled out from the escapement member 381, by depressing the keyboard portion.

Therefore, the more a reliable movement of let-off is desired, the longer the shifting distance of the rotational central axis 378 must be made by separating the rotational central axis 378 from the keyboard body 305 and placing it in a higher position. In addition, since the back-check 389 is required to be placed correspondingly in a higher position as well, it is hard to design the action mechanism 373 to be low in height. Further, since it is necessary to provide the back-check 389 and to adjust its condition of striking, there is also a problem that the number of components and the number of assembly steps are many.

Moreover, in the conventional Vienna style action mechanism 373, since the entire action mechanism 373 protrudes to the other side of the keyboard portion by the length L (see FIG. 54) that includes the part from the string striking point of the hammer portion 387 of the hammer body 377 to the mounting positions of the hammer body 377 and the escapement member 381, it is hard to design the entire keyboard musical instrument to be shallow in depth. In addition, when the hammer portion 387 is larger, the rotational central axis 378 of the hammer body 377 must be placed in a higher position, which, on the other hand, results in larger dislocation of the string striking point on the hammer portion 387.

SUMMARY OF THE INVENTION

The present invention has been devised for the purpose of solving these problems, and it is an object of the present invention to provide a jumping-up style keyboard musical instruments that can be designed to improve repetition (repeated striking function). It is another object of the present invention to provide a jumping-up style keyboard musical instrument that can be played in a tilted state as in standing play.

In line with these objects, the inventor of the present invention started the second challenge concerning the manufacture of a keyboard musical instrument approximately three years ago. Then, a first trial product that had good appearance (function) as a musical instrument was completed in March 1998. Thereafter, it was confirmed by an action analysis of a third trial product by a personal computer that it is difficult to alter the dimensions of major parts such as an engaging portion of a hammer body and an escapement member. Currently, a fifth trial product is being manufactured. Under such circumstances, this application is filed in order to protect novel mechanisms whose performances have been confirmed.

An embodiment of present invention provides a keyboard musical instrument having an action mechanism, wherein in the longitudinal direction of a keyboard body having a keyboard portion at its one end, a middle part or the other end thereof is swingably held and, at the same time, a base of a hammer body is pivotally attached to the opposite side or the same direction side of the keyboard portion across the holding point of the keyboard body. The action mechanism includes a beak-like projecting piece that is protrudingly provided in a base end of the hammer body, and at the same time, an engaging stepped portion formed in an escapement member that is always biased toward the beak-like projecting piece of the hammer body. The pivotally attached portion of the hammer body pivots in accordance with a movement of the keyboard body by a key striking operation of the keyboard portion, and at the same time, the beak-like projecting piece of the hammer body and the engaging stepped portion of the escapement member engage with each other so that the hammer body performs a pivotal operation.

In addition, the embodiment provides, in at least one of the hammer body and the escapement member, a pushing-out member for pushing out the escapement member to the opposite side with respect to the hammer body in accordance with the pivotal operation of the hammer body to let off the beak-like piece of the hammer body from the engaging stepped portion. The embodiment also provides a pivotal member that is made engageable and disengageable to and from the hammer body which is pivotally attached to the escapement member, a biasing means for pivotally biasing the pivotal member in a fixed direction, and the hammer body which has started returning after the pivotal operation is locked by the pivotal member, whereby the engaging stepped portion can re-engage with the beak-like projecting piece relatively soon.

In this way, since at least one of the base end of the hammer body and the escapement member is provided with a pushing-out member for pushing out the escapement member to the opposite side in respect to the hammer body to separate the projecting piece of the hammer body from the engaging stepped portion in accordance with a striking pivotal movement of the hammer body, the beak-like projecting piece can be forced to separate from the engaging stepped portion of the escapement member. Therefore, since a member such as the supporting pole 375 for increasing a shifting component in the horizontal direction (the direction toward keyboard portion) of the beak-like projecting piece 379 as conventionally required becomes unnecessary, the length of the keyboard body can be designed short, the height of the action mechanism can be designed extremely low, and the depth extremely shallow.

An action mechanism in accordance with another embodiment includes an escapement member provided with a restraining member that opposes the hammer body so as to be attachable to and detachable from the hammer body and stops the hammer body at a position apart from a sound source body or a highest pivotal position in a state in which the beak-like projecting piece is let off from the engaging stepped portion.

Since the control member is integrally formed in the escapement member for separably opposing the hammer body in the striking direction and separating the hammer body from the sound source body to stop in the state in which the beak-like projecting piece is separated from the engaging stepped portion, the back-check 389 as required in the conventional art becomes unnecessary, and the number of components and the number of assembly steps can be reduced. In addition, the height of the action mechanism portion can be made low.

Moreover, in an action mechanism in accordance with another embodiment, the pivotal member pivots together with the escapement member, at the point when the hammer body starts pivoting, against an extending biasing force of the biasing means. Also, immediately before the hammer body strikes a sound source body or immediately before a highest pivotal position, the pivotal member follows the movement of the keyboard body to further pivot after the pivoting of the escapement member is stopped, to thereby further compress the biasing means.

In addition, an action mechanism in accordance with another embodiment including a cylindrical stopping portion for stopping a returning operation of the hammer body provided to the pivotal member and a base portion on which a roller supporting rod is coupled to a position parallel with the stopping portion of the pivotal member is mounted during the pivoting is provided in the keyboard body.

Also, an action mechanism in accordance with another embodiment includes a part of the pivotal member intervened between the biasing means and the escapement member to transmit a biasing force of the biasing means to the escapement member via the pivotal member, whereby the escapement member is always biased toward the hammer body.

Further, another embodiment of the present invention provides a keyboard musical instrument having an action mechanism comprising a keyboard body, a hammer body, and an escapement member. The keyboard body has a keyboard portion at its one end and is held at the middle part in the longitudinal direction or at the other end so to be made swingable. The hammer body has a hammer portion and is pivotally fixed at its base in the opposite side or the same direction side of the keyboard portion across a holding point of the keyboard body. The escapement member is always biased toward the hammer body.

A projecting piece is provided on the opposite side of the hammer portion across the pivotal fulcrum of the hammer body. An engaging stepped portion for engaging the projecting piece is provided in the escapement member. The hammer body performs a pivotal operation in a state where the projecting piece of the hammer body and the engaging stepped portion of the escapement member are engaged with each other when the pivotal fulcrum of the hammer body pivots in the striking direction by a key striking operation of the keyboard portion.

A pivotal member made engageable and disengageable to and from the hammer body is pivotally attached to the escapement member. A biasing means for pivotally biasing the pivotal member in a fixed direction is provided. The hammer body which has started returning after the pivotal operation is locked by the pivotal member, whereby the engaging stepped portion can re-engage with the beak-like projecting piece relatively soon.

In addition, an action mechanism in accordance with another embodiment wherein in at least one of the hammer body and the escapement member there is provided a pushing-out member for pushing out the escapement member to the opposite side with respect to the hammer body in accordance with the pivotal operation of the hammer body to let off the beak-like piece of the hammer body from the engaging stepped portion is provided.

Moreover, an action mechanism in accordance with another embodiment wherein at the point when the hammer body starts pivoting, the pivotal member pivots together with the escapement member against an extending biasing force of the biasing means and, immediately before the hammer body strikes a sound source body or immediately before a highest pivotal position, the pivotal member follows the movement of the keyboard body to further pivot after the pivoting of the escapement member is stopped, to thereby further compress the biasing means.

In addition, an action mechanism in accordance with another embodiment wherein a cylindrical stopping portion for stopping a returning operation of the hammer body is provided to the pivotal member and a base portion on which a roller supporting rod to be coupled to a position parallel with the stopping portion of the pivotal member is mounted during the pivoting is provided in the keyboard body.

Also, an action mechanism in accordance with another embodiment wherein a part of the pivotal member is intervened between the biasing means and the escapement member to transmit a biasing force of the biasing means to the escapement member via the pivotal member, whereby the escapement member is always biased toward the hammer body.

DETAILED DESCRIPTION OF THE INVENTION

Figure 1:
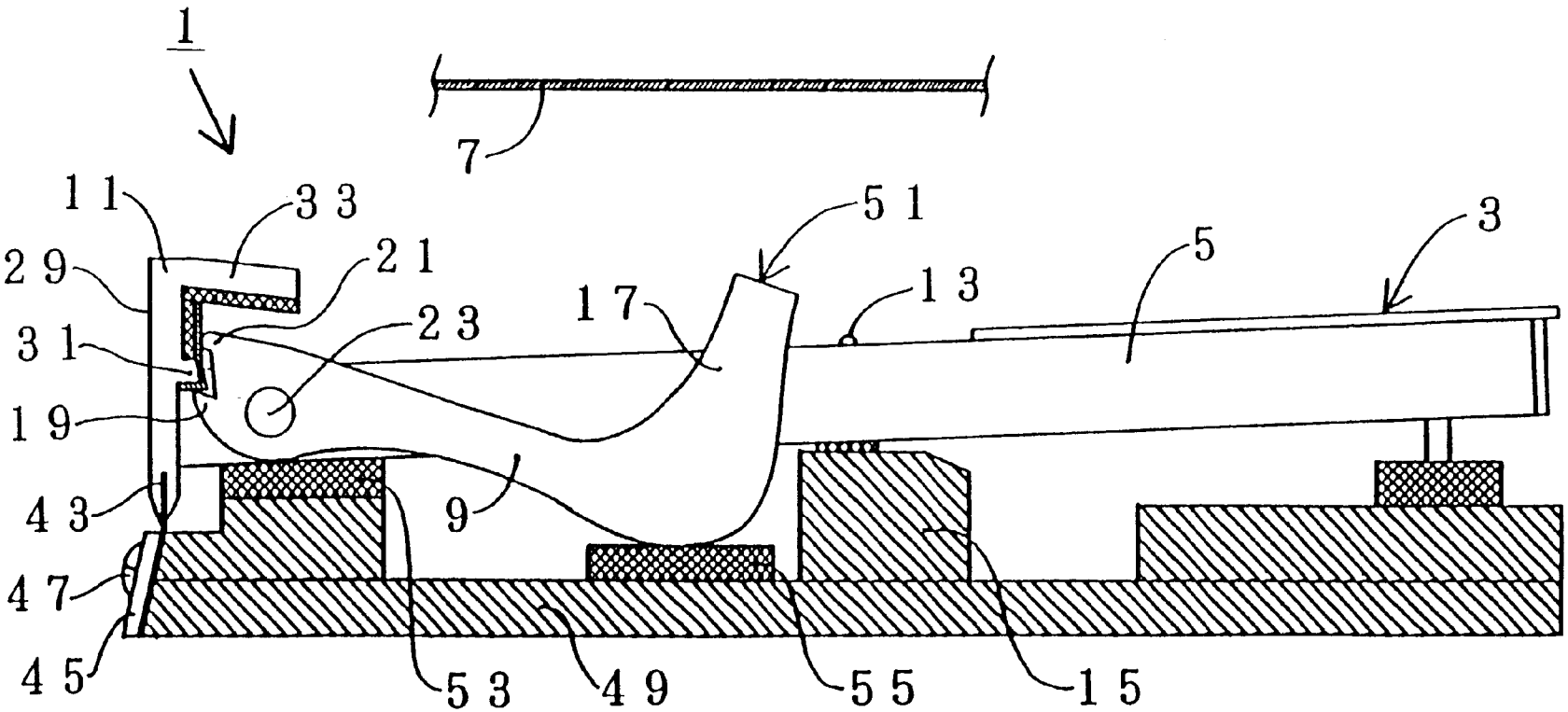
FIG. 1 is a side view illustrating an action mechanism used in a keyboard musical instrument of a first embodiment of the present invention.

Preferred embodiments of the present invention will be hereinafter described with reference to the figures. Further, a first embodiment of the present invention will be described first based on FIGS. 1 through 6. As shown in FIG. 1, an action mechanism 1 of a keyboard musical instrument in accordance with the first embodiment of the present invention consists of a keyboard body 5 having a keyboard portion 3 in its right side (in the figure), a hammer body 9 for striking a string 7 that is a sound source body, and an escapement member 11 for controlling the striking pivotal operation of the hammer body 9.

In FIG. 1, the middle part in the longitudinal direction of the keyboard body 5 having the keyboard portion 3 at its right side end (in the figure) is swingably held by a pin 13 on the upper surface of a pedestal 15. A hole 5*a* is made in the opposite side of the keyboard body 5 across a swinging fulcrum (the position of the pin 13 that is also a holding point) as shown in FIG. 2.

The hammer body 9 has a hammer portion 17 that should strike the string 7 (see FIG. 1) at its top end. A hole 9*a* is made in the base of the hammer body 9, and a beak-like projecting piece 19 to be a projecting piece is protrudingly provided in the opposite side of the hammer portion 17 across the hole 9*a*. In addition, a pushing-out protrusion 21 that is a pushing-out member in the present invention is protrudingly provided in the upper side with respect to the beak-like projecting piece 19.

Figure 2:
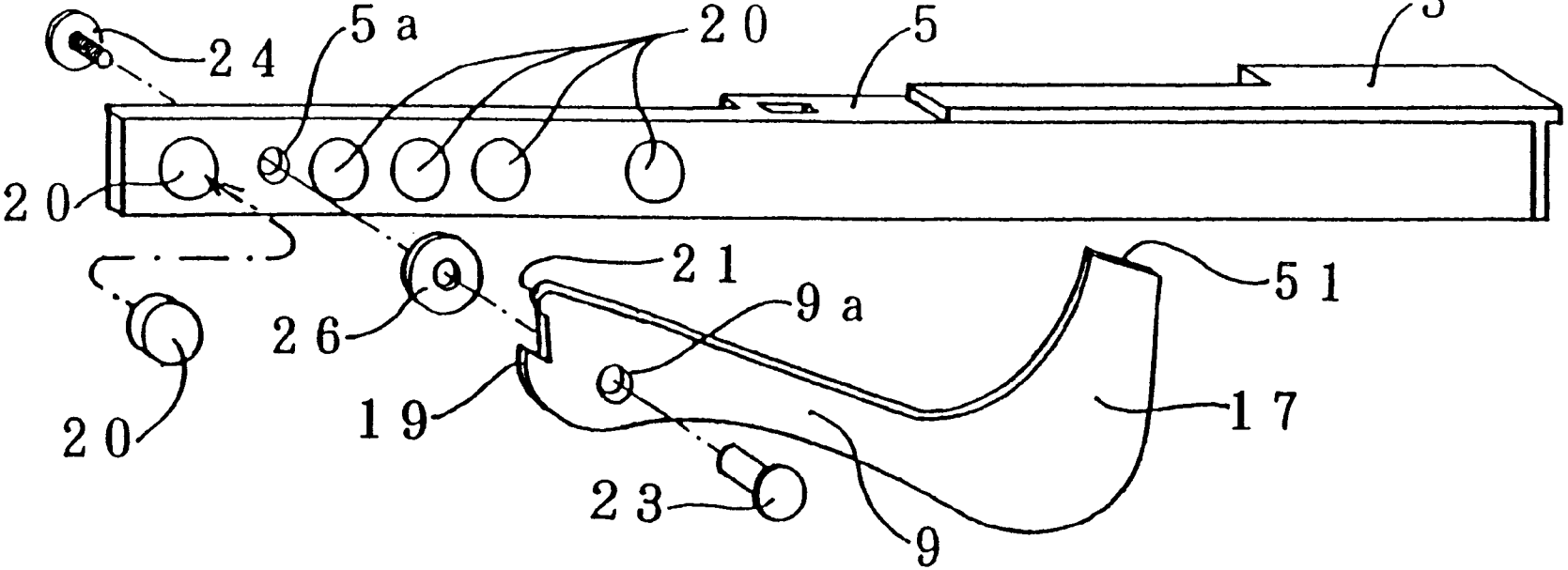
FIG. 2 is a perspective view illustrating a keyboard body and a hammer body in the action mechanism of FIG. 1.

As shown in FIG. 2, the keyboard body 5 and the hammer body 9 are relatively and pivotally fixed by inserting into the hole 5*a* of the keyboard body 5 and the hole 9*a* of the hammer body 9 through a washer 26, and tightening a screw union 23 having a female screw inside and a screw union 24 having a male screw on the circumference. Further, the inner diameter of the hole 9*a* of the hammer body 9 is slightly larger than the outer diameter of the screw union 23 in the female side (outer side), hence, the hole 9*a* is made rotatable with respect to the screw union 23 in the female side. A key lead 20 for adjusting the weight balance of the keyboard body 5 is provided on the side surface of the keyboard body 5. An appropriate number of key leads 20 are inserted in holes made in the keyboard body 5, and are fixed by beating from both sides in the compressing direction to enlarge the diameters. Further, the screw union 23 is made a pivotal fulcrum of the hammer body 9.

Figure 3:
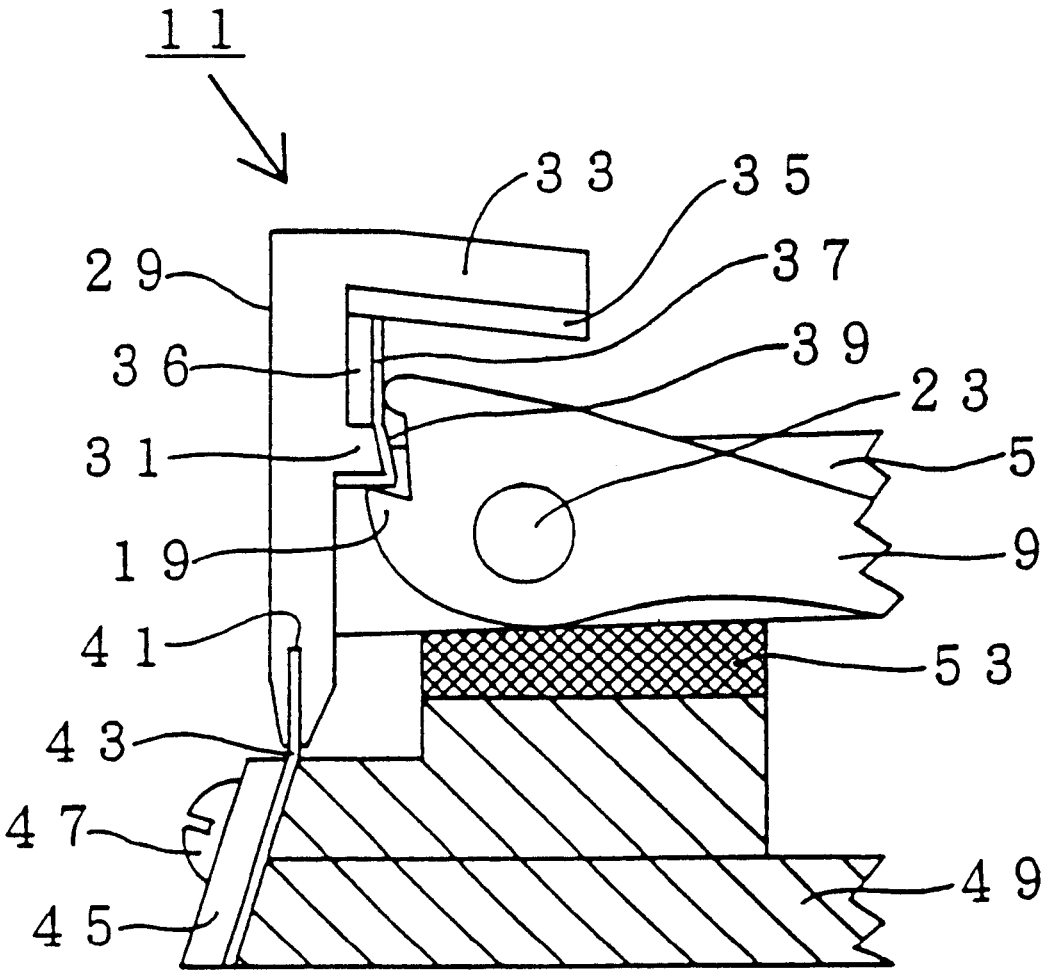
FIG. 3 is a side view illustrating a main part of the action mechanism of FIG. 1.

As shown in FIG. 3, the escapement member 11 is protrudingly provided with an engaging stepped portion 31 in the central inside of a back portion piece 29, and a control member 33 in the upper end of the back portion piece 29 respectively. In addition, cushions 35 and 36 made of cloth or felt are respectively stuck to the lower surface of the control member 33 and the upper side of the engaging stepped portion 31 (in the figure). Moreover, a sliding member 37 made of an uncut leather is stuck to the lower surface and the protruding surface of the engaging stepped portion 31 and the front surface of the cushion 36, which forms a return sliding surface 39 connecting the upper side (in the figure), with respect to the engaging stepped portion 31 of the back portion piece 29, and the right side top of the engaging stepped portion 31 (in the figure).

A groove 41 is provided in the lower end of the escapement member 11, and the top end of a spring plate 43 made of carbon fiber is inserted in and is adhered to the groove 41. The lower end of the spring plate 43 is fixed to a machine base 49 by a screw 47 via a stopping plate 45. In this way, the escapement member 11 is always biased toward the base of the hammer body 9 by the elasticity of the spring plate 43.

On the machine base 49, cushions 53 and 55 made of cloth are respectively laid in the position opposing the hammer portion 17 and the base (the position of the screw union 23) of the hammer body 9 as shown in FIG. 1.

Operations of the action mechanism 1 used in the keyboard musical instrument of the first embodiment will now be described. In FIG. 1, when a performer strikes keys of the keyboard portion 3, the keyboard body 5 pivots clockwise (in FIG. 1) around the pin 13 and the pedestal 15, and the pivot portion (the position of the screw union 23 and the rotational fulcrum of the hammer body 9) rises toward the striking direction, i.e., toward the string 7 side. With this rising, the beak-like projecting piece 19 of the hammer body 9 engages with the engaging stepped portion 31 of the escapement member 11.

Figure 4:
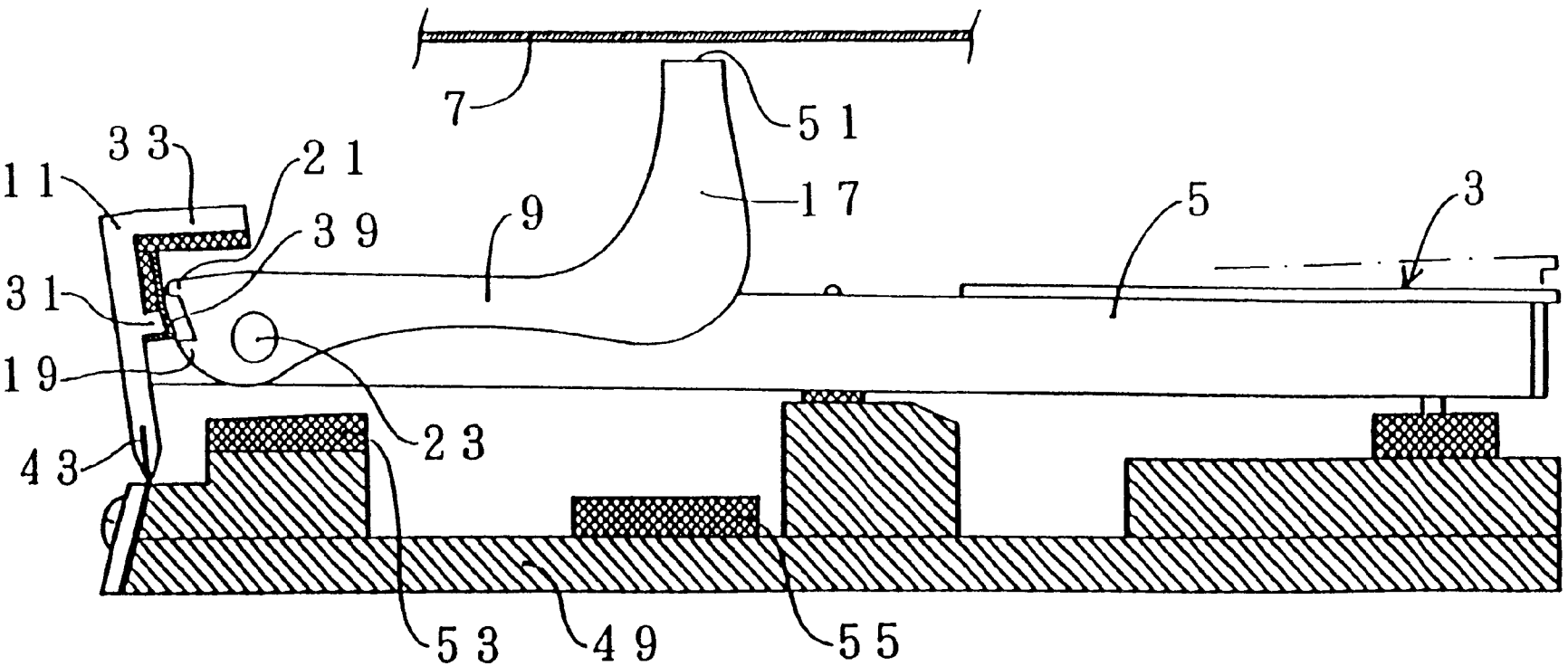
FIG. 4 is a side view illustrating the state immediately before striking a string in the action mechanism of FIG. 1.

When the performer further depresses the keyboard portion 3, as shown in FIG. 4, the pivot portion (the position of the screw union 23) of the hammer body 9 further rises toward the string 7. On the other hand, since the shift of the beak-like projecting piece 19 is prevented by the engaging stepped portion 31, the hammer portion 17 side of the hammer body 9 pivots to perform a striking pivot operation against the string 7. At this time, the pushing-out protrusion 21 of the hammer body 9 gradually pushes out the escapement member 11 to its back side (the left side in FIG. 4) against the elasticity of the spring plate 43 while contacting the return sliding surface 39 of the escapement member 11.

Figure 5:
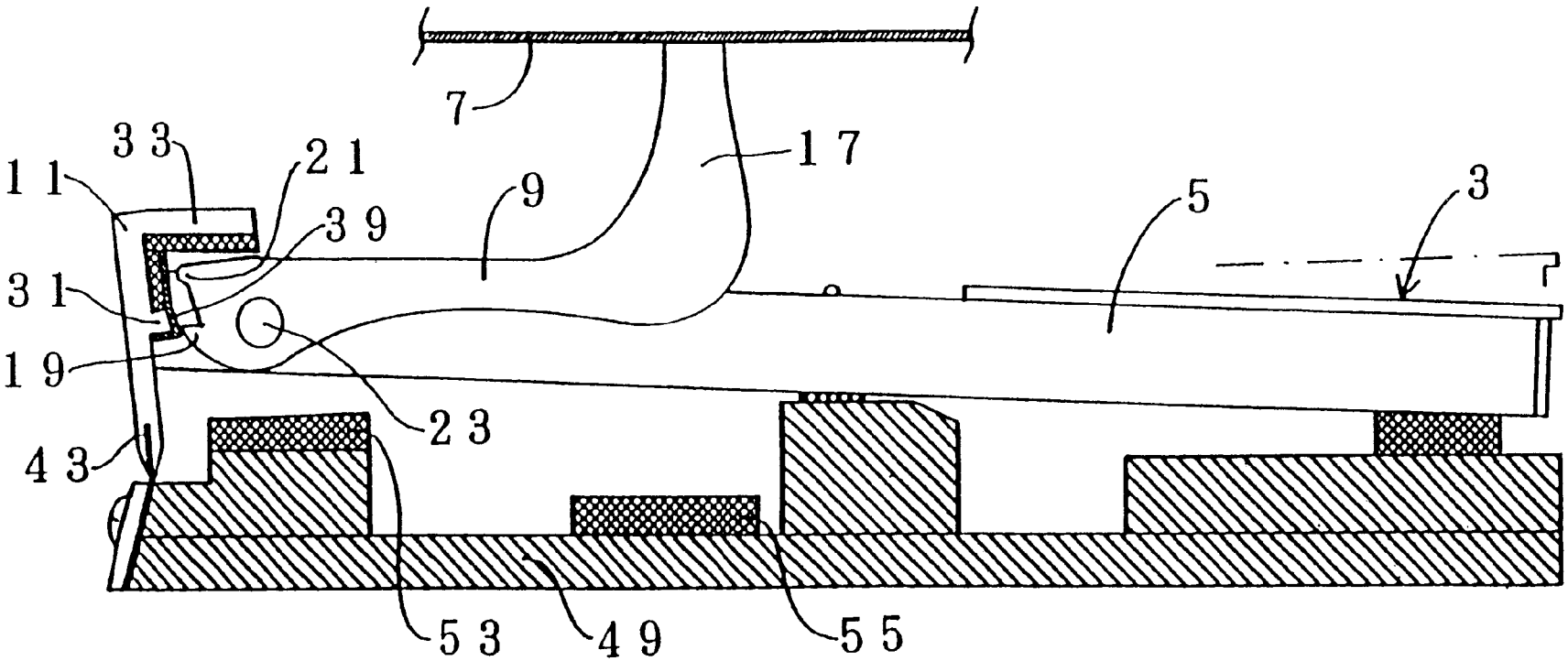
FIG. 5 is a side view illustrating the state at the time of striking a string in the action mechanism of FIG. 1.

Then, the hammer portion 17 of the hammer body 9 strikes the string 7. Immediately before striking, the escapement member 11 is pushed out completely to its back side against the elasticity of the spring plate 43 by the pushing-out protrusion 21 of the hammer body 9, which let off the beak-like projecting piece 19 of the hammer body 9 from the lower surface of the engaging stepped portion 31. As shown in FIG. 5, when the hammer portion 17 of the hammer body 9 strikes, the beak-like projecting piece 19 is positioned more upward than the lower surface of the engaging stepped portion 31 of the escapement member 11 (in the figure). Therefore, when the escapement member 11 is returned from its retreated position by the elasticity of the spring plate 43, the beak-like projecting piece 19 let off from the engaging stepped portion 31 abuts the return sliding surface 39 that is above the lower surface of the engaging stepped portion 31.

Then, after the beak-like projecting piece 19 of the hammer body 9 is let off from the lower surface of the engaging stepped portion 31, the hammer body 9 continues the rotational motion by inertia, and the hammer portion 17 strikes the string 7. Meanwhile, the keyboard portion 3 is depressed by the performer (see FIG. 5). The hammer portion 17 after striking the string 7 is forced back to the lower side (in the figure) by the repulsion of the string 7, which makes the hammer body 9 rotate counter clockwise (clockwise in the figure).

Figure 6:
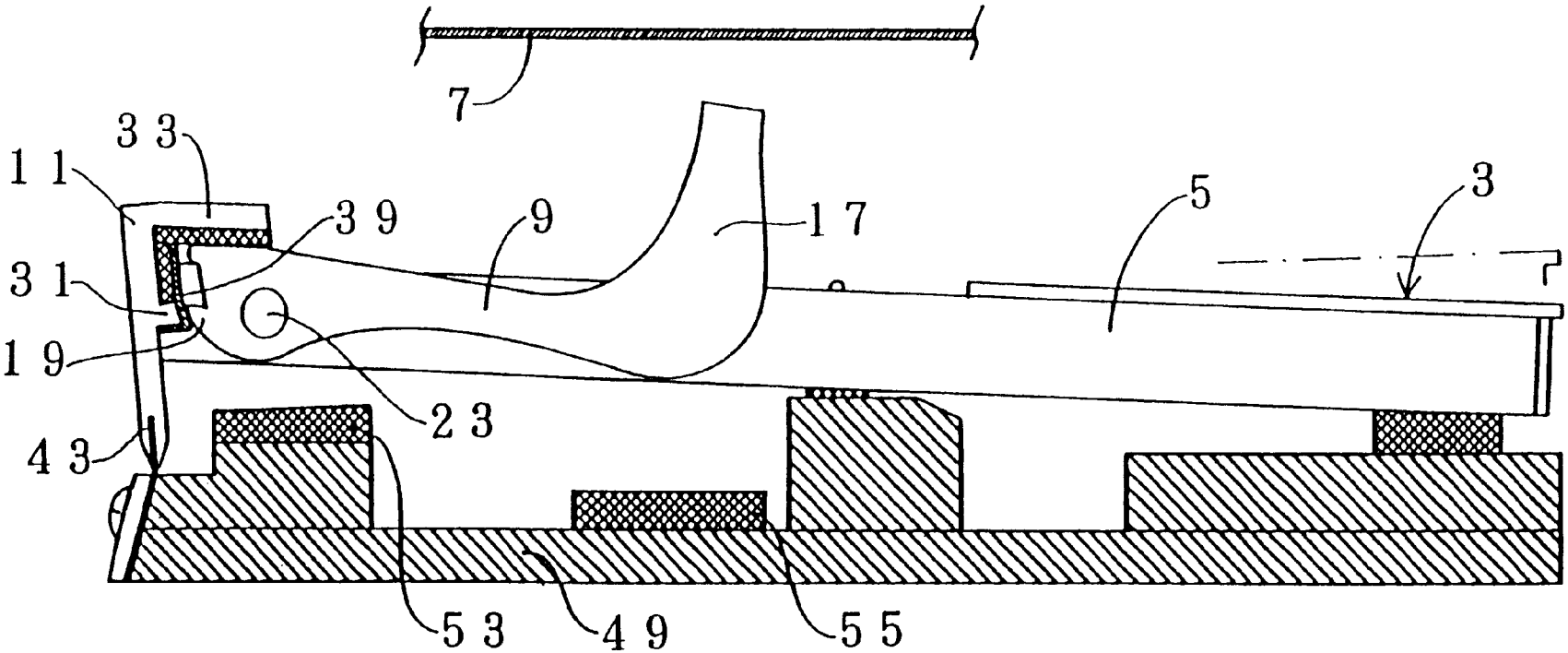
FIG. 6 is a side view illustrating the state in which the hammer body is stopped by a control member after striking the string in the action mechanism of FIG. 1.

Here, the control member 33 of the escapement member 11 abuts the upper surface of the base end of the hammer body 9, which stops the hammer body 9 at the position where the hammer portion 17 is separated from the string 7 (FIG. 6). That is, the lower surface of the control member 33 adheres to the upper surface of the base end of the hammer body 9 by the pressing-down force of the keyboard portion 3 and the control of the control member 33 and is prevented from pivoting clockwise (in the figure) of the hammer body 9, and at the same time, is also prevented from pivoting counter clockwise (in the figure) of the hammer body 9 by the repulsion of the collision of the lower surface of this control member 33 and the hammer body 9. In this way, since the pivoting of the hammer portion 17 is stopped by the control member 33, the hammer body 9 does not strike the string 7 again by rebounding.

Finally, when the performer releases the keyboard portion 3, the opposite side end of the keyboard body 5 falls while the keyboard portion 3 rises, which causes the beak-like projecting piece 19 to slide along the return sliding surface 39 and to return to under the engaging stepped portion 31. On the other hand, the hammer body 9 is then released from the control by the control member 33, drops to the cushion 55 due to its own weight, and returns to the state shown in FIG. 1.

In this way, in the first embodiment of the present invention, since the pushing-out protrusion 21 is provided in the base end of the hammer body 9, which is to be a pushing-out member for letting off the beak-like projecting piece 19 of the hammer body 9 from the engaging stepped portion 31 by pushing out the escapement member 11 to the opposite side with respect to the hammer body 9 with the striking pivotal operation of the hammer body 9, the beak-like projecting piece 19 of the hammer body 9 can be forced to be let off from the engaging stepped portion 31 of the escapement member 11. Therefore, since a member such as the supporting pole 375 for increasing a shifting component in the horizontal direction (the direction toward keyboard portion) of the beak-like projecting piece 379 as required in conventional examples is unnecessary or can be made small, the length of the keyboard body 5 can be designed short, the height of the action mechanism 1 can be designed extremely low and the depth extremely shallow.

In addition, in the first embodiment, since the control member 33 is integrally formed in the escapement member 11 for separably opposing the hammer body 9 in the striking direction and separating the hammer body 9 from the string 7 to stop in the state in which the beak-like projecting piece 19 is separated from the engaging stepped portion 31, the back-check 389 as required in the conventional examples become unnecessary and the number of components and the number of assembly steps can be reduced. In addition, since the bulky back-check 389 becomes unnecessary, the height of the action mechanism 1 can be made low.

Further, the first embodiment has the configuration in which the pushing-out protrusion 21 to be a pushing out member is provided in the base end of the hammer body 9, however, a pushing-out member in accordance with the present invention may be provided in the escapement member 11 side instead of the hammer body 9 side.

Figure 7:
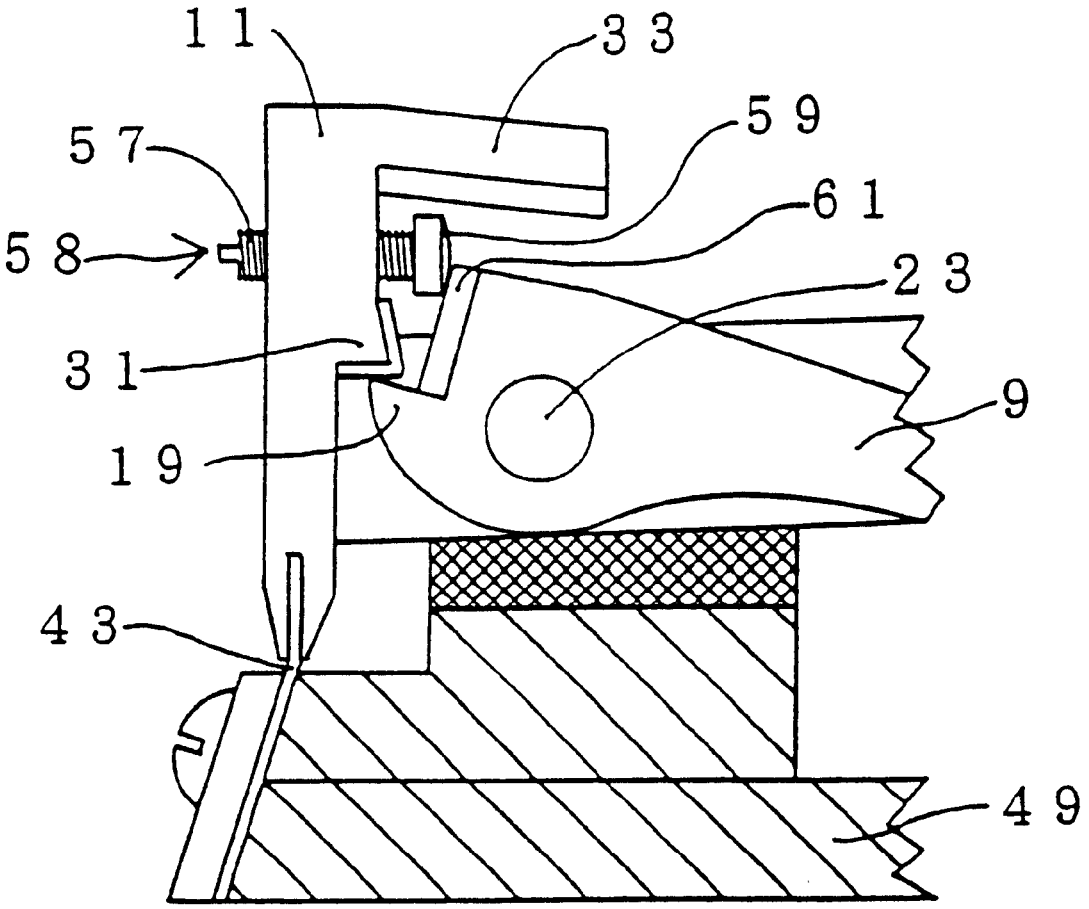
FIG. 7 illustrates a second embodiment of the present invention and is a side view illustrating a main part of a modified portion of the action mechanism of the first embodiment.

Moreover, as in a second embodiment of the present invention shown in FIG. 7, another configuration may be employed in which an adjustment screw 57 is attached to an escapement member 11 in the manner the adjustment screw 57 can protrude and move backward by the rotational operation of the escapement member 11, which adjusts the space between the escapement member 11 and the cushion 61 provided in the hammer body 9 side. In this case, there is an advantage that a beak-like projecting piece 19 of the hammer body 9 can be forced to be let off from an engaging stepped portion 31 of the escapement member 11 by the abutment of a head 59 of the adjustment screw 57 and the cushion 61 provided in the hammer body 9 side. In addition, there is another advantage that the timing for letting off the beak-like projecting piece 19 and the engaging stepped portion 31 can be adjusted exactly by rotating the adjustment screw 57 utilizing a flat gripping portion 58 to protrude or move backward.

Figure 8:
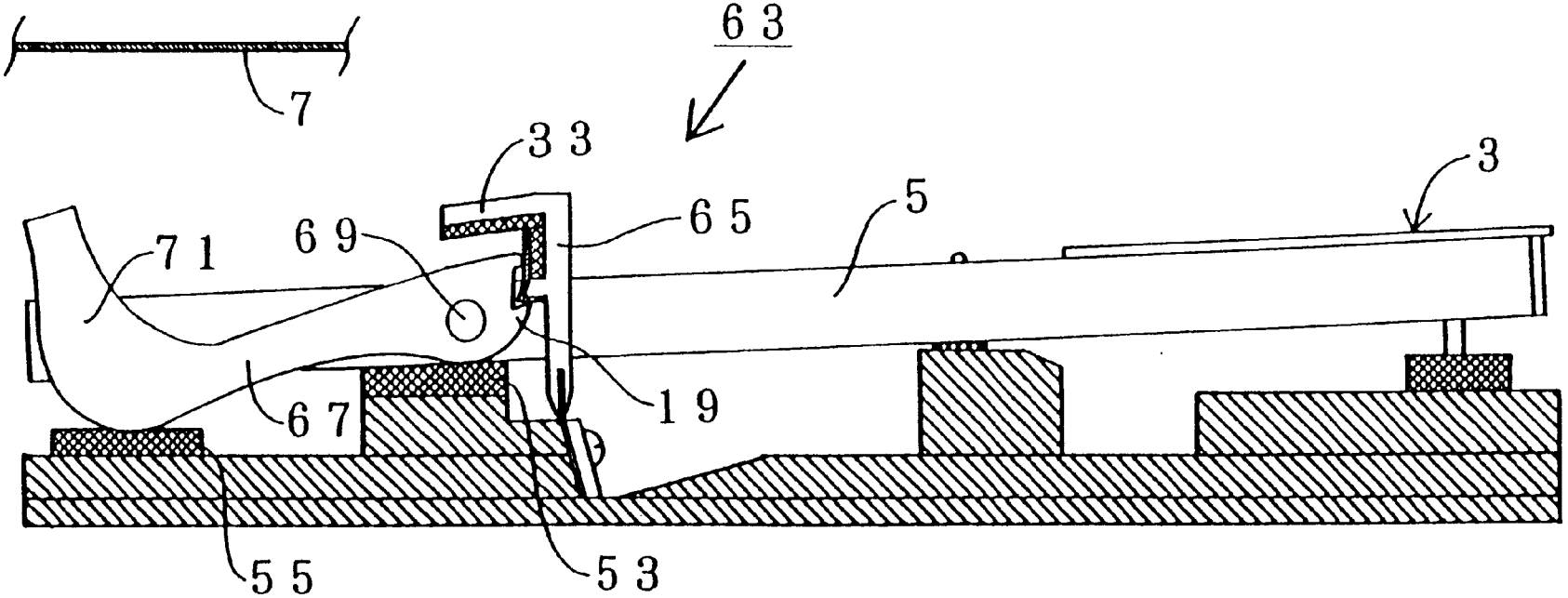
FIG. 8 is a side view illustrating an action mechanism used in a keyboard musical instrument of a third embodiment of the present invention.

A third embodiment of the present invention will now be described with reference to FIG. 8. In an action mechanism 63 of the third embodiment, an escapement member 65 is disposed in a keyboard portion 3 side view from a screw union 69 (an illustration of the other screw union is omitted) used for pivotally fixing a hammer body 67. Further, since a configuration of other parts of the action mechanism 63 of the third embodiment is the same as that of the action mechanism 1 of the first embodiment, its description is omitted.

Figure 9:
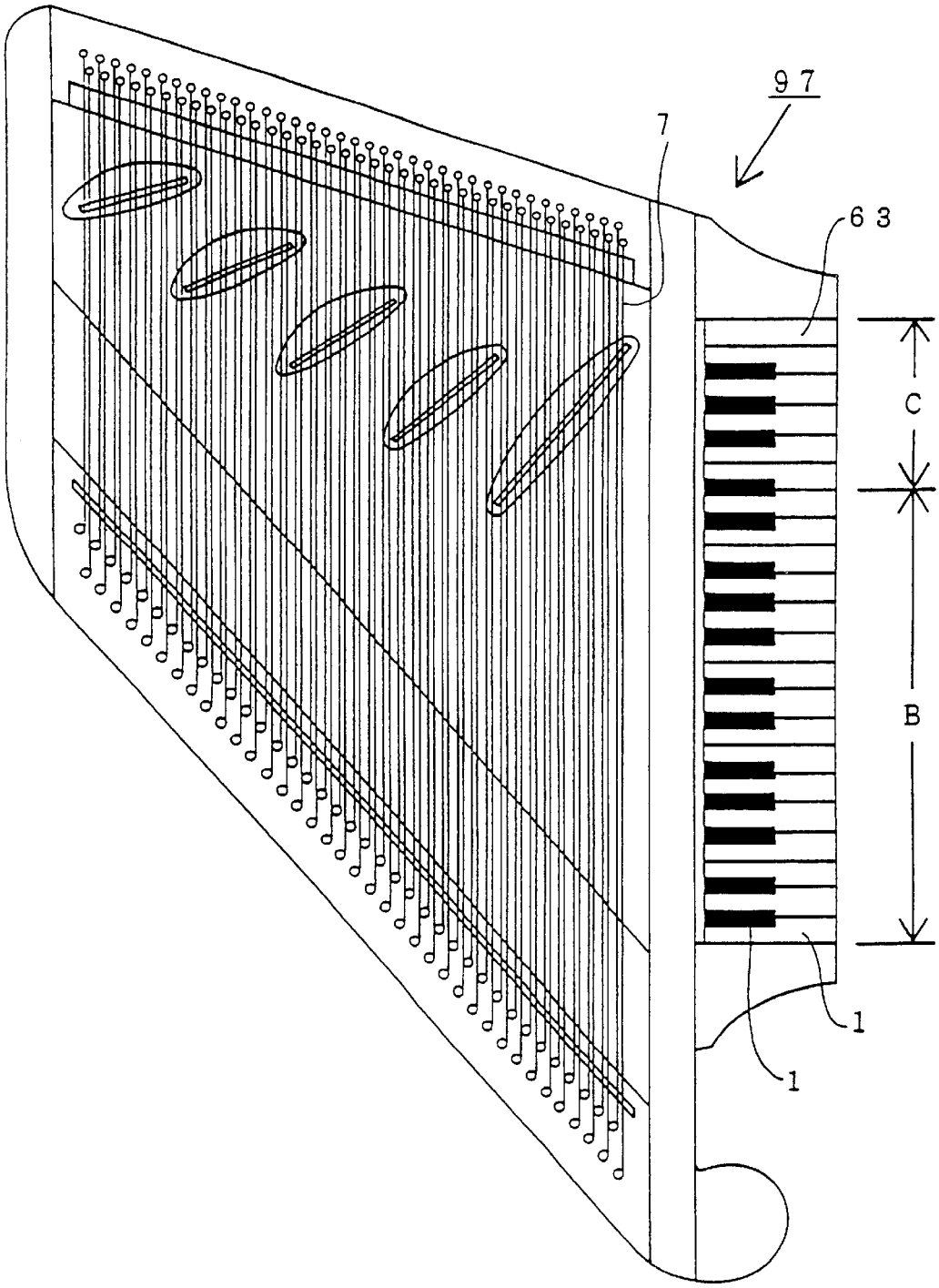
FIG. 9 is a plan view illustrating a keyboard musical instrument employing the respective action mechanisms of the first through the third embodiments of the present invention.

In accordance with this action mechanism 63, since both the hammer body 67 and the escapement member 65 are disposed in the keyboard portion 3 side with respect to a striking point of a hammer portion 71 of the hammer body 67, the hammer body 67 and the escapement member 65 does not protrude to the opposite side of the keyboard portion 3 with respect to the striking point of the hammer portion 71. Therefore, as shown in FIG. 9, in the case of a keyboard musical instrument 97 whose keyboard bodies 5 are serially getting longer from a bass part to a treble part, there is an advantage that the depth of the entire keyboard musical instrument 97 can be designed small by applying, for example, the action mechanism 1 of the first embodiment to keyboards in a bass range (B in the figure) and the action mechanism 63 of the third embodiment to keyboard in a treble range (C in the figure) respectively, depending on the arrangement of strings 7.

Figure 10:
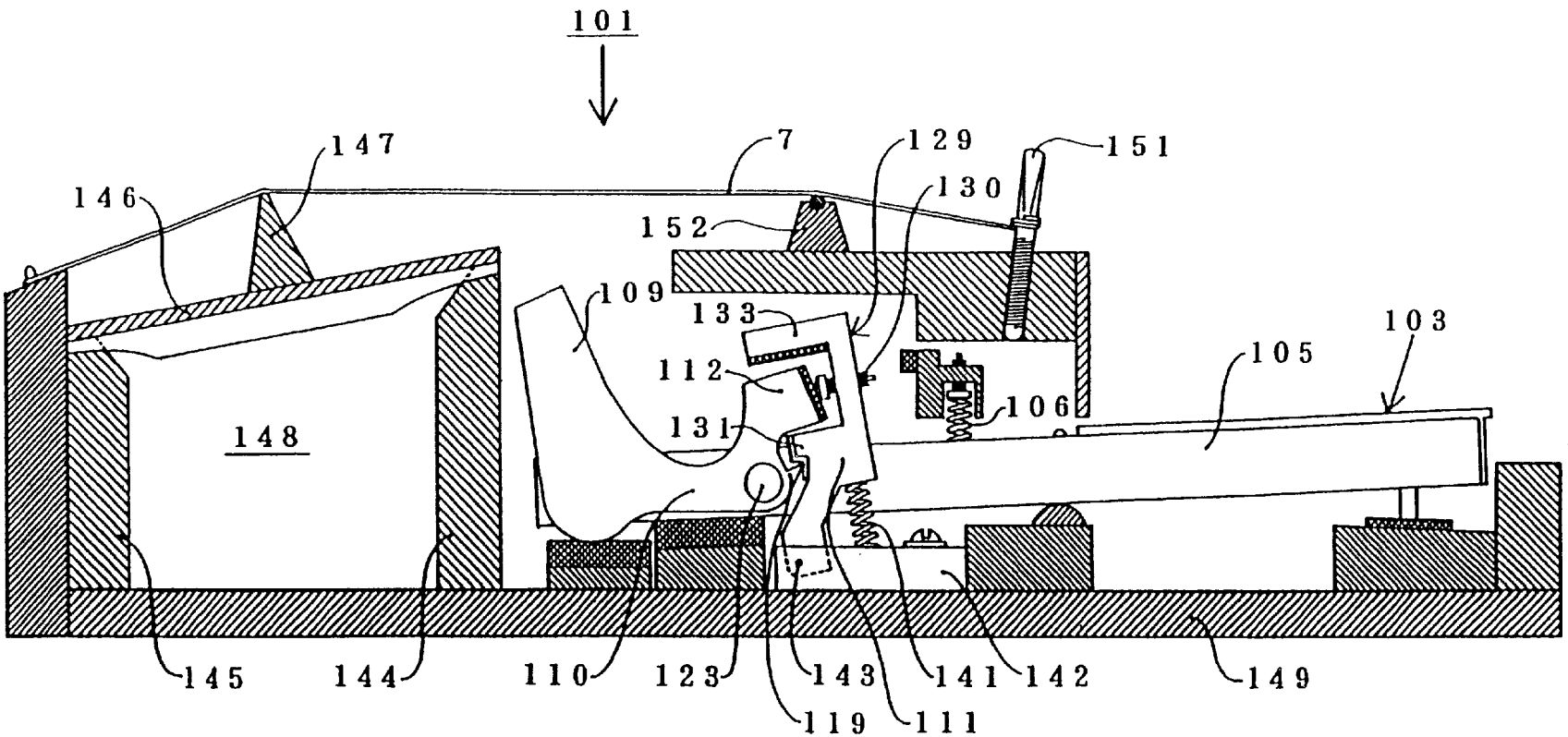
FIG. 10 is a side view illustrating an action mechanism used in a keyboard musical instrument of a fourth embodiment of the present invention.

A fourth embodiment of the present invention will now be described. As shown in FIG. 10, an action mechanism 101 in a keyboard musical instrument of the fourth embodiment has an escapement member 111 disposed on a keyboard portion 103 side with respect to a screw union 123 (an illustration of the other screw union is omitted) for pivotally attaching a hammer body 109, and has something in common with the third embodiment in this regard. However, the action mechanism 101 is made smaller and made to enable a playing state as in playing an accordion, i.e., to enable a standing play.

The hammer body 109 in the fourth embodiment has an arm portion 110 formed relatively short, and a beak-like projecting piece 119 to be a projecting piece and an operation block 112 to be a pushing-out member projecting toward the upper side (a string 7 side) with respect to an extended line of the arm portion 110 respectively formed in its base end (its right end in FIG. 10). On the other hand, an escapement member 111 is provided with a recessed portion and has an engaging stepped portion 131 formed below the recessed portion and a control member 133 formed in the inside upper part of the recessed part respectively, and screws an adjustment screw 130 in a back portion piece 129 of the escapement member 111. The lower end of the escapement member 111 is swingably fixed to a mounting base 142 by a shaft 143 and, at the same time, a coil spring 141 is mounted in a keyboard portion 103 side (the right side in FIG. 10) of the escapement member 111, which always biases the escapement member 111 toward the base end of the hammer body 109. On the other hand, a coil spring 106 is mounted on the upper surface of the keyboard body 105, which always biases the keyboard body 105 downward.

In addition, although the hammer body 109 is relatively and pivotally attached to the keyboard body 105 by a screw union 123, preferably, a thrust bearing (not shown) is mounted between the hammer body 109 and the keyboard body 105 instead of the washer 26 shown in FIG. 2, for the purpose of reducing sliding friction between them.

Frames 144 and 145 are provided on a machine base 149, a resonance plate 146 is mounted in the upper end of these frames 144 and 145, and a bridge 147 of a triangular prism shape is fixed in substantially the center of the resonance plate 146. The machine base 149, the frames 144 and 145, and the resonance plate 146 form a resonance box 148. In addition, a tuning pin 151 for fixing one end of a string 7 as well as adjusting the stretching condition of the string 7, and a trapezoid bridge 152 are fixed in a fixed portion similar to that disposed above the machine base 149.

Figure 11A:
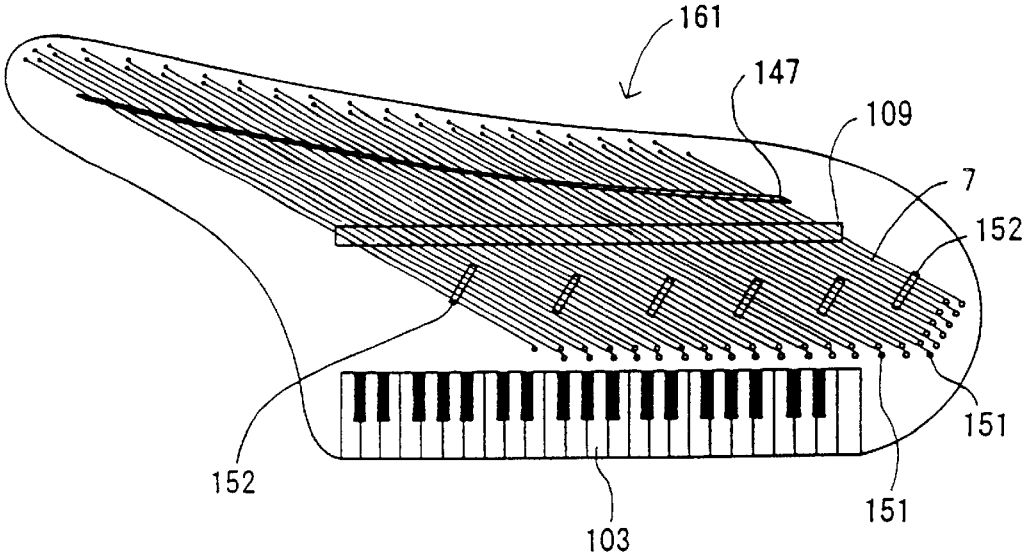
FIG. 11 is a plan view illustrating examples of two kinds of keyboard musical instruments employing the action mechanism of FIG. 10.
Figure 11B:
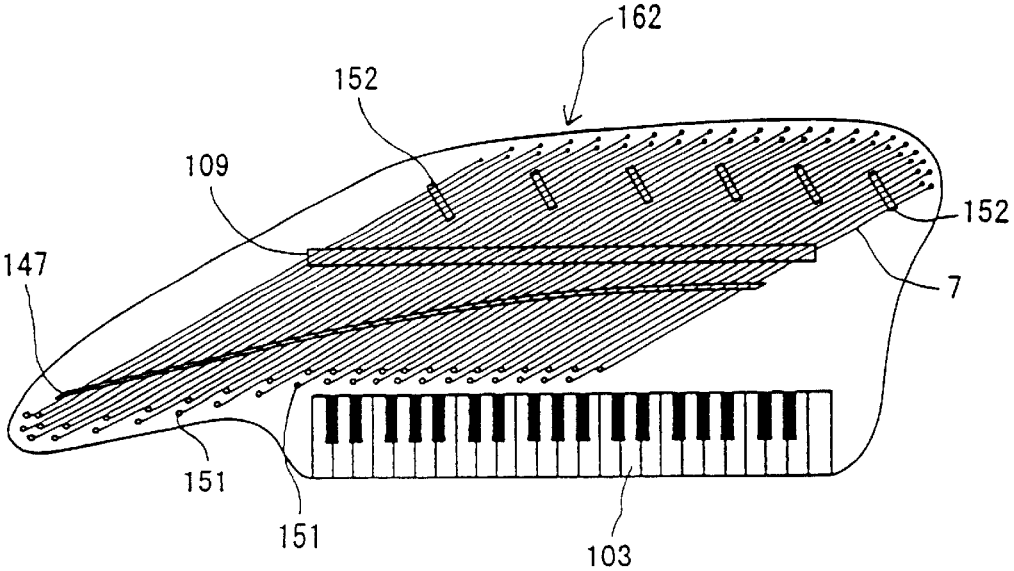

The string 7 may be stretched toward the left backend viewed from the front side (in the figure) (a performer side), as in a keyboard musical instrument 161 shown in FIG. 11(A), or may be stretched toward the right backend viewed from the performer side as in a keyboard musical instrument 162 shown in FIG. 11(B). Further, both the keyboard musical instruments 161 and 162 show an example in which the lengths of the keyboard bodies 105 are identical. In addition, the action mechanism 1 and the action mechanism 63 may be applied to the keyboard musical instruments 161 and 162.

Since the action mechanism 101 of the fourth embodiment has the operation block 112 to be a pushing-out member that protrudes toward the upper side (the string 7 side) with respect to an extended line of the arm portion 110 of the hammer body 109, even in a case the keyboard portion 105 and the arm portion 110 of the hammer body 109 are formed short, the escapement member 111 is not made small but can be designed in a sufficient size to perform an accurate operation, and further can have durability.

Moreover, since the mounting position of the screw union 123 can be designed lower in respect to the operation block 112, the entire keyboard musical instrument can be designed flat. In addition, in this embodiment, since the coil spring 141 is mounted under the escapement member 111 and the escapement member 111 is always biased toward the base end of the hammer body 109, it is not likely for the hammer body 109 to hit the string 7 inadvertently even if the keyboard musical instruments 161 and 162 are held with the bass range side (the left side in FIGS. 11(A) and (B)) at the top. In addition, since the thrust bearing is mounted between the hammer body 109 and the keyboard body 105, there is only a small friction between them. Moreover, since the keyboard body 105 is always biased downward by the coil spring 106, the keyboard portion 103 never rises. Therefore, a performer can play such a keyboard musical instrument by standing or sitting in a performing state such as in playing an accordion.

A keyboard musical instrument of a fifth embodiment of the present invention will now be described based on FIGS. 12 through 14. The appearance of the keyboard musical instrument is a shape of an upright piano with an upper part of a keyboard taken off to be made smaller, but other appearances may be adopted. For example, an appearance identical with or similar to the keyboard musical instruments 97, 161 and 162 may be adopted. In this way, since various appearances can be selected and adopted, only an action mechanism 171 part in a keyboard musical instrument will hereinafter be described.

Since this action mechanism 171 has basically the same structure as that of the action mechanism 101, the same symbols are given to the same members and descriptions on the same members are omitted, and only the different main parts will be illustrated and described.

The action mechanism 171 has the escapement member 111 completely identical with that of the action mechanism 101, but has a hammer body 172 engaging the escapement member 111 different from the hammer body 109 of the action mechanism 101, and at the same time is different from the action mechanism 101 in that a sound generating body is a metal plate 173 disposed vertically instead of the string 7.

In the action mechanism 171, a cushion material 175 made of felt to which the lower end of a hammer portion 174 of the hammer body 172 abuts is disposed in the opposite side end of the keyboard portion 103 of the keyboard body 105. In addition, a striking sound generating portion 176 contacting the metal plate 173 provided in the top end of the hammer portion 174 such that the striking sound portion 176 is perpendicular to the metal plate 173 when striking sounds are generated. Further, the top end of the striking sound generating portion 176 is formed as a circular curved surface 177 as shown in FIG. 12, and striking sound generating portion of other shapes are made to be appropriately attachable to the hammer portion 174. The metal plate 173 is held by hanged supporting members 179 that are inserted and held in openings 178 in the upper and lower end sides of the metal plate 173.

Figure 14:
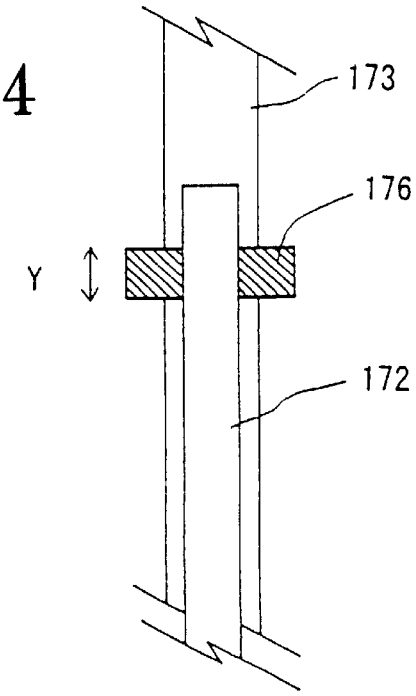
FIG. 14 is a view from the back of the hammer portion illustrating the hammer portion of the hammer body and the part of the sound source body of FIG. 12 overlapping each other.

In addition, the striking sound generating portion 176 may be stuck in an appropriate position by shifting the mounting position of the striking sound generating portion 176 as indicated by an arrow Y of FIG. 14. Further, in FIG. 14 although the metal plate 173 is hanged vertically, even if the metal plate 173 is disposed inclininglyly, the striking sound generating portion 176 can be stuck inclined correspondingly. The configuration for sticking the striking sound generating portion 176 and enabling it to shift, can be also applied to the aforementioned first through fourth embodiments.

Under the keyboard portion 103, a pedestal 180 fixed on a machine base 149, a keyboard position regulating bar 181 having an oval-shaped cross section fixed on the pedestal 180, and a cushion portion 182 made of felt material and the like of disk-shape mounted on the pedestal 180 are provided. The keyboard position regulating bar 181 performs positional regulation in the latitudinal direction of the keyboard body 105 by entering a screw slot like groove 183 provided in the keyboard body 105. Further, the groove 183 is blocked by the keyboard portion 103 at its top end.

A semi-spherical shaped supporting portion 184 is provided on the pedestal 15, in the manner of crossing the keyboard body 103, in order to ease the swing of the keyboard body 103. Further, it is preferable to mount a cushion material made of felt and the like on this supporting portion 184. The pin 13 having the circular cross section is a hole provided in the keyboard body 105, and is configured to enter a fan-shaped hole 185 having longer longitudinal length toward the upper part and to be made swingable around the abutting part of the keyboard body 105 and the supporting portion 184 as a fulcrum.

One end side of the coil spring 106 enters a cavity 187 provided in a fixed portion 186 fixed on the machine base 149 and the other end abuts the keyboard body 105. The biasing force of the coil spring 106 is made to be adjusted by the adjustment screw 188. A cushion member 189 made of felt and the like is stuck and fixed on the fixed portion 186, which functions as a cushion when the back portion piece 129 of the escapement member 111 knocks against the fixed portion 186.

A sixth embodiment of the present invention will now be described. Only an action mechanism 201 will be described as well concerning this embodiment. The action mechanism 201 is considerably different from that of other embodiments in that a control member is formed in a fixed portion that is integral with the machine base 49, 149 whereas the previously shown control members 33 and 133 are integrally formed in the escapement members 11, 65 and 111. Further, since most of the other parts have the similar configurations as the action mechanism 101 of the fourth embodiment and the action mechanism 171 of the fifth embodiment, the same symbols are given to the same members and their descriptions are omitted or simplified.

The hammer body 202 has, other than the beak-like projecting piece 119 to be a projecting piece and the operation block 112 to be a pushing-out member, a hammer portion 203 for striking the string 7, a rear abutting portion 204 for contacting and separating from the cushion material 175, and a moving-over portion for repeated striking 205 mounted on the rear end (the left side in FIG. 15) of the operation block 112.

The escapement member 207 has a similar configuration as that of the escapement member 111 of the fourth and the fifth embodiment, but is different in that it does not have the control member 133. In this action mechanism 201, a fixing control portion 208 to be a control member is fixed to the fixed portion 186. In this fixing control portion 208, a cushion portion 209 made of felt and the like is provided in a part to which the upper surface of the operation block 112 of the hammer body 202 abuts. In addition, a rubber member 210 is attached to the rear end of the fixing control portion 208 by a bolt 212 and a nut 213 via an inserted member 211.

The pin 221 fixed on the pedestal 15 at it lower end is fixed at both ends by its upper end entering an upper side of the supporting portion 222 having the same shape as the supporting portion 184. The performer's side top end of the keyboard body 105 is a screw slot portion 223, and its opening portions in the upper side and the top end side and are blocked by the keyboard portion 103. In the rear end (the left end in FIG. 15) of the keyboard body 105, a spring abutting portion 224 with its upper side cut off is provided, and a coil spring 225 is disposed such that its one end abuts this spring abutting portion 224.

The other end of the coil spring 225 enters into and is held by a semi-spherical shaped cylinder portion 226 having a cavity inside. This cylinder portion 226 is formed integrally with an adjustment screw 228 attached to a fixed portion 227 fixed on the machine base 149, and is movable vertically by the pivoting of the adjustment screw 228.

One end of the coil spring 141 abutting the escapement member 207 enters the escapement member 207, and the other end having the same shape as the cylinder portion 226 enters into and is held by a cylinder portion 229 fixed on the mounting base 142. In addition, the bottom part of the cylinder portion 229 is made a screw and is movable vertically by pivoting.

A third pedestal 231 is also mounted and fixed on the machine base 149 other than the pedestals 15 and 180. A cushion member 232 is mounted and fixed on the pedestal 231 in the manner to cross the keyboard body 105. Further, the pedestal 180 is formed in a slope shape with the height being low in its front side and getting higher toward the inner side. On the other hand, the pedestal 231 has a shape making a slope in the direction opposite from that of the pedestal 180. That is, both the pedestals have a symmetrical shape with the supporting portion 184 as the center.

Figure 15:
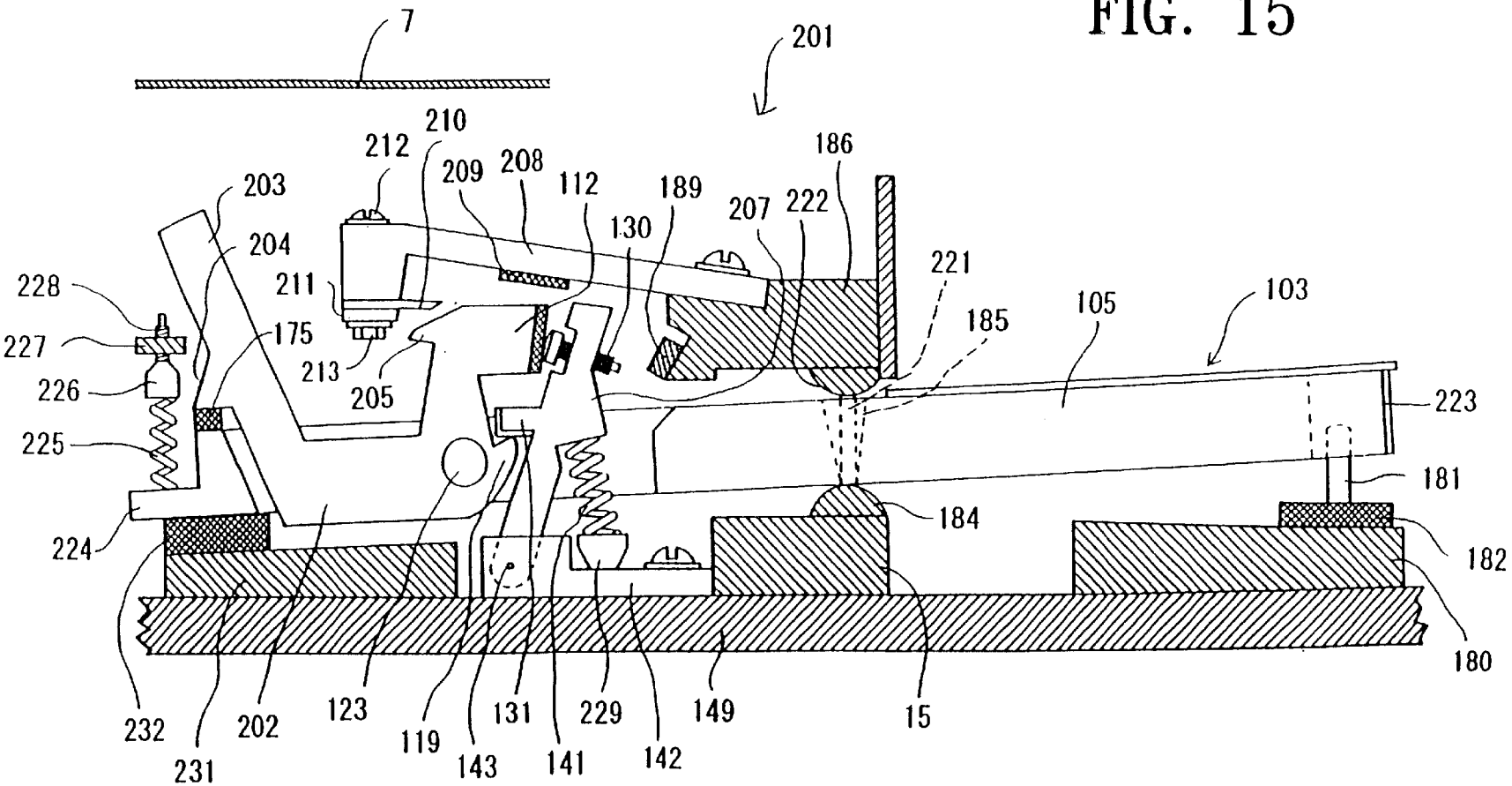
FIG. 15 is a side view illustrating an action mechanism used in a keyboard musical instrument of a sixth embodiment of the present invention.
Figure 16:
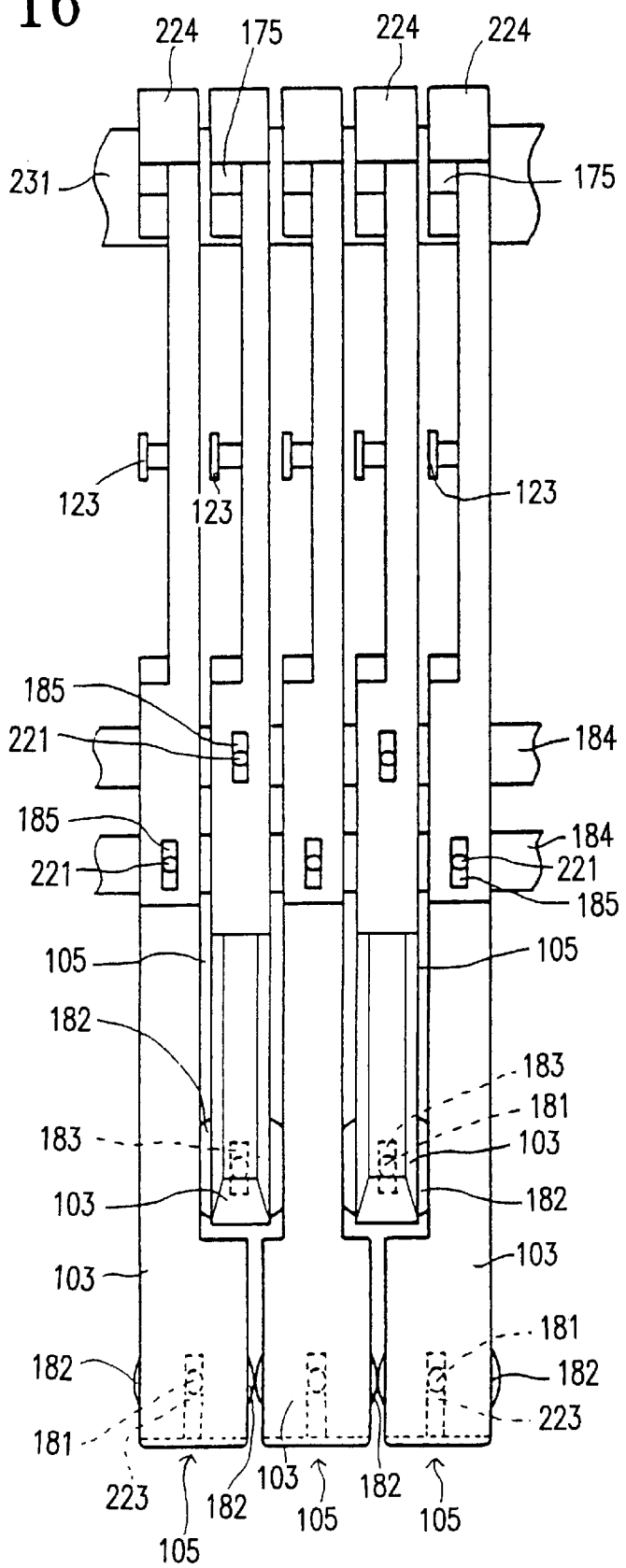
FIG. 16 is a plan view illustrating the state in which a member disposed over a keyboard body as well as a hammer body and an escapement member in the action mechanism of FIG. 15 are taken away.

A plan view of the state in which the fixed portion 186 and the like are disposed above the keyboard body 105 and the escapement member 207 are removed is shown in FIG. 16. FIG. 16 illustratively shows three tones of C, D and E as well as semitone parts between the tones. As shown in FIG. 16, the pins 221 to be swinging fulcrums of the keyboard bodies are arranged in two rows of an alternate arrangement due to the existence of the semitone parts, and the pins 181 of the keyboard portions 103 are also arranged in two rows of an alternate arrangement. Further, the shapes of the respective keyboard bodies 105 are different except that the shapes of two semitone parts are the same. However, the basic configuration of each keyboard body is completely identical with the configuration shown in FIG. 15.

Further, in other embodiments as well, for the keyboard bodies in which the positions of respective hammer bodies are the same with respect to the longitudinal direction, both the pins 13 and 221 to be the swinging fulcrums of the keyboard bodies and the pins 181 of the keyboard portions 3 and 103 are disposed in two rows of an alternate arrangement.

Figure 17:
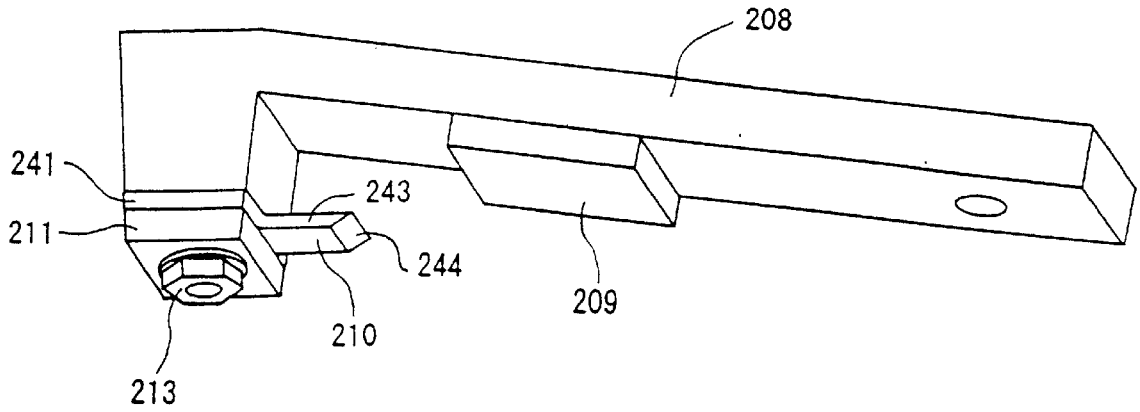
FIG. 17 is a perspective view of a fixed control portion in the action mechanism of FIG. 15.
Figure 18A:
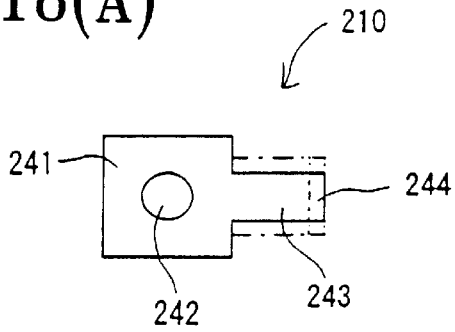
FIG. 18 is a plan view illustrating an example of a rubber member attached on the top end of the fixed control portion in the action mechanism of FIG. 15.
Figure 18B:
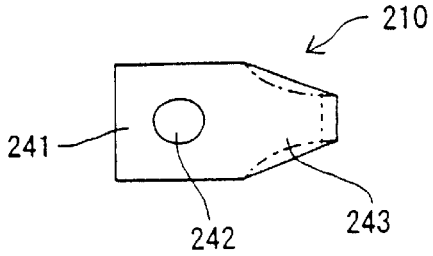

As shown in FIGS. 17 and 18(A), the rubber member 210 is comprised of a square-shaped base portion 241, a through hole 242 in which the bolt 212 is inserted, a rectangular mounting portion 243 over which the moving-over portion for repeated striking 205 moves, and a top end portion 244 having a top end protruding in a triangle shape. Further, the rubber member 210 may have a wider mounting portion 243 as shown by an alternate long and short dot line of FIG. 18(A), or may have a trapezoidal mounting portion 243 as shown in FIG. 18(B). Alternatively, the rubber member 210 may have an angular mounting portion having both side portions formed of a recess-shaped curved line as shown by an alternate long and short dot line of FIG. 18(B). In this way, elasticity (bend) can be adjusted. In addition, the rubber member 210 is replaceable and its protruding position can be adjusted.

Operations of the action mechanism 201 used in the keyboard musical instrument of this sixth embodiment will now be described based on FIGS. 15 through 19 and 24. Further, FIGS. 19 through 23 illustrate only the parts necessary for the description of operations.

In FIG. 15, when a performer strikes a key of the keyboard portion 103, the keyboard body 105 starts to pivot in the clockwise direction (in FIG. 15) with the pin 221 and the supporting portion 184 as a center. At this time, the screw union 123 to be a rotational center of the hammer body 202 rises in the key striking direction, that is, in the direction of the string 7 side. By this rising, the beak-like engaging piece 119 of the hammer body 202 engages the lower surface of the engaging portion 131 of the escapement member 207.

When the keyboard portion 103 is further depressed, since the shift of the beak-like projecting piece 119 is prevented by the engaging stepped portion 131, the hammer portion 203 side of the hammer body 202 further pivots to the string 7 side. At this time, the operation block 112 to be a pushing-out member of the hammer body 202 gradually pushing out the escapement member 207 to its back side (the right side in FIG. 15) against the elasticity (biasing force) of the coil spring 141.

Figure 19:
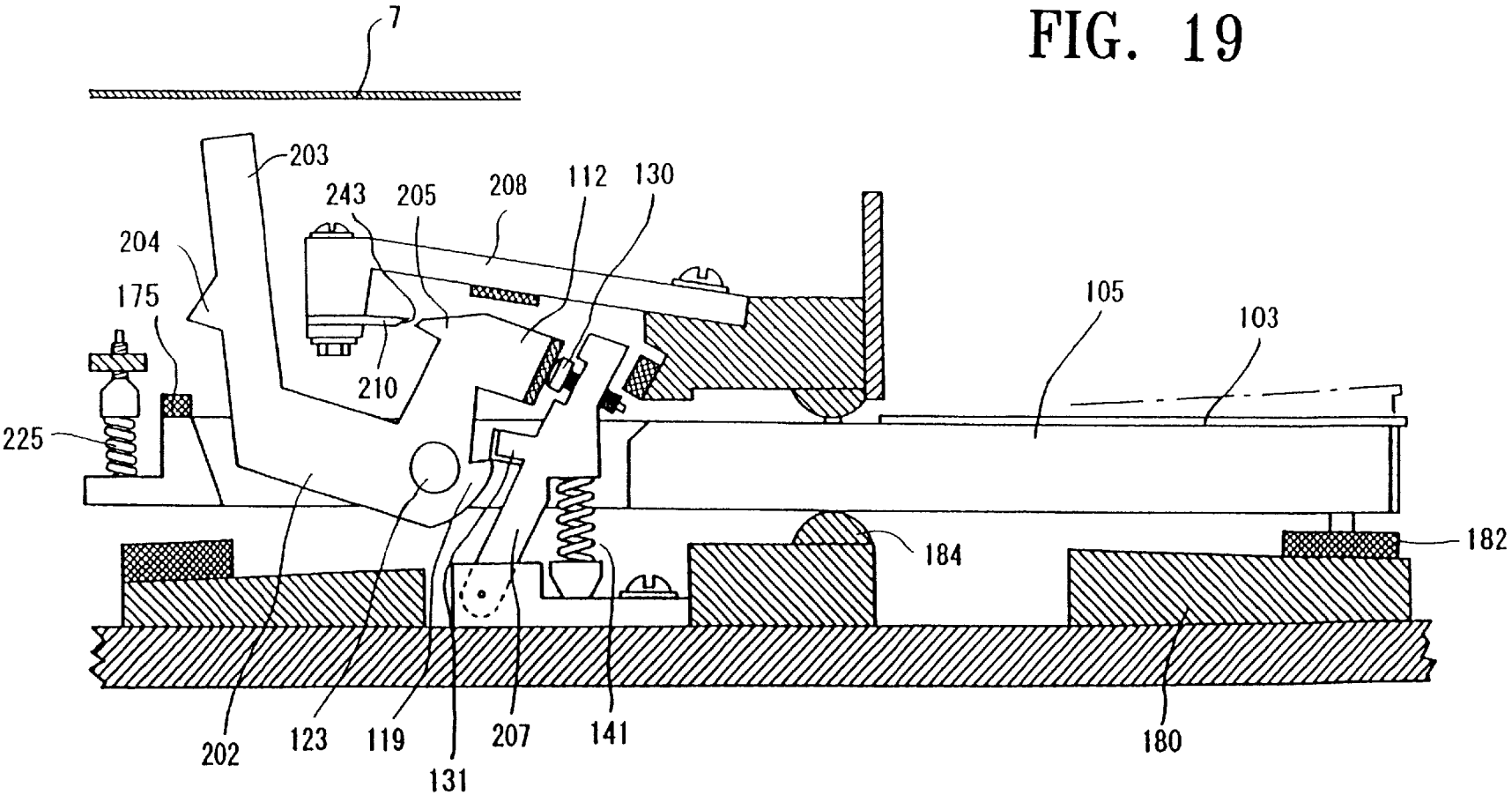
FIG. 19 is a side view illustrating the state immediately after starting key striking in the action mechanism of FIG. 15.
Figure 20:
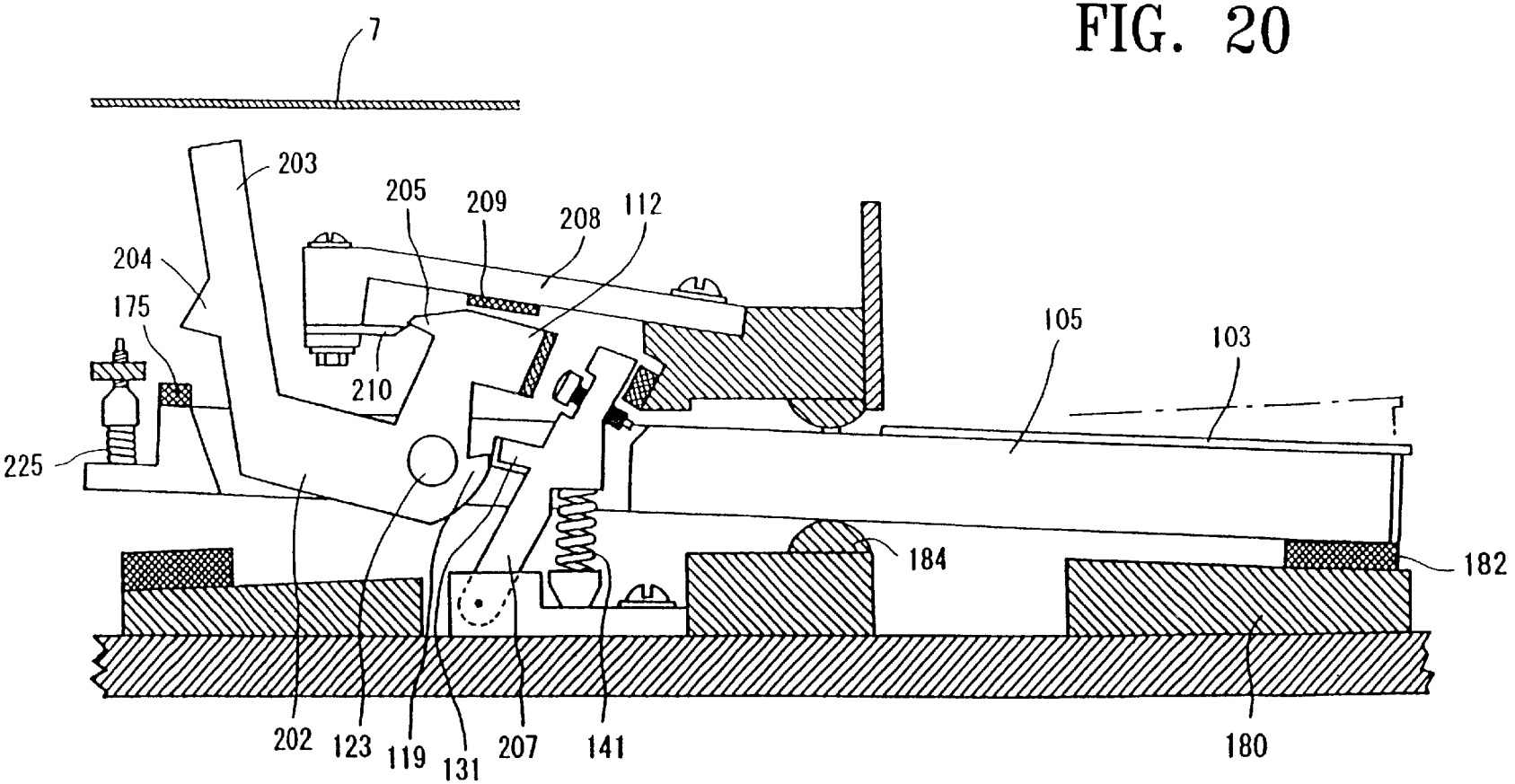
FIG. 20 is a side view showing the state immediately after striking a string in the action mechanism of FIG. 15.

At this time, as shown in FIG. 19, the moving-over portion for repeated striking 205 passes without colliding with the tongue piece like mounting portion 243 of the rubber member 210 fixed in the fixing control portion 208. Then, the hammer portion 203 of the hammer body 202 strikes the string 7, immediately before which the escapement member 207 is completely pushed out to the back portion side by the operation block 112 of the hammer body 202 against the elasticity of the coil spring 141. As a result, the beak-like projecting piece 119 of the hammer body 202 is let off from the lower surface of the engaging stepped portion 131.

Thereafter, the hammer portion 203 of the hammer body 202 strikes the string 7 by the clockwise pivoting of the entire keyboard body 105 (the hammer portion 203 rises) while continuing the rotational operation by inertia. After striking the string 7, the hammer portion 203 is forced back to the lower side (in each figure) by the repulsion of the string 7. As a result, the hammer body 202 rotates in the opposite direction.

Further, at the time of striking, the beak-like projecting piece 119 of the hammer portion 203 of the hammer body 202 is positioned higher (in the figure) than the lower surface of the engaging stepped portion 131 of the escapement member 207. Therefore, when the escapement member 207 returns from its retreated position by elasticity of the coil spring 141, the beak-like projecting piece 119 abuts the return sliding surface which is higher than the lower surface of the engaging stepped portion 131 (see FIG. 20).

Figure 24:
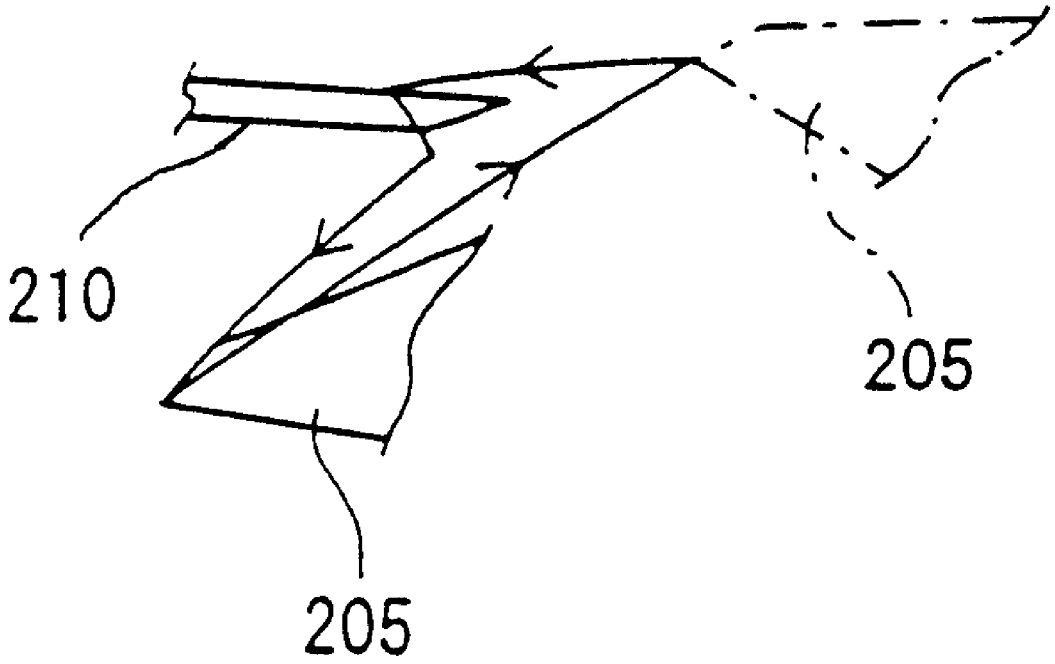
FIG. 24 is a view illustrating the moving track of the top end of the moving-over portion for repeated striking of the hammer body in the action mechanism of FIG. 15.

In this state after striking, the moving-over portion for repeated striking 205 starts to move over the mounting portion 243 of the rubber member 210. This is because rotation of the hammer body 202 takes place with the screw union 123 portion that is shifted upward as a center after striking, that is, after the engaging stepped portion 131 is let off. For ease of understanding of this operation, the track of the top end of the moving-over portion for repeated striking 205 is shown in FIG. 24. Further, a letter S shaped bend in the return stroke in the track shown in FIG. 24 is caused by the mounting portion 243 bending, after the moving over portion for repeated striking 205 moves over the mounting portion 243.

Figure 21:
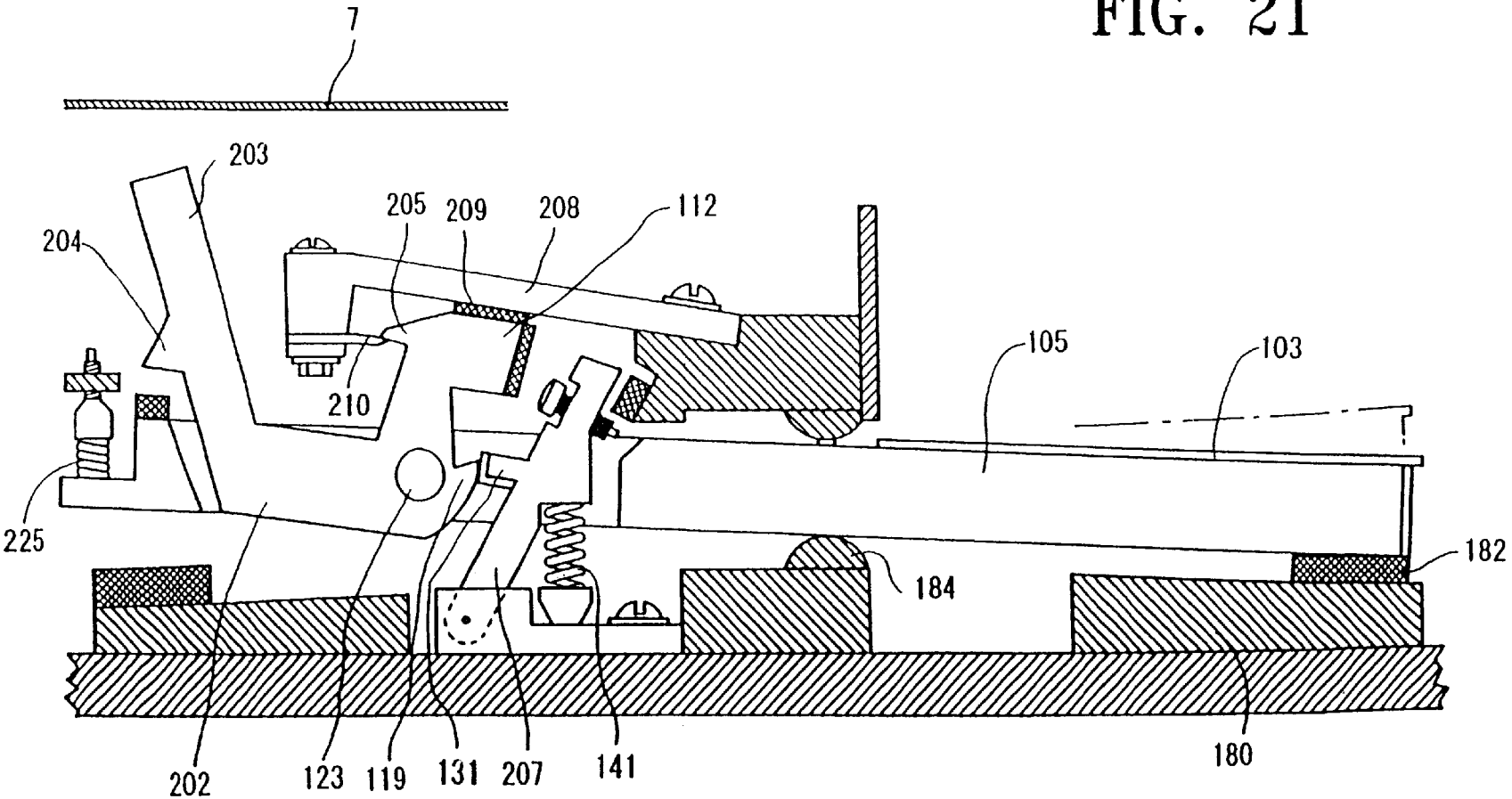
FIG. 21 is a side view illustrating the state in which a moving-over portion for repeated striking of the hammer body has moved over a mounting portion after finishing string striking in the action mechanism of FIG. 15.

When this moving-over takes place, the upper face of the base end of the hammer body 202 abuts the cushion portion 209 of the fixing control portion 208, by which the hammer body 202 is stopped, in the state in which the hammer portion 203 is separated from the string 7 (see FIG. 21). That is, the upper surface of the operation block 112 of the hammer body 202 sticks to the lower surface of the cushion portion 209 by the pivoting force in the clockwise direction from the keyboard portion 103 and the position preserving force of the fixing control portion 208, and pivoting in the counter clockwise direction (in the figure) of the hammer body 202 is prevented, and pivoting in the clockwise direction (in the figure) of the hammer body 202 based on the repulsion at the time of collision of the cushion portion 209, and the hammer body 202 is also prevented. In this way, since the pivoting of the hammer body 202 is stopped by the fixing control portion 208, the hammer body 202 does not rebound to strike the string 7 again.

Figure 22:
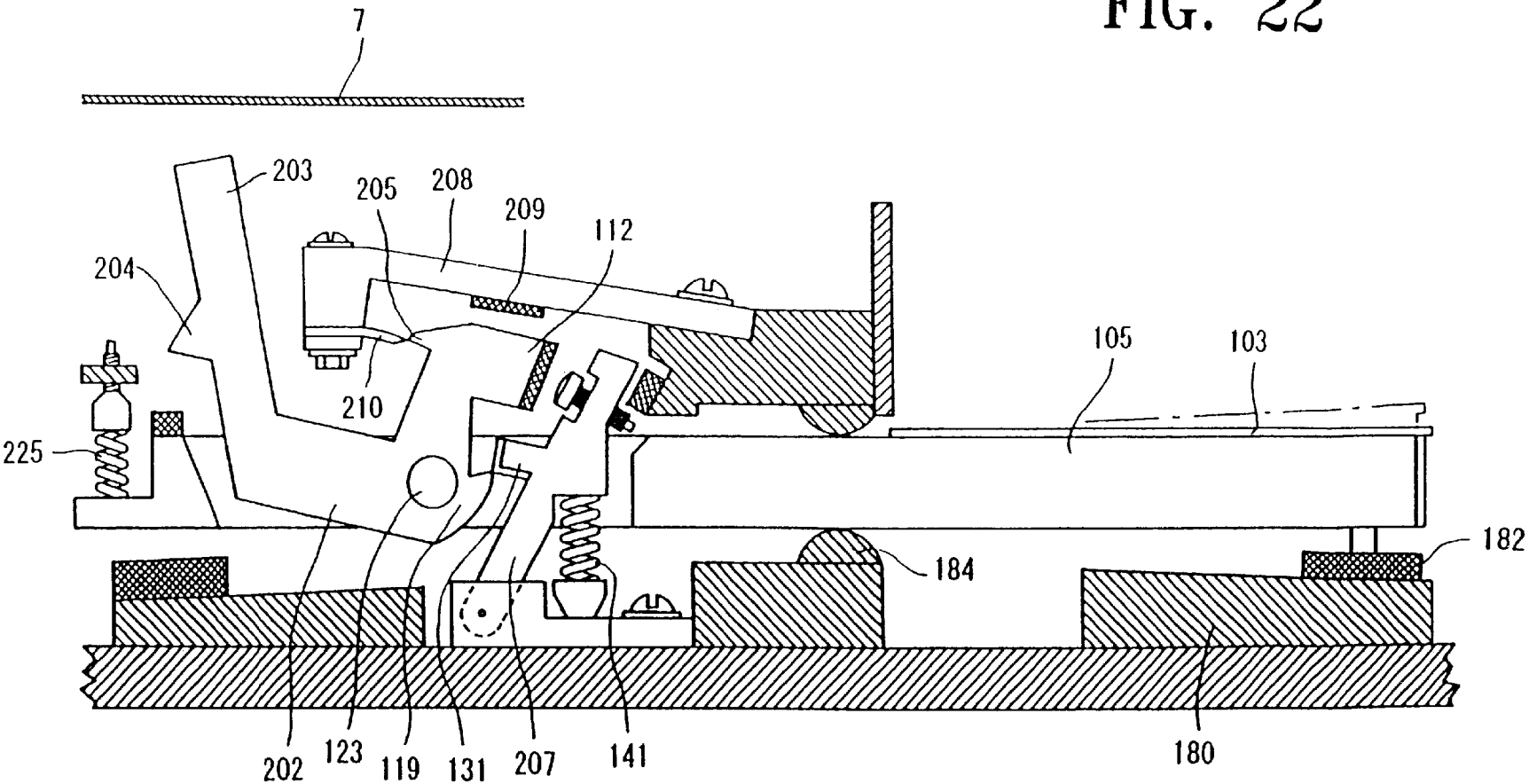
FIG. 22 is a side view illustrating the state immediately before the moving-over portion for repeated striking of the hammer body comes off from the mounting portion after finishing string striking in the action mechanism of FIG. 15.

Thereafter, when the keyboard portion 103 is raised, the mounting portion 243 continues to support moving-over portion for repeated striking 205 while bending (see FIG. 22). When the moving-over portion for repeated striking 205 is about to come off from the mounting portion 243, the beak-like projecting piece 119 is about to enter under the lower surface of the engaging stepped portion 131. The beak-like projecting piece 119 returns to the engagement with the lower surface of the engaging stepped portion 131 utilizing the elasticity of the coil spring 141 simultaneously with or immediately before the moving-over portion for repeated striking 205 coming off from the mounting portion 243.

Figure 23:
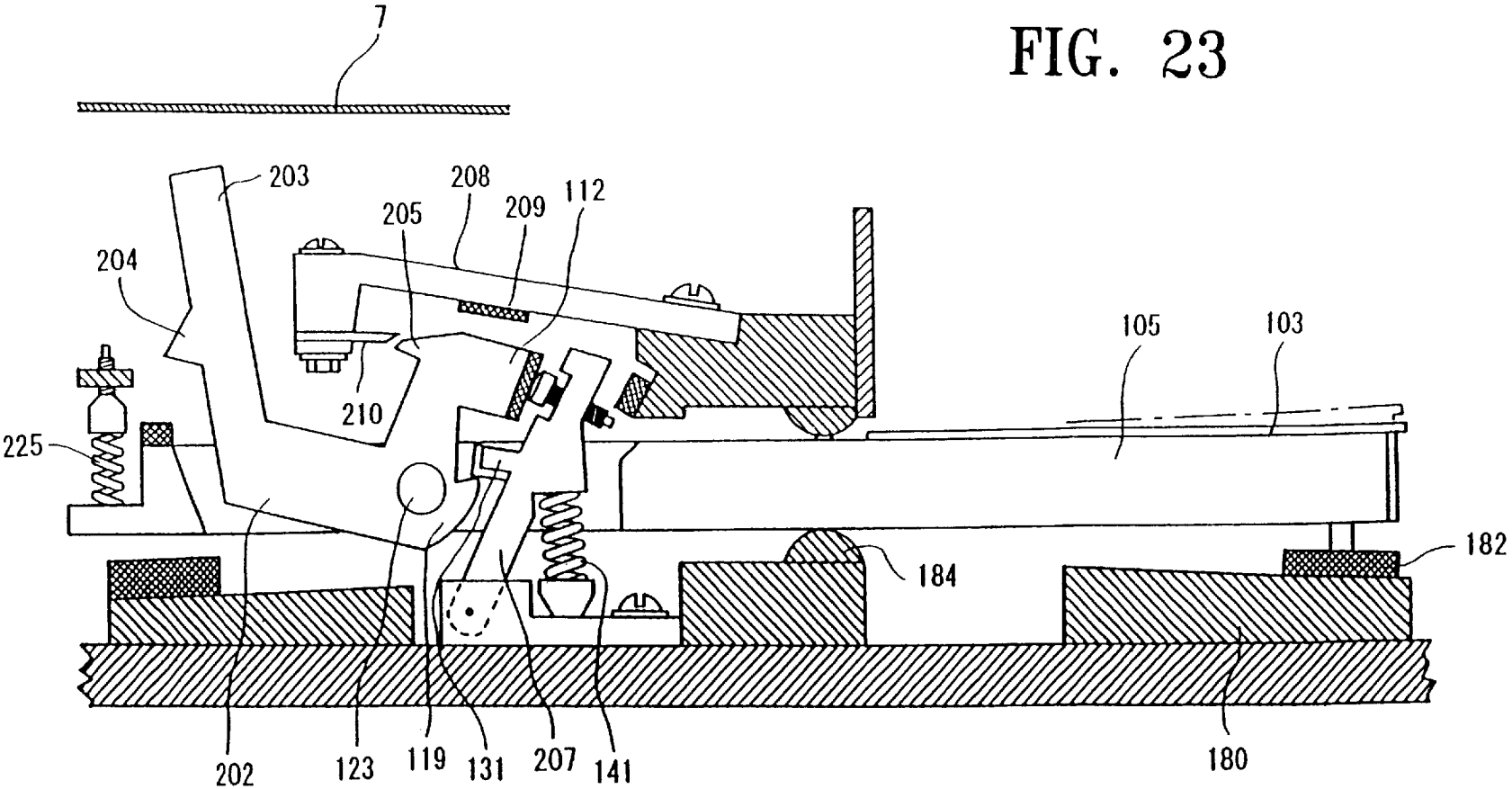
FIG. 23 is a side view illustrating the state immediately after the moving-over portion for repeated striking of the hammer body has come off from the mounting portion after finishing string striking in the action mechanism of FIG. 15.

The state in which the beak-like projecting piece 119 starts to return to the lower surface of this engaging stepped portion 131 is shown in FIG. 23. The state immediately before the beak-like projecting piece 119 is about to completely engage or has completely engaged the lower surface of the engaging portion 131 arises before the keyboard body 105 returns to the original state as shown in FIG. 23. Therefore, the keyboard portion 103 can be depressed to strike the string again, before the state in which the keyboard portion 103 rises to the highest, i.e., the state before key striking shown in FIG. 5. That is, a repetition that is a faster repeated striking becomes possible. To show an example of concrete numerical values, if the possible amount of depressing the keyboard portion 103 is 8 mm, a key striking operation is possible again at the time when the keyboard portion 103 returns by 4.5 mm from the depressing completed point.

Next, a seventh embodiment of the present invention will be described with reference to FIGS. 25 to 46. An action mechanism 601 has basically the same configuration as that of the aforementioned action mechanisms 101 and 171. A main difference is a portion that is added in order to improve repetition (repeated striking function). In addition, only an action mechanism portion of a keyboard musical instrument is described and description of an entire structure of the keyboard musical instrument is omitted in the following description.

Figure 25:
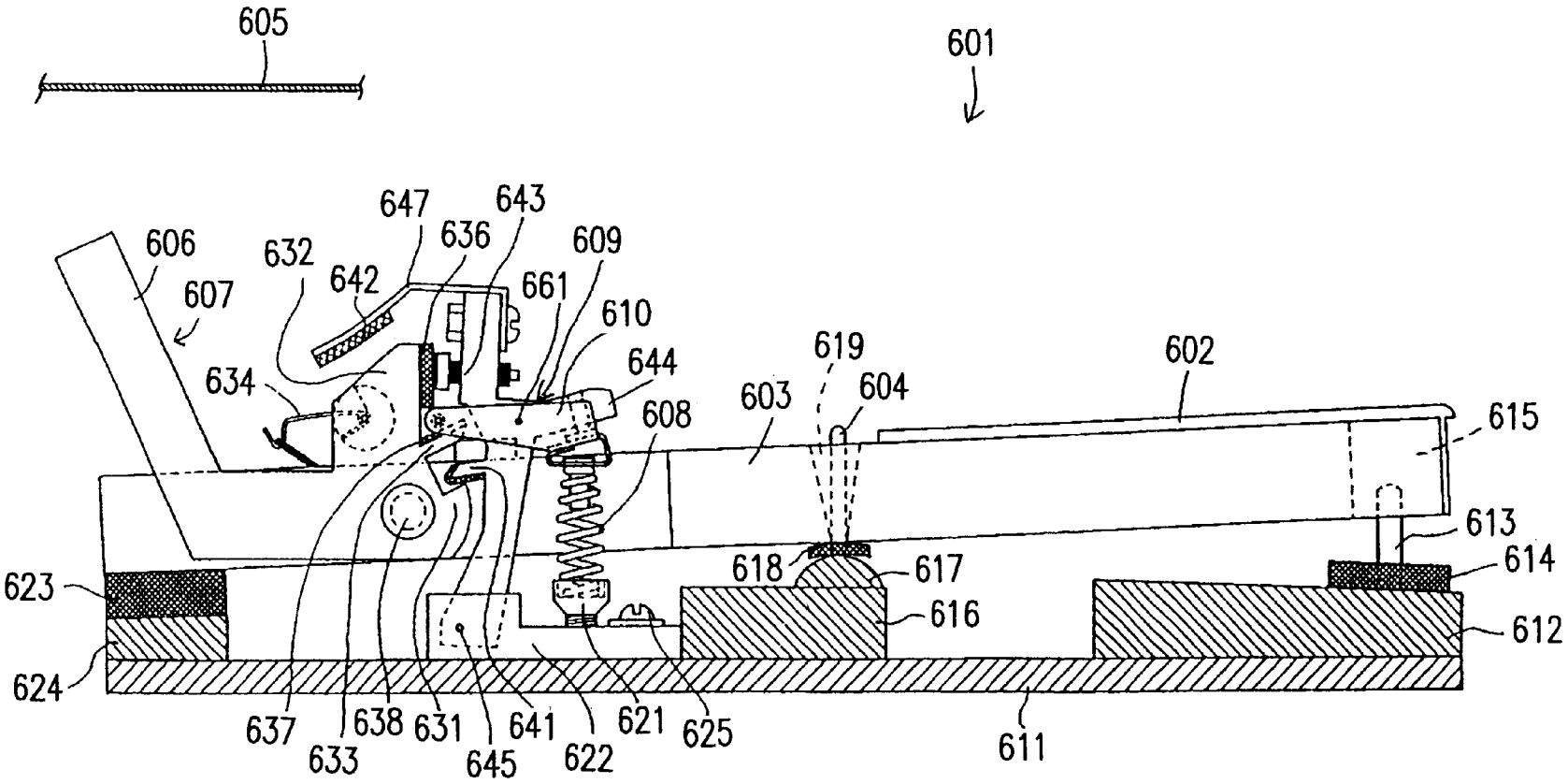
FIG. 25 is a side view illustrating an action mechanism used in a keyboard musical instrument of a seventh embodiment of the present invention.
Figure 26:
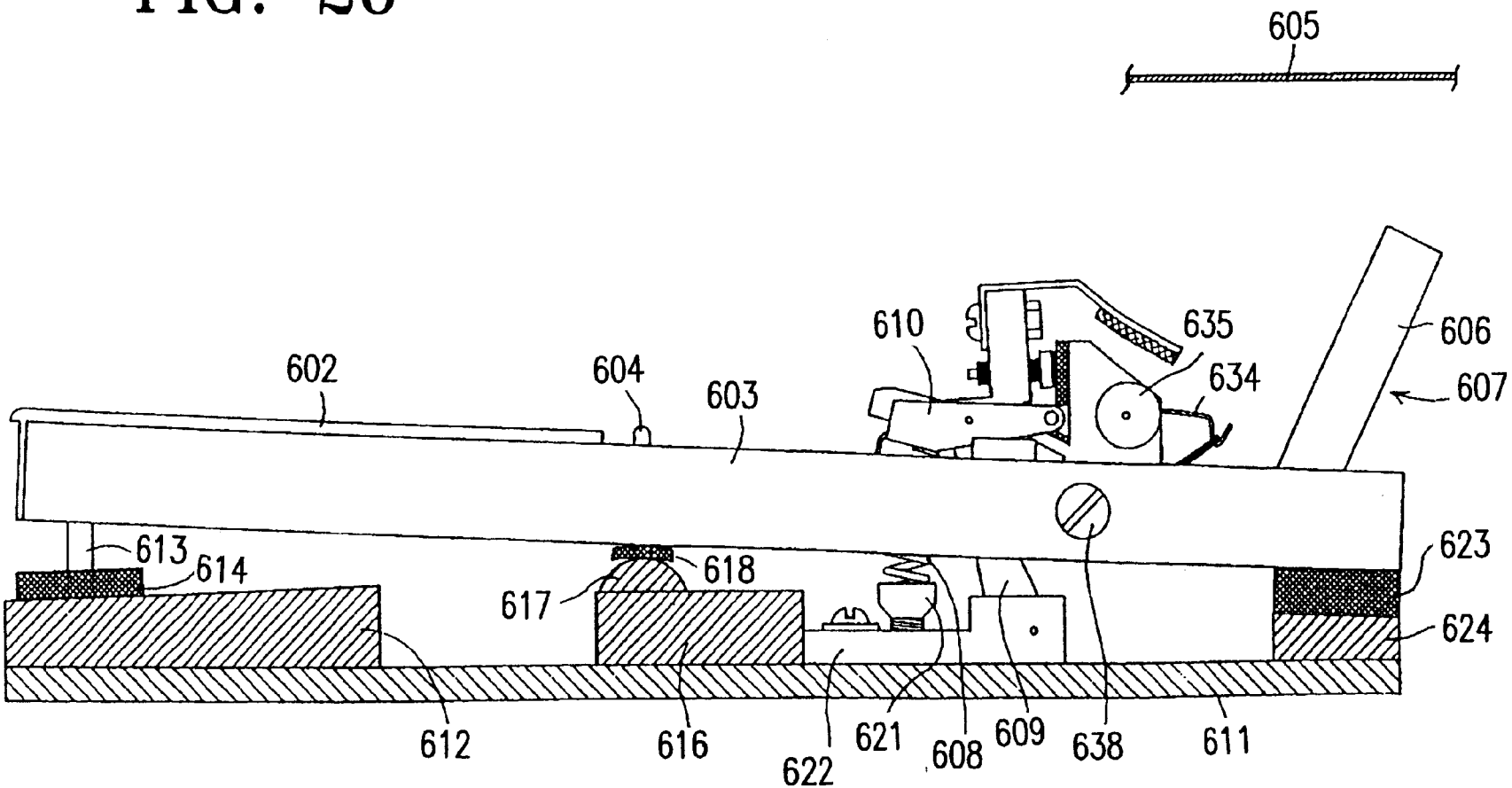
FIG. 26 is a side view of the action mechanism of FIG. 25 viewed from the opposite side.

As shown in FIG. 25, this action mechanism 601 has a keyboard portion 602 in one end and is provided with a keyboard body 603 that is held at an intermediate part in the longitudinal direction to be made swingable, a hammer body 607 that is pivotally fixed at its base on the opposite side of the keyboard portion 602 across a pin 604 to be a holding point as well as a swinging center point of the keyboard body 603 and has a hammer portion 606 for striking a string 605 to be a sound source body, an escapement member 609 that is always biased by a coil spring 608 to be biasing means toward this hammer body 607, and a pivotal member 610 for improving repetition (repeated striking function).

The keyboard body 603 is mounted on a machine base 611. The machine base 611 is provided with a pedestal 612, a keyboard position regulating rod 613 that is fixed to this pedestal 612 and has an elliptical cross section, and a cushion portion 614 made of disc-like felt or the like mounted on the pedestal 612. The keyboard position regulating rod 613 enters a slot-like groove portion 615 provided in the keyboard body 603 to perform positional regulation in the lateral direction of the keyboard body 603. Further, the groove portion 615 is closed by the keyboard portion 602 at its top and on the front side (player side).

The machine base 611 is further provided with a pedestal 616, on which a supporting portion 617 having a semicircular cross section is disposed traversing the keyboard body 603 in order to facilitate swinging of the keyboard body 603. A cushion material 618 made of felt or the like is mounted on this supporting portion 617. The pin 604 inserted and secured in the supporting portion 617 is made in a cylindrical shape having a circular cross section and enters a sector hole 619 that is a hole provided in the keyboard body 603 and has a length increasing toward the upper part in the longitudinal direction. Thus, the keyboard body 603 is made swingable with an abutted portion with the cushion material 618 as a fulcrum.

An attaching base 622 into which a holding member 621 for pivotally supporting one end of the escapement member 609 and holding one end of the coil spring 608 is screwed and a pedestal 624 on which a cushion material 623 made of felt abutted by the back end of the keyboard body 603 are fixed on the machine base 611. Further, the pedestals 612, 616 and 624 are adhered to the machine base 611 and the attaching base 622 is secured to the machine base 611 by a screw 625. In addition, adjustment of the coil spring 608 is performed according to a degree of screwing-in of the spring holding member 621.

Figure 27:
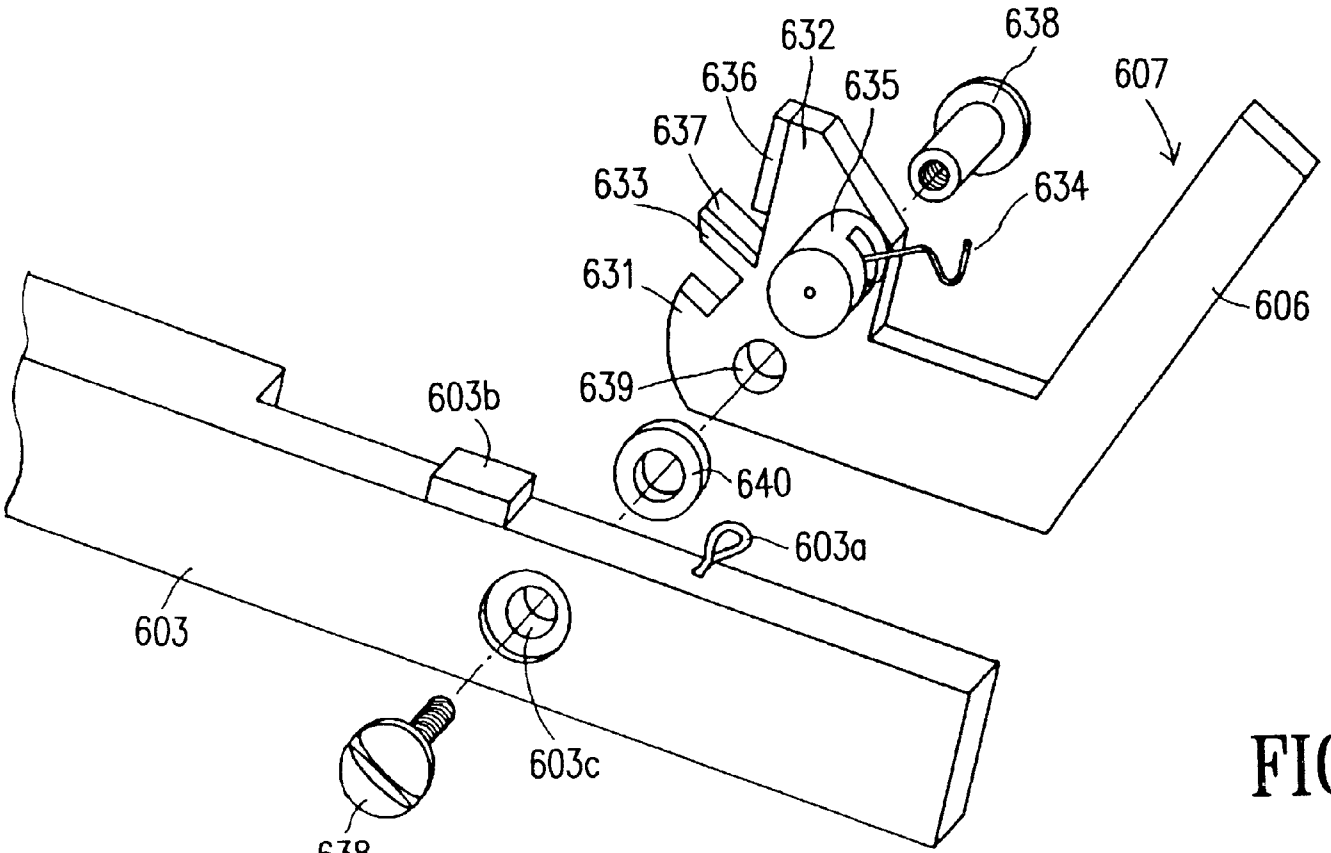
FIG. 27 is a partly disassembled perspective view showing a relation between a hammer body and a keyboard body in the action mechanism of FIG. 25.
Figure 27A:
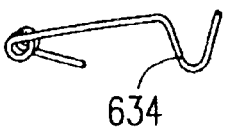
FIG. 27(A) shows the detailed structure of the hammer spring of FIG. 27.

As shown in FIG. 27, a beak-like projecting piece 631, a pushing-out protrusion 632 to be a pushing-out member, a lever-like engaging and disengaging portion 633 for engaging to and disengaging from the pivotal member 610, a spring locking portion 635 for locking one end of a hammer spring 634 for helping a returning operation of the hammer body 607 (see FIG. 26), a cushion portion 636 of felt or the like that is provided at the tip of the pushing-out protrusion 632 and becomes a part of the pushing-out protrusion 632, a sliding portion 337 made of leather or the like that is provided in a part where the pivotal member 610 abuts the engaging and disengaging portion 633 and becomes a part of the engaging and disengaging portion 633, and a hole 639 through which screw unions 638 and 638 are inserted are provided in the hammer body 607 other than the hammer portion 606. Further, the screw unions 638 and 638 also penetrate through a hole 603*c* provided in the keyboard body 603 and makes the hammer body 607 pivotal with respect to the keyboard body 603. A part where these screw unions 638 and 638 are attached is referred to as a base of the hammer body 607.

The hammer body 607 is pivotally attached to the keyboard body 603 by the screw unions 638 and 638 and a washer 640. Here, the other end of the hammer spring 634 is hooked to a cord 603*a* attached to the keyboard body 603. In addition, a base portion 603*b* on which a part of the pivotal member 610 is mounted and a hole 603*c* through which the screw unions 638 and 638 penetrate are provided in the keyboard body 603.

The escapement member 609 includes an engaging stepped portion 641 for engaging with the projecting piece 631 of the hammer body 607, a restraining portion 642 that abuts the back of the pushing-out protrusion 632 of the hammer body 607 and becomes a part of a restraining member made of felt or the like, an adjustment screw 643 for let-off adjustment for adjusting a position where the cushion portion 636 of the push-out protrusion 632 abuts, a biasing force receiving portion 644 for receiving a biasing force of the coil spring 608 via the pivotal member 610, and a hole (not shown) for inserting through an attachment shaft 645.

Figure 28:
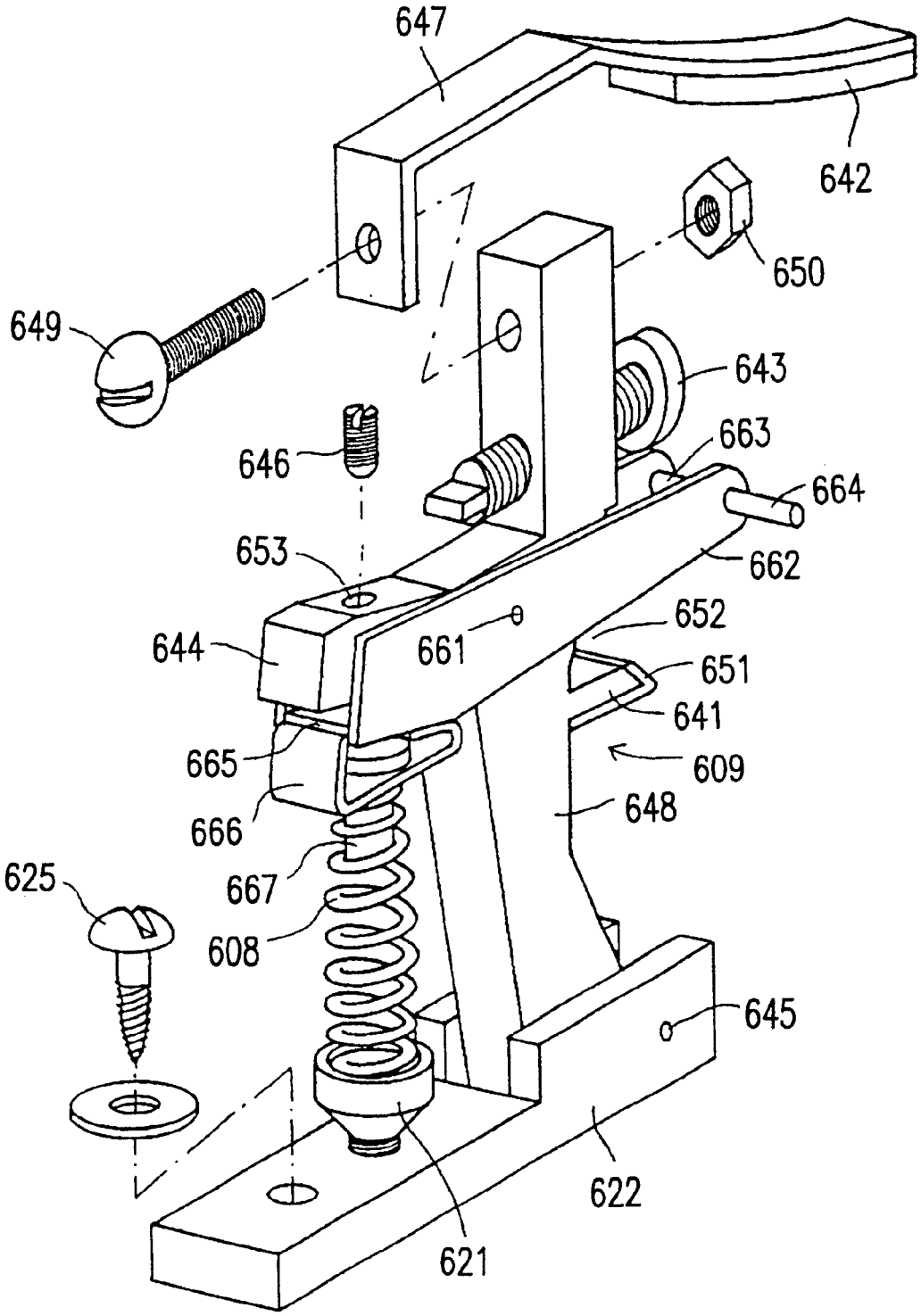
FIG. 28 is a partly disassembled perspective view showing a relation between an escapement member and a pivotal member in the action mechanism of FIG. 25.
Figure 29C:
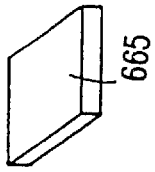
FIGS. 29(A)–29(D) show the structures of various components of the pivotal member of FIG. 29.
Figure 29D:
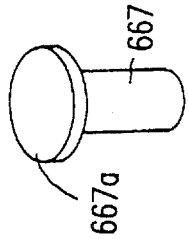
Figure 29:
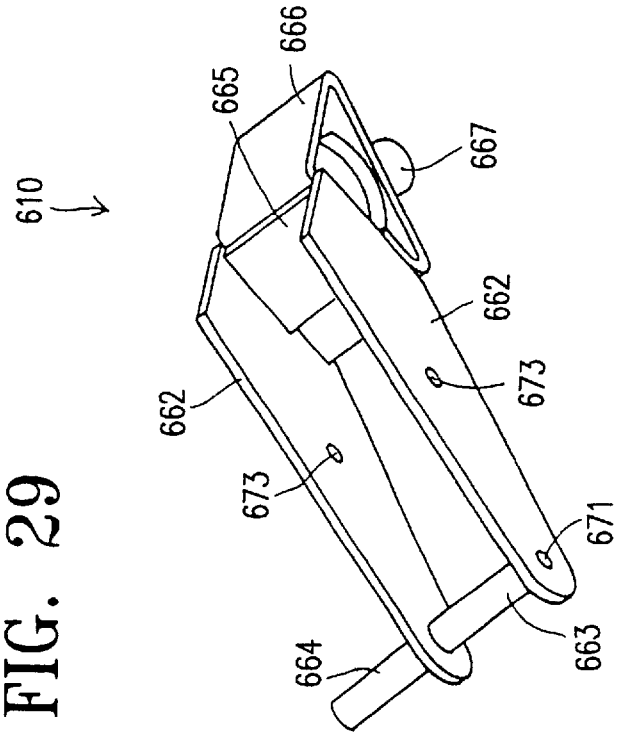
FIG. 29 is a perspective view showing the pivotal member in the action mechanism of FIG. 25.
Figure 29A:
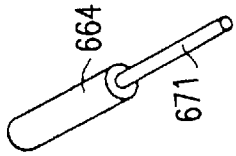
Figure 29B:
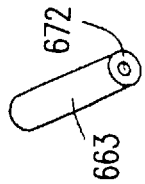

Moreover, as shown in FIG. 28, a pivotal member angle adjustment screw 646 for adjusting a pivotal positional relation with the pivotal member 610, a restraining member 647 to which the restraining portion 642 is secured, an attachment screw 649 and a nut 650 for attaching this restraining member 647 to an escapement main body 648, and a sliding material 651 made of leather or the like that is adhered to the engaging stepped portion 641 and becomes a part of the engaging stepped portion 641 are provided in the escapement member 609. In addition, a recessed portion 652 into which the engaging and disengaging portion 633 of the hammer body 607 enters and a screw hole 653 in which the pivotal member angle adjustment screw 646 is engaged are provided in the escapement main body 648.

The pivotal member 610 for improving repetition (repeated striking function) is pivotally provided in this escapement member 609 around a shaft 661 penetrating through the escapement member 609 and the pivotal member 610.

As shown in FIGS. 28, 29 and 29(A)–29(D), this pivotal member 610 includes two sides 662 and 662 for sandwiching the biasing force receiving portion 644 of the escapement member 609, a cylindrical roller 663 to and from which the engaging and disengaging portion 633 of the hammer body 607 engages and disengages and which becomes a stopping portion for stopping a returning operation of the hammer body 607, a roller supporting rod 664 to be mounted on the base portion 603*b* of the keyboard body 603 from a predetermined period by the pivoting of the hammer body 607, a cushion portion 665 made of leather or the like with which the tip of the pivotal member angle adjustment screw 646 collides, a pedestal portion 666 for receiving a biasing force of the coil spring 608, and a spring receiver 667 whose head portion 667*a* is disposed in the internal space of the pedestal portion 666 having a triangle cross section.

Further, the roller supporting rod 664 has a small diameter portion 671 where it is made thin and the small diameter portion 671 is inserted through a central hole 672 to be provided in the center of the roller 663. With this configuration, the roller 663 can pivot around the small diameter portion 671. In addition, holes 673 and 673 through which the shaft 661 is inserted are provided in substantially the center of the sides 662 and 662.

Operations of the action mechanism 601 of the seventh embodiment that is configured as described above will be described with reference to FIGS. 30 to 45. Further, each figure is a partially enlarged view showing a relation among the hammer body 607, the escapement member 609 and the pivotal member 610 or a partially enlarged view of portions around the beak-like projecting piece 631 of the hammer body 607.

Figure 30:
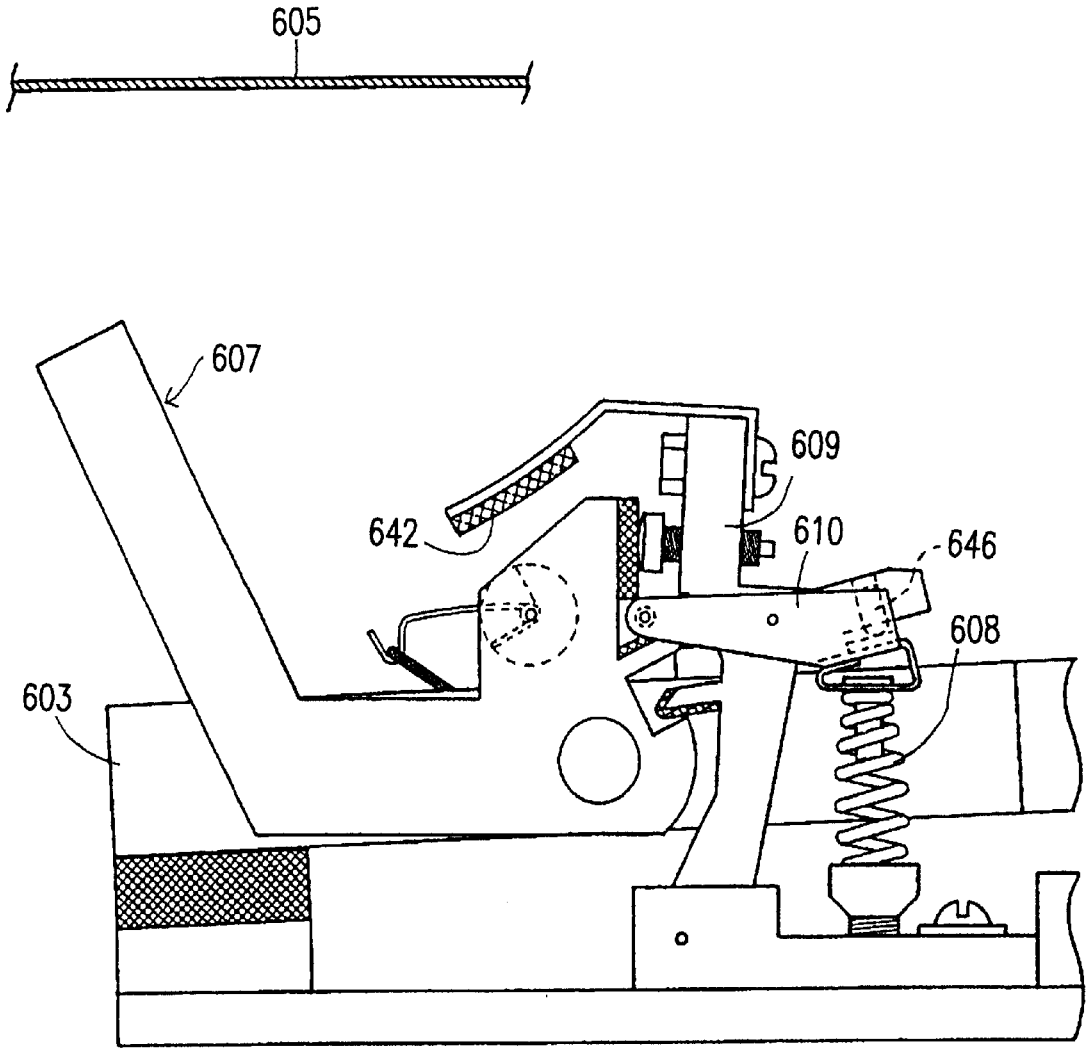
FIG. 30 is a view for illustrating an operation of the action mechanism of FIG. 25 and is a partially enlarged view of the hammer body and portions around the hammer body in a stationary state.
Figure 31:
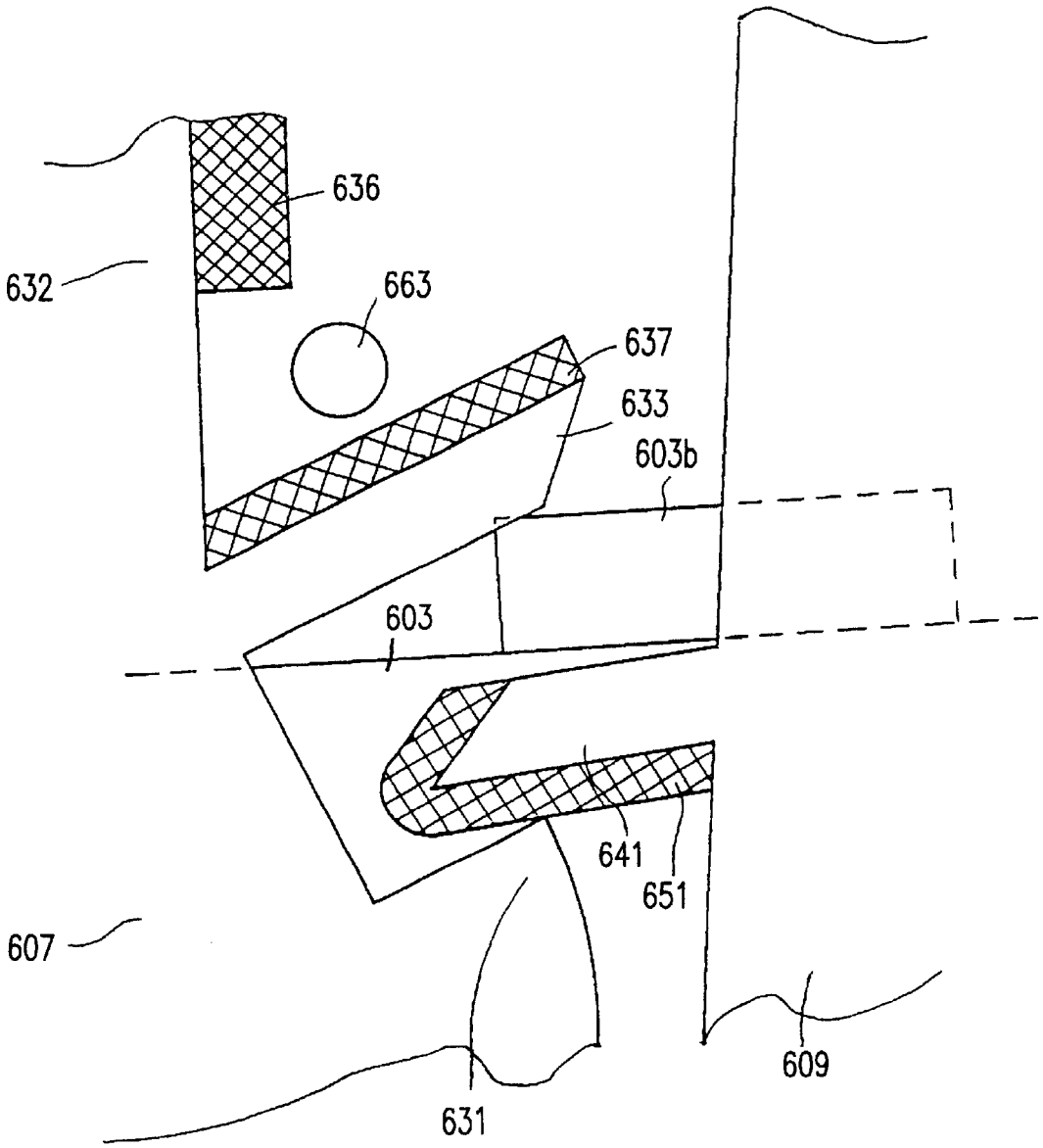
FIG. 31 is a view for illustrating an operation of the action mechanism of FIG. 25 and is a partially enlarged view of portions around a beak-like projecting piece and an engaging stepped portion in a stationary state.

First, a stationary state before the keyboard portion 602 is pressed down is shown in FIGS. 30 and 31. In the state of these stationary views, the pivotal member 610 provided with the roller 663 keeps a fixed angle with the escapement member 609 by the function of the pivotal member angle adjustment screw 646. Thus, the engaging and disengaging portion 633 extending from the base of the hammer body 607 and the roller 663 are separated apart (see FIG. 31).

Figure 32:
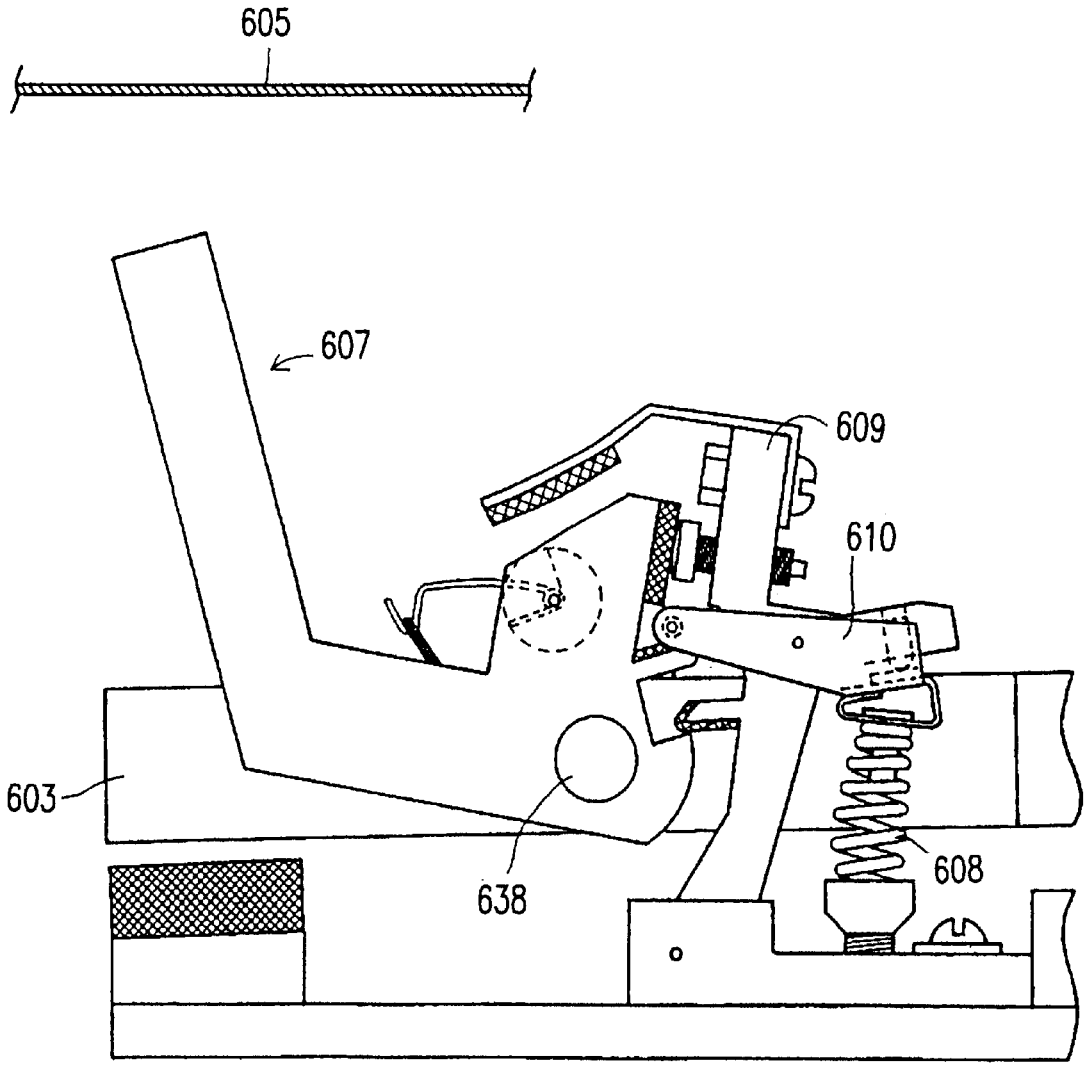
FIG. 32 is a view for illustrating an operation of the action mechanism of FIG. 25 and is a partially enlarged view of the hammer body and the portions around the hammer body in a state in which the keyboard portion is slightly pressed down.

When the keyboard portion 602 is gradually pressed down, the entire rear portion of the keyboard body 603 starts rising and at the same time the hammer body 607 starts pivoting with respect to the keyboard portion 603 and is getting closer to the string 605 as shown in FIG. 32. This is because, since the projecting piece 631 is restrained by the engaging stepped portion 641 when the portion of the screw union 638 starts rising, the hammer portion 606 side pivots around the screw unions 638.

Figure 33:
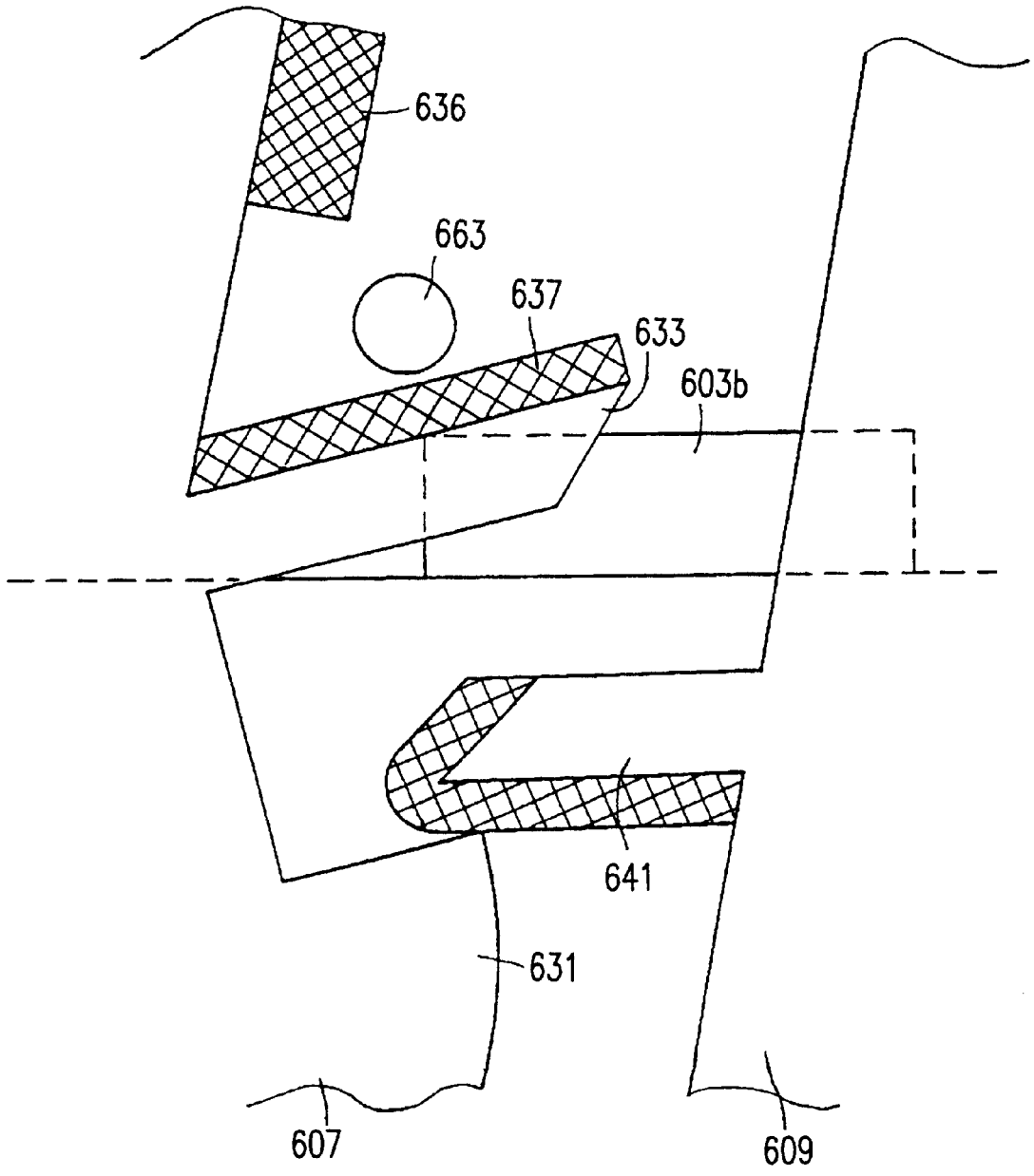
FIG. 33 is a view for illustrating an operation of the action mechanism of FIG. 25 and is a partially enlarged view of the portions around the beak-like projecting piece and the engaging stepped portion in a state in which the keyboard portion is slightly pressed down.

When the keyboard portion 602 is pressed down, the lever-like engaging and disengaging portion 633 extending from the base of the hammer body 607 and the roller 663 gradually move closer to each other as shown in FIG. 33. In addition, the roller supporting rod 664 of the pivotal member 610 gradually moves closer to the base portion 603*b* mounted on the keyboard body 603. In addition, the coil spring 608 is compressed as the escapement member 609 is pressed by the adjustment screw 643 for let-off adjustment and slanted. Further, FIGS. 32 and 33 show a state in which the keyboard portion 602 in the keyboard position regulating rod 613 is pressed down by 2 mm. In addition, a maximum length by which the keyboard portion 602 can be pressed down is 8 mm in this embodiment.

Figure 34:
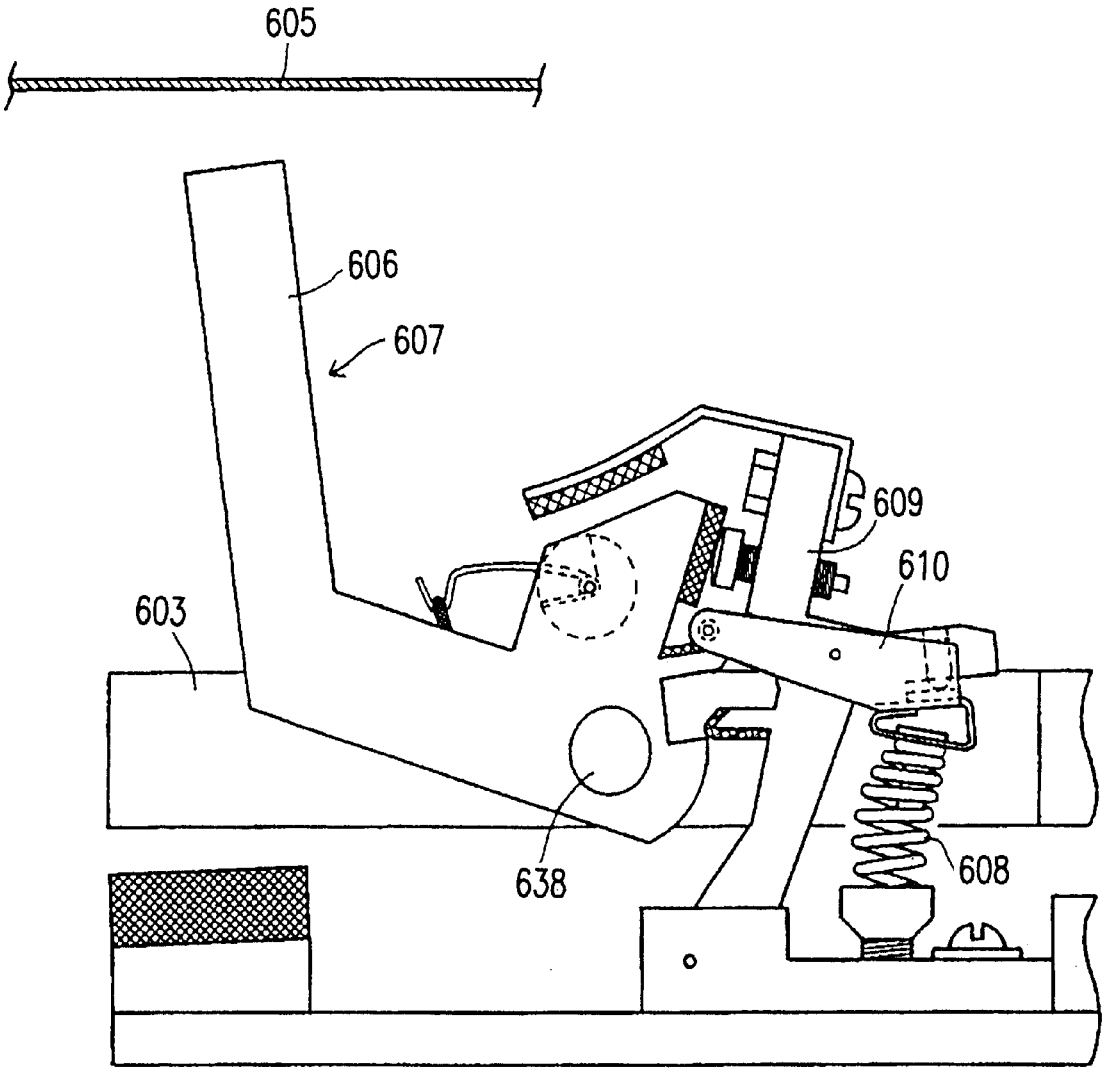
FIG. 34 is a view for illustrating an operation of the action mechanism of FIG. 25 and is a partially enlarged view of the hammer body and the portions around the hammer body in a state in which the keyboard portion is further pressed down and the beak-like projecting piece of the hammer body has approached a curved surface portion of the engaging stepped portion of the escapement member.
Figure 35:
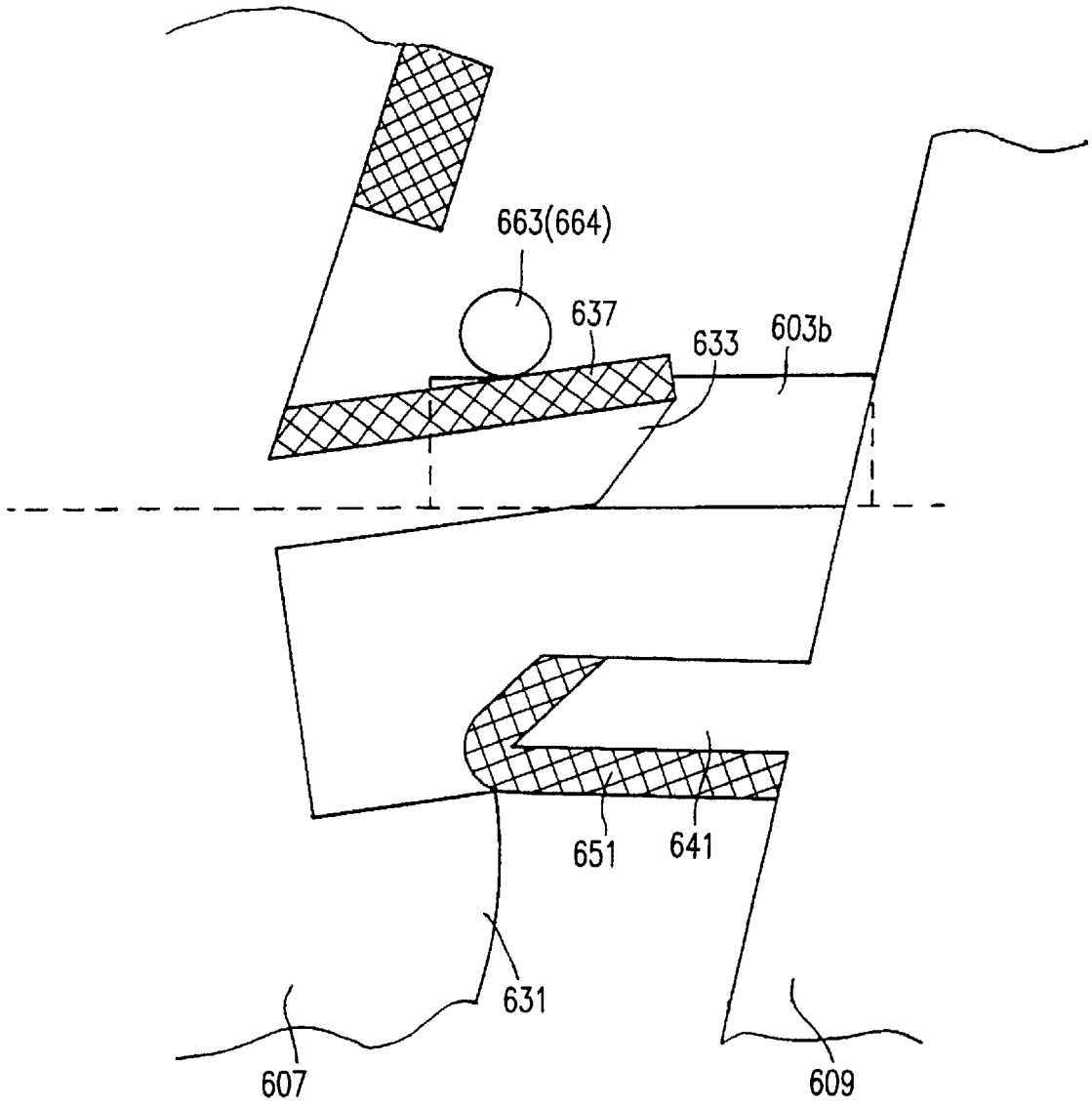
FIG. 35 is a view for illustrating an operation of the action mechanism of FIG. 25 and is a partially enlarged view of the portions around the beak-like projecting piece and the engaging stepped portion in a state in which the keyboard portion is further pressed down and the beak-like projecting piece of the hammer body has approached the curved surface portion of the engaging stepped portion of the escapement member.

Moreover, when the keyboard 602 is pressed down (pressing-down depth 3.8 mm), the beak-like projecting piece 631 approaches the curved surface portion of the engaging stepped portion 641 as shown in FIGS. 34 and 35. Then, the hammer portion 606 further pivots and further approaches the string 605. At this point, a sliding portion 637 on the upper surface of the engaging and disengaging portion 633 and the roller 663 contact each other and at the same time the roller supporting rod 664 and the base portion 603*b* of the keyboard body 603 contact each other as shown in FIG. 35. That is, an angle between the pivotal member 610 and the escapement member 609 is adjusted in advance by the pivotal member angle adjustment screw 646 such that the both of these contacts occur simultaneously.

Figure 37:
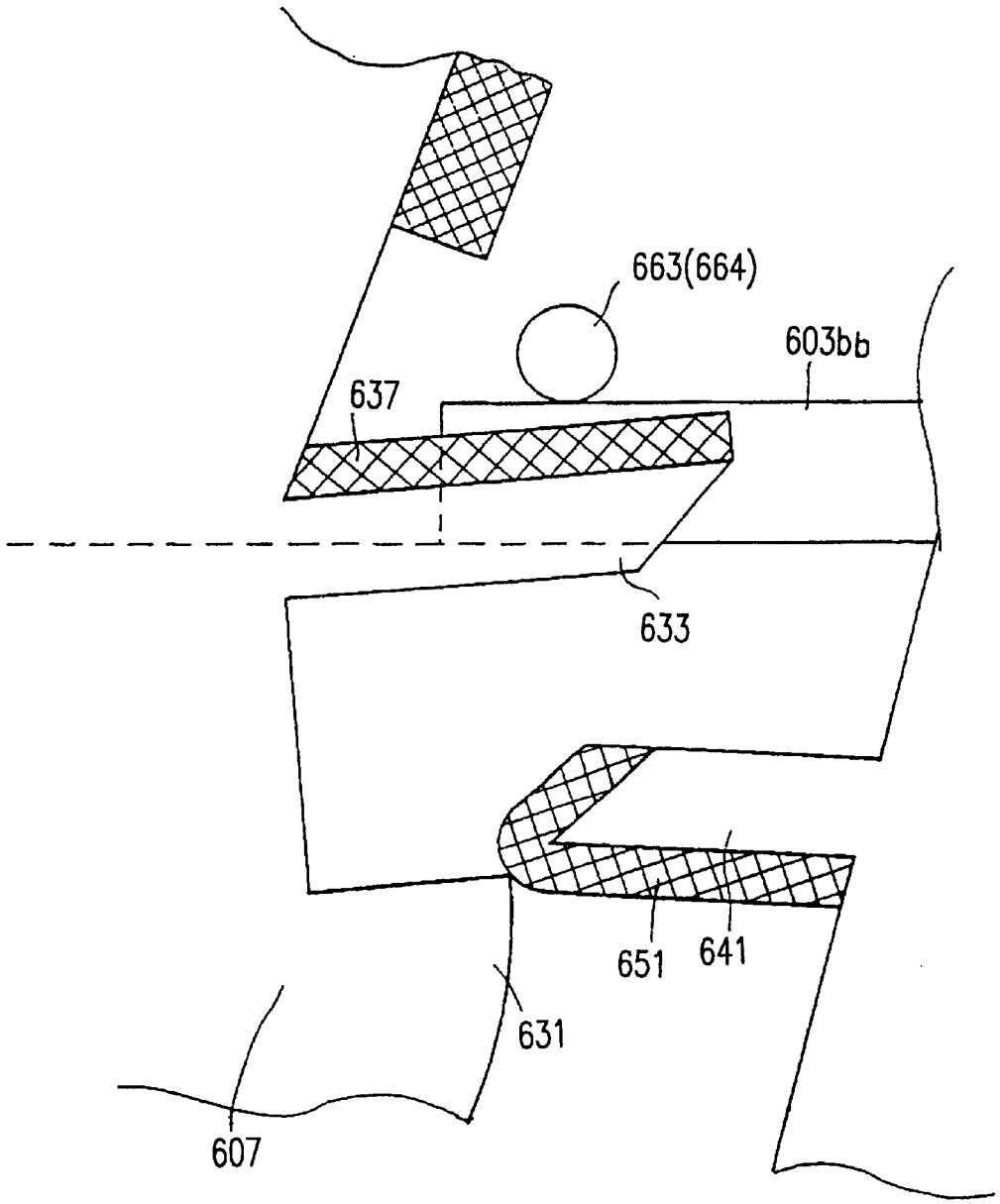
FIG. 37 is a view for illustrating an operation of the action mechanism of FIG. 25 and is a partially enlarged view of the portions around the beak-like projecting piece and the engaging stepped portion in a state in which the keyboard portion is further pressed down and the roller supporting shaft of the pivotal member moves onto the base portion of the keyboard body and the pivotal member follows movement of the keyboard body.

When the keyboard portion 602 is further pressed down, the hammer body 607 further rises and the hammer portion 606 pivots and approaches the string 605. Then, as shown in FIG. 37, the roller supporting rod 664 is placed on the base portion 603*b* mounted on the keyboard body 603 as shown in FIG. 37 and, since the roller supporting rod 664 performs rising motion in accordance with the rise of the rear part of the keyboard body 603 thereafter while remaining placed on the base portion 603*b*, the engaging and disengaging portion 603 and the roller 663 start separating from each other again.

Figure 36:
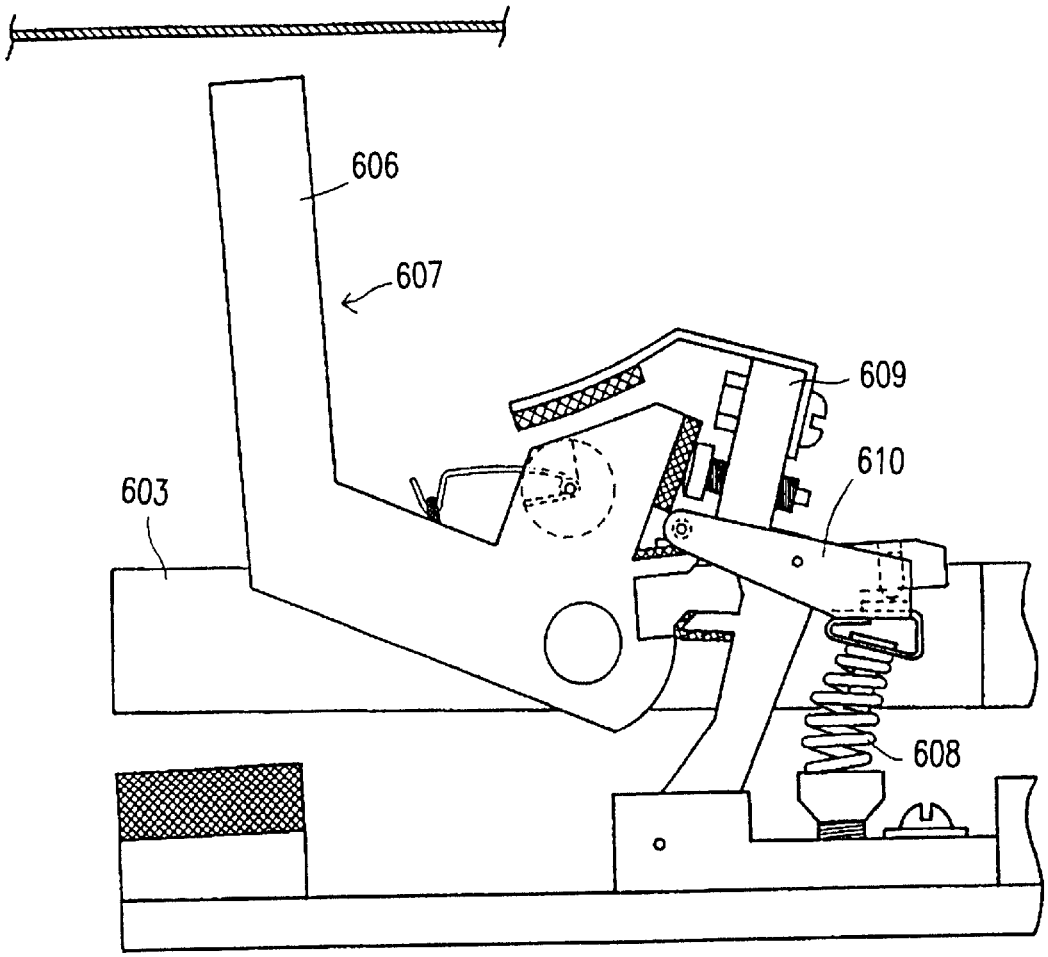
FIG. 36 is a view for illustrating an operation of the action mechanism of FIG. 25 and is a partially enlarged view of the hammer body and the portions around the hammer body in a state in which the keyboard portion is further pressed down and a roller supporting shaft of the pivotal member moves onto a base portion of the keyboard body and the pivotal member follows movement of the keyboard body.

Then, the roller supporting rod 664 is pushed up from the base portion 603*b*, whereby the pivotal member 610 starts pivoting clockwise in FIG. 36. Thus, the coil spring 608 is compressed by the pivoting of the pivotal member 610 in addition to the change of the angle of the escapement member 609. In this way, the coil spring 608 is compressed in two steps. The angle of the escapement member 609 changes by approximately 10 degrees until the keyboard portion 602 is pressed down to the half depth and the tip of the beak-like projecting piece 631 approaches the curved surface portion of the engaging stepped portion 641. However, the change becomes small after the tip of the projecting piece 631 has approached the curved surface portion of the engaging stepped portion 641 and the angle changes by only about 3 degrees until the time of striking a string that is a state in which the keyboard portion 602 is pressed down to a maximum depth.

On the other hand, the compression of the coil spring 608 by the pivoting of the pivotal member 610 starts when the tip of the beak-like projecting piece 631 approaches the curved surface portion of the engaging stepped portion 641 and continues until the time of striking a string. In this case, the change of the angle is approximately 7 degrees. When the pivotal member 610 starts pivoting, a gap is created between the pivotal member angle adjustment screw 646 and the cushion portion 665 that is a contact surface of the pivotal member 610. Further, the depth of pressing down the keyboard portion 602 in FIGS. 36 and 37 is assumed to be 5 mm.

Figure 38:
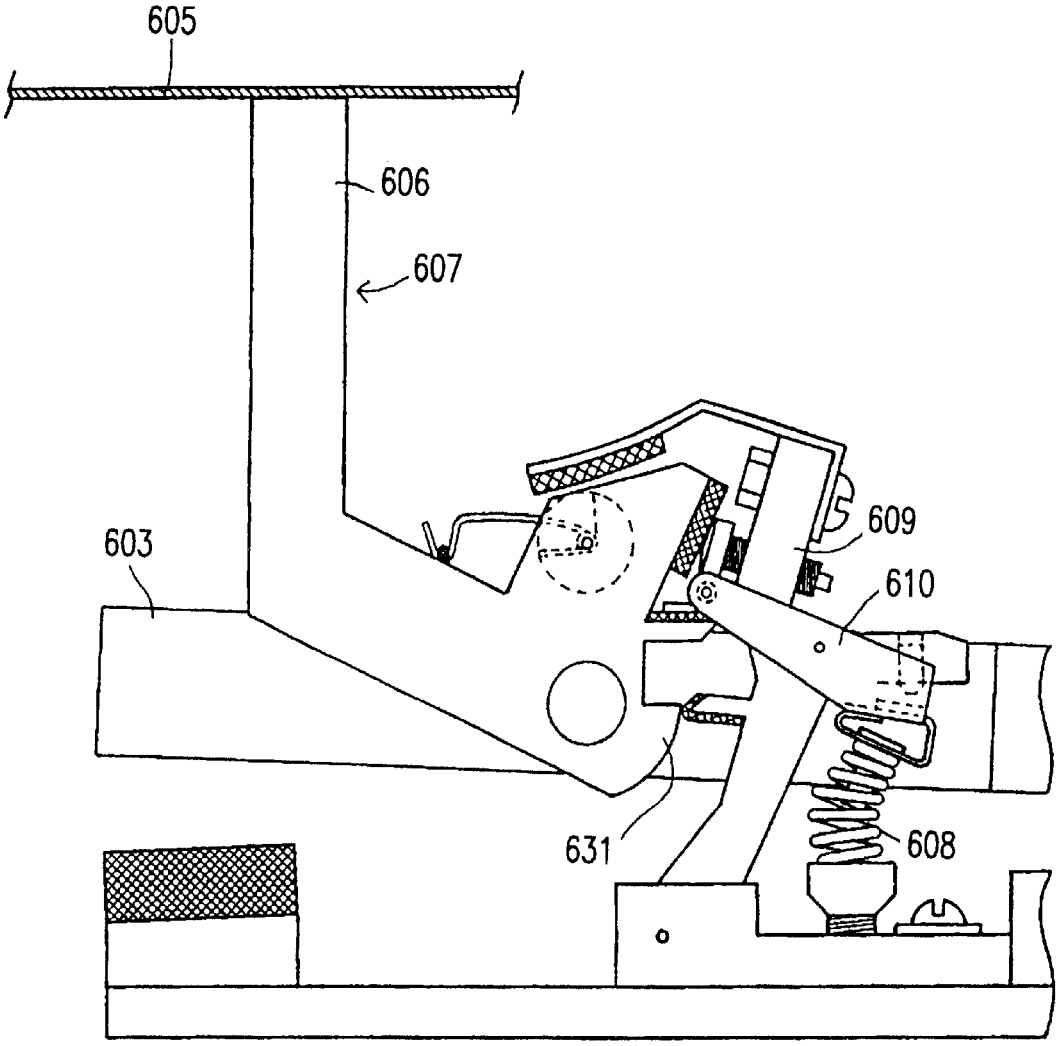
FIG. 38 is a view for illustrating an operation of the action mechanism of FIG. 25 and is a partially enlarged view of the hammer body and the portions around the hammer body at the time of striking a string.
Figure 39:
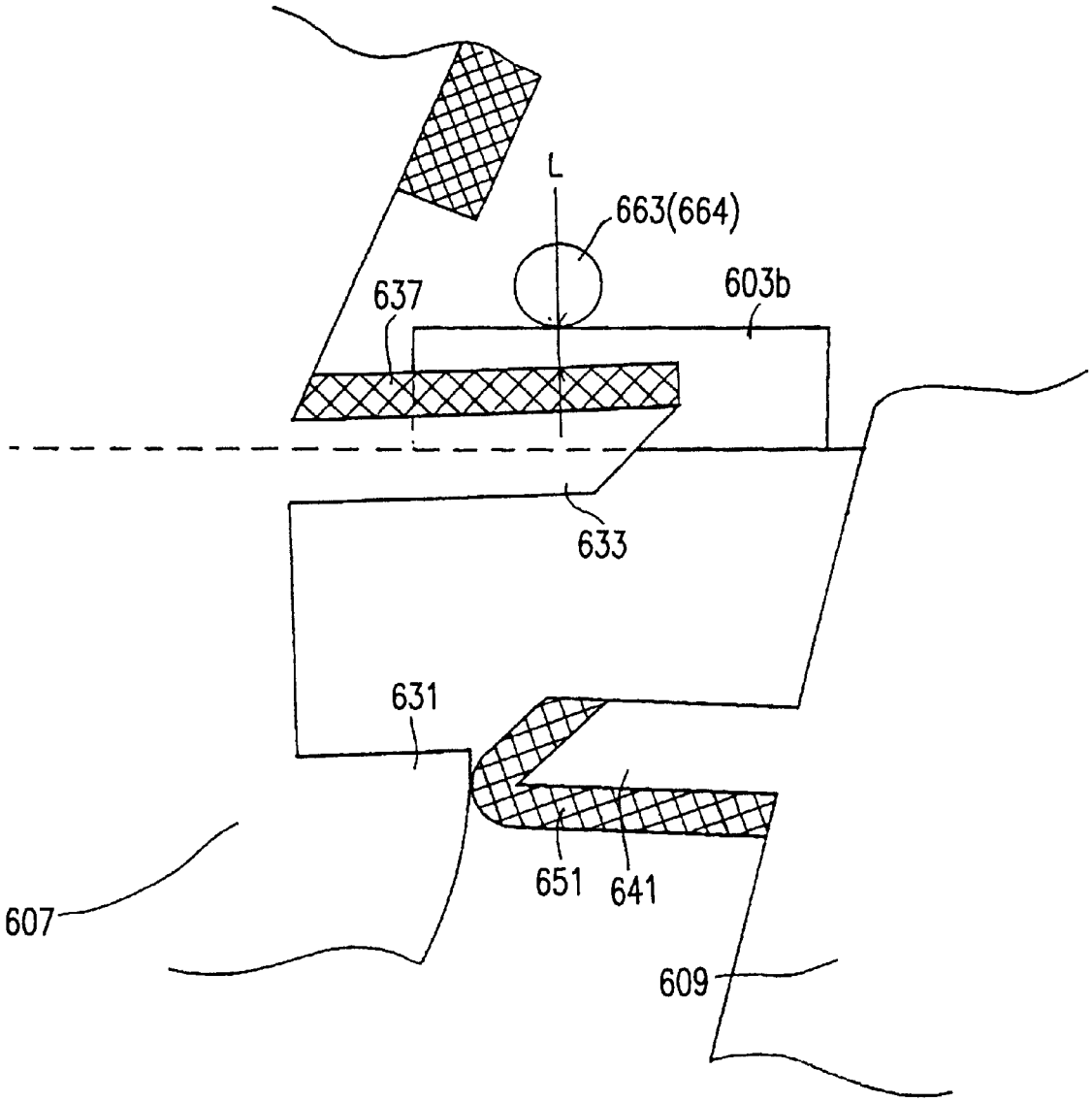
FIG. 39 is a view for illustrating an operation of the action mechanism of FIG. 25 and is a partially enlarged view of the portions around the beak-like projecting piece and the engaging stepped portion at the time of striking a string.
Figure 40:
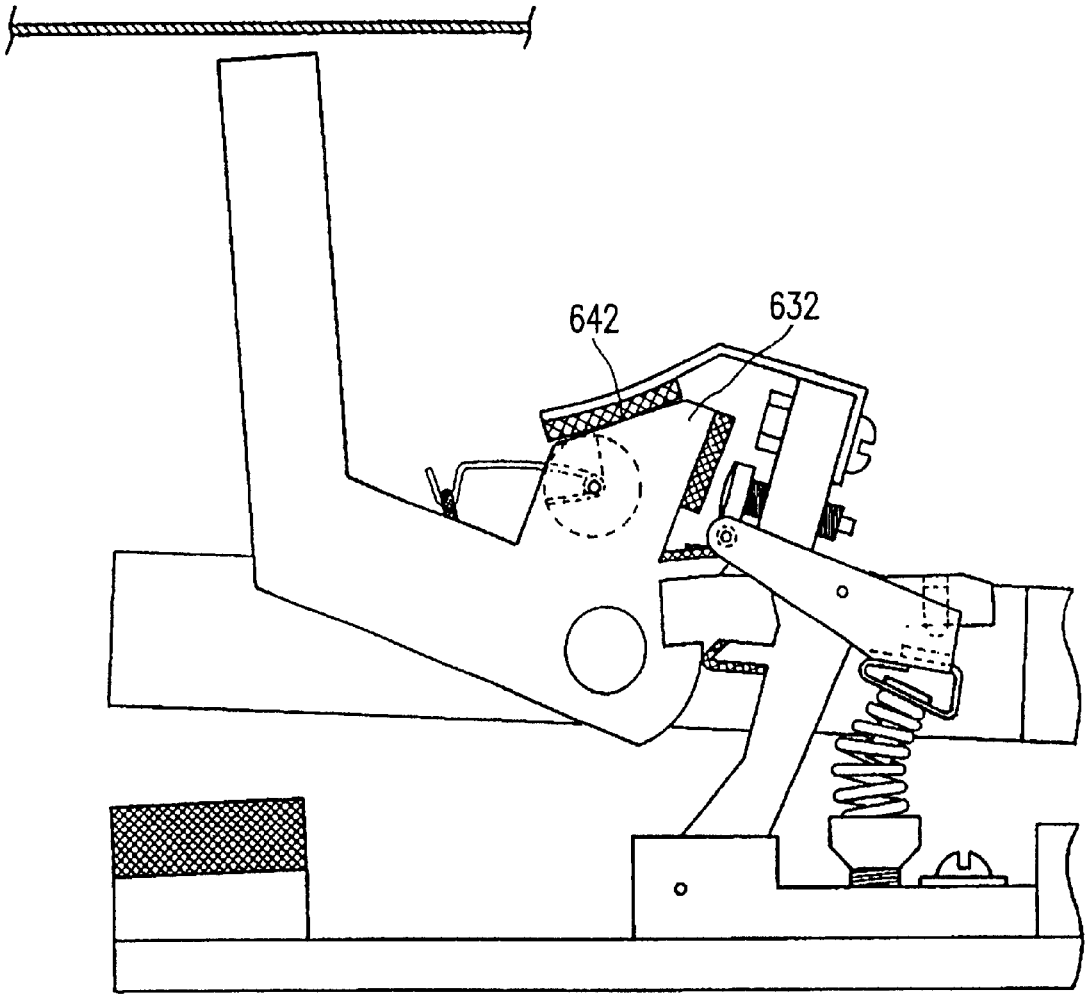
FIG. 40 is a view for illustrating an operation of the action mechanism of FIG. 25 and is a partially enlarged view of the hammer body and the portions around the hammer body in a state in which the hammer body is brought to a hammer stop position by a returning operation of the hammer.

As shown in FIGS. 38 and 39, the rise of the rear part of the keyboard body 603 reaches a highest position and the hammer portion 606 also reaches a highest pivotal position at the time of striking a string. In addition, the position of the roller 663 also becomes the highest. The height of the base portion 603*b* mounted on the keyboard body 603 is adjusted such that this maximum height of the roller 663 becomes the same height to which the upper surface of the tip of the projecting piece 631 rises at the time of hammer stop that occurs next. Therefore, since the upper surface of the tip of the projecting piece 631 does not become an obstacle even if it rises at the time of hammer stop shown in FIGS. 40 and 41, the hammer body 607 after striking a string can pivot to a position of hammer stop without a hindrance.

As shown in FIG. 38, the coil spring 608 is strongly pressed by the pivotal member 610 and compressed at the time of striking a string. In addition, although FIG. 38 illustrates as if the tip part of the hammer portion 606 opposes the string 605 in a surface to surface relation and the entire tip part abuts the string 605, in actuality, since the string 605 is extended while forming a certain angle with respect to the longitudinal direction of the keyboard body 603, the hammer portion 606 abuts the string 605 at one point of the tip part.

Figure 41:
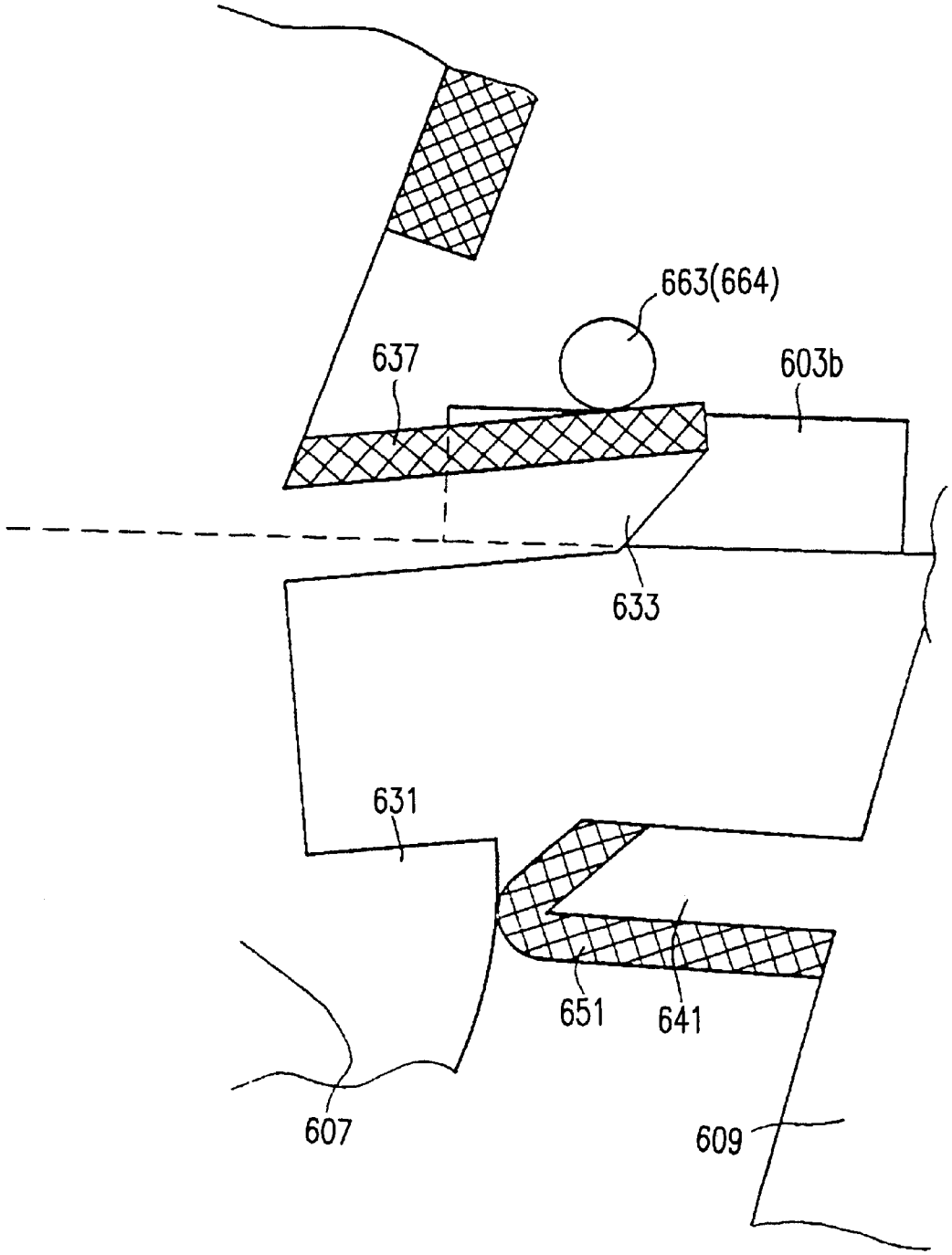
FIG. 41 is a view for illustrating an operation of the action mechanism of FIG. 25 and is a partially enlarged view of the portions around the beak-like projecting piece and the engaging stepped portion in a state in which the hammer body is brought to a hammer stop position by a returning operation of the hammer.

After striking a string, although the keyboard portion 602 continues to stay in the lowermost position, the hammer body 607 returns to its original position by a repulsion of the string 605 and due to a configuration to be described next. That is, as shown in FIG. 39, since a gap L exists between the roller 663 and the engaging and disengaging portion 633, the hammer body 607 returns to a hammer stop position shown in FIG. 40 by the weight on the hammer portion 606 side and the repulsion of the string 605 without its pivoting hindered by the roller 663. In the hammer stop position, the back of the push-out protrusion 632 abuts the restraining portion 642 and its returning operation is stopped. In addition, as shown in FIG. 41, the roller 663 and the engaging and disengaging portion 633 (in actuality, the sliding portion 637 that is a part of the engaging and disengaging portion 633) contact each other, and the returning operation to the original position of the hammer body 607 is also stopped in this part. At this moment of contact, the roller supporting rod 664 and the base portion 603*b* still contact each other.

The returning operation (pivoting of the hammer body 607 after striking a string until the hammer stop in a direction opposite to a direction in which it pivots at the time of striking a string is called "returning operation of the hammer") of the hammer body 607 is helped by the hammer spring 634 attached to the hammer body 607. This hammer spring 634 is pulled by the cord 603*a* attached to the keyboard body 603 and transformed such that its effect (elasticity) becomes maximum at the time of striking a string.

Further, the hammer spring 634 is attached in order to prevent the return of the hammer body 607 being hindered by friction between the tip lower surface of the beak-like projecting piece 631 and the curved surface portion of the engaging stepped portion 641 when a string is struck very weakly or to prevent the return of the hammer body 607 from being hindered when it is used in a state other than the one in which the surface of the keyboard body 603 is faced upward.

Figure 42:
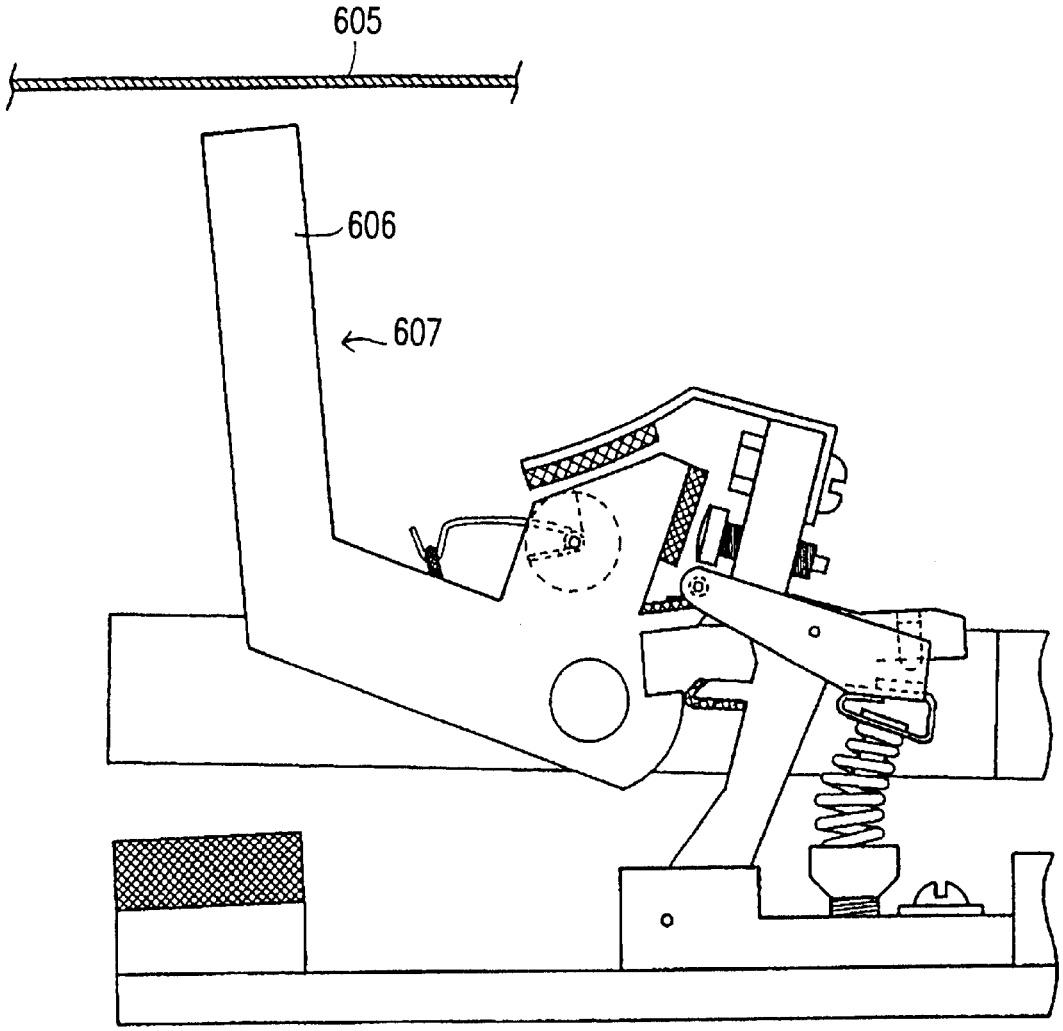
FIG. 42 is a view for illustrating an operation of the action mechanism of FIG. 25 and is a partially enlarged view of the hammer body and the portions around the hammer body in a state in which the keyboard portion starts returning to the original position, whereby the hammer body starts returning downward from the hammer stop position.

After the hammer stop, when the keyboard portion 602 is risen by releasing the pressure of the pressing-down force on the keyboard portion 602, the rear part of the keyboard body 603 falls and the hammer portion 606 moves away from the string 605 (see FIG. 42). In addition, the back of the pushing-out protrusion 632 is separated from the restraining portion 642 at the same time. Since the position of the base portion 603*b* functioning as a support of the roller supporting rod 664 is lowered, the pivotal member 610 pivots following it and the roller 663 lowers its position. At this point, the roller 663 works to press the lever-like engaging and disengaging portion 633 extending from the hammer body 607 by the force of the coil spring 608 compressed by the pivoting of the pivotal member 610.

Figure 43:
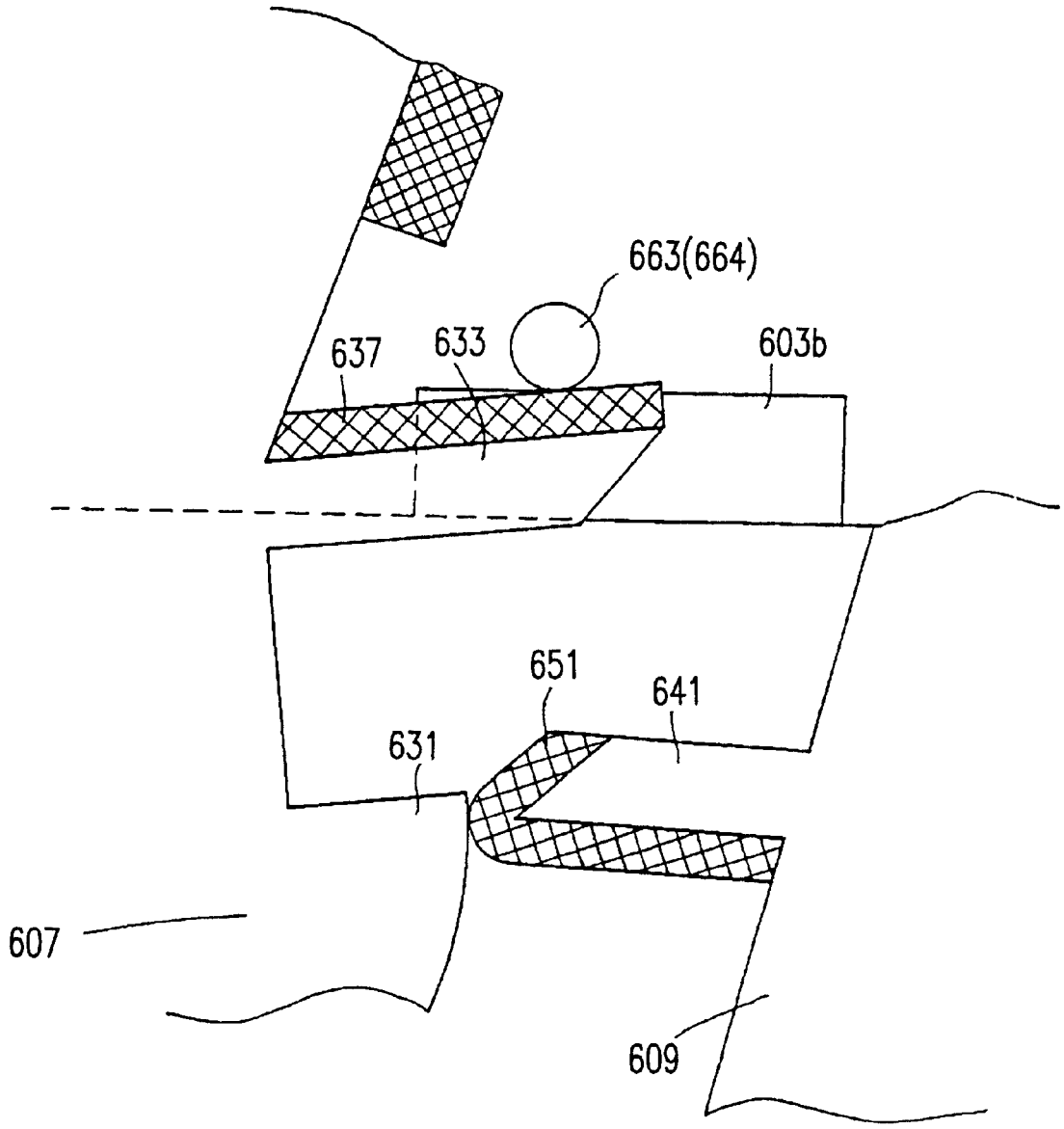
FIG. 43 is a view for illustrating an operation of the action mechanism of FIG. 25 and is a partially enlarged view of the portions around the beak-like projecting piece and the engaging stepped portion in a state in which the keyboard portion starts returning to the original position, whereby the hammer body starts returning downward from the hammer stop position.
Figure 44:
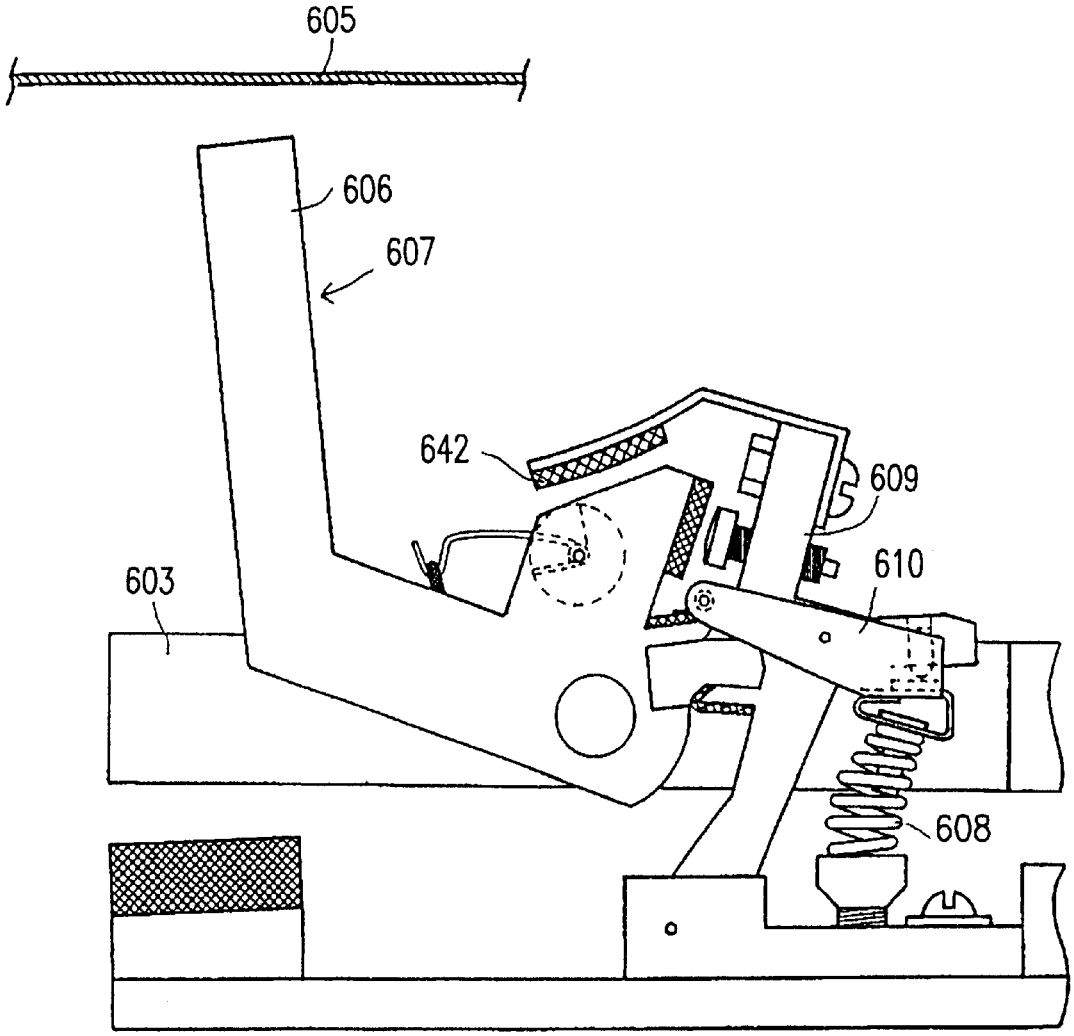
FIG. 44 is a view for illustrating an operation of the action mechanism of FIG. 25 and is a partially enlarged view of the hammer body and the portions around the hammer body immediately before a position where re-striking of a string is possible.
Figure 45:
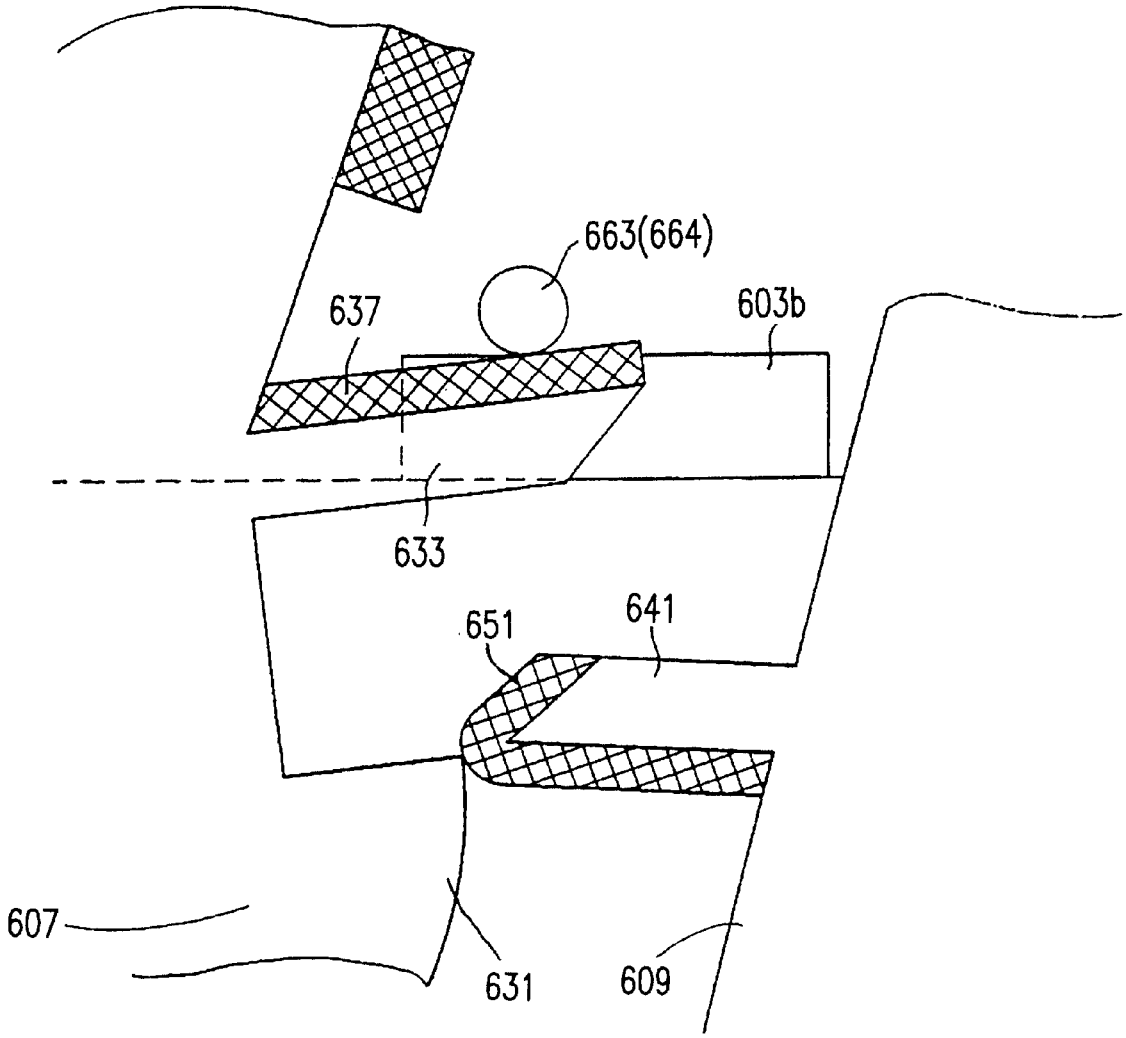
FIG. 45 is a view for illustrating an operation of the action mechanism of FIG. 25 and is a partially enlarged view of the portions around the beak-like projecting piece and the engaging stepped portion immediately before a position where re-striking of a string is possible.

Since the engaging and disengaging portion 633 of the hammer body 607 cannot be pushed up against the downward pressing force, the engaging and disengaging portion 633 and the roller 663 as well as the roller supporting rod 664 and the base portion 603*b* of the keyboard body 603 fall simultaneously while keeping their contacting states, respectively, as the rear part of the keyboard body 603 falls. This contacting also continues from a state in which the pressed-down depth of the keyboard portion 602 is 6.5 mm as shown in FIGS. 42 and 43 to a state in which of the pressed-down depth is 5 mm as shown in FIGS. 44 and 45.

During the course of pressing down the keyboard portion 602 for striking a string, the hammer body 607 falls following the falling of the keyboard body 603 to a position shown in FIGS. 34 and 35, that is, to a position where the engaging and disengaging portion 633 and the roller 663 as well as the roller supporting rod 664 and the base portion 603*b* of the keyboard body 603 contact each other, respectively. Then, the tip of the projecting piece 631 is pressed down along the curved surface portion of the engaging stepped portion 641 to a position at which the tip of the projecting piece 631 approaches the curved surface portion of the engaging stepped portion 641 as shown in FIGS. 34 and 35. Thus, it becomes possible to press down the keyboard portion 602 and strike a string again before the front part of the keyboard body 603 rises most, that is, before it comes into a stationary state.

As a result, repetition capable of quicker repeated striking become possible. In the above-mentioned embodiment, the maximum amount by which the keyboard portion 602 can be pressed down is assumed to be 8 mm and a key-striking operation becomes possible again at the point when a remaining amount of a depth of a key is 3.8 mm, that is, when the keyboard portion 602 has returned by 4.2 mm from the completion of pressing-down. However, in an actual model manufactured from each figure, a more favorable result was obtained. To indicate examples of specific numerical values, in a result obtained by adjusting the manufactured model, when the maximum amount by which the keyboard portion 602 can be pressed down was assumed to be 8 mm, the key-striking operation became possible again at the point when the keyboard portion 602 returned by 3.8 mm from the completion of pressing-down. The repeated key-striking operation may well become possible at an earlier point by further improvement. If re-striking of a key is possible before returning by a half or less of a pressed-down amount, the key striking operation becomes possible again before a damper used in a piano for restraining vibration of the string 605 at the time of returning of the keyboard body 603 works, which is extremely favorable in practice.

Next, an arrangement relation of keyboard body 603 when incorporating the action mechanism 601 acting as described above in an actual keyboard musical instrument will be described with reference to FIG. 46. Further, an arrangement relation view of FIG. 46 is basically the same as that in FIG. 16.

Figure 46:
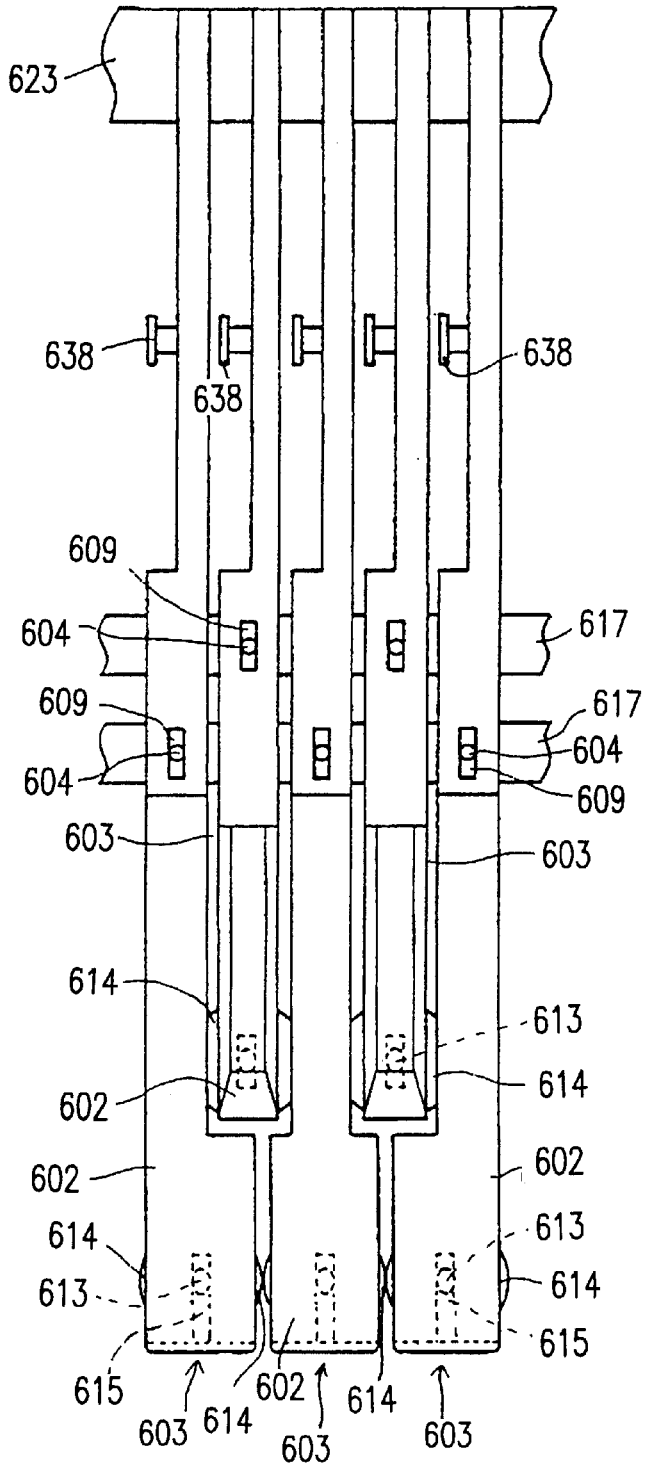
FIG. 46 is a plan view in a state in which each of members to be disposed above the keyboard body as well as the hammer body and the escapement member are removed in the action mechanism of FIG. 25.

FIG. 46 is a plan view in a state in which the hammer body 607 and the escapement member 609 to be disposed on the keyboard body 603 are removed (the cord 603*a* and the base portion 603*b* are also omitted). FIG. 46 illustratively shows three sounds of C, D and E and semitone parts between them. As shown in FIG. 46, the pins 604 to be the pivotal fulcrums of the keyboard bodies 603 are arranged in two rows in zigzag and the keyboard position regulating rods 613 that are parts of the keyboard portions 602 are also arranged in two rows in zigzag due to the existence of the semitone parts. Further, every keyboard body 603 is formed in a different shape except for the two keyboard bodies 603 of the semitone parts which are formed in an identical shape. However, the basic configuration of each keyboard body 603 is completely identical with the configuration shown in FIGS. 25 to 27.

Next, a keyboard musical instrument of an eighth embodiment of the present invention will be described with reference to FIG. 47. Only an action mechanism portion is described and description of an entire structure of the keyboard musical instrument is omitted in the description of this eighth embodiment as well. Further, identical reference numerals are assigned to members identical with those of the action mechanism 601 described above and description of them is omitted or simplified.

In an action mechanism 701 to be employed in the keyboard musical instrument of the eighth embodiment, unlike in the action mechanism 601, the cord 605 is disposed below the keyboard body 603 and the hammer body 607, the escapement member 609 and the pivotal member 610 are arranged on the keyboard portion 602 side with respect to the pin 604 to be a pivotal fulcrum. Further, FIG. 47 also shows a keyboard body 711 to be a black key in addition to the keyboard body 603 to be a white key. The keyboard body 711 also pivots with another pin 604 as a fulcrum. In addition, the escapement member 609 and the pivotal member 610 in the case of the black key are disposed in a position closer to the pin 604 side compared with the position shown in FIG. 47. A regulating portion 713 to be secured to the pedestal 616, a cushion material 714 mounted on the regulating portion 713 and a coil spring 715 for keeping the keyboard bodies 603 and 711 in a stationary state are disposed between the keyboard body 711 and the pedestal 616.

Each of the regulating portions 713 has a concave cross-section, and each of the keyboard bodies 603 and each of the keyboard bodies 711 are inserted in each of the associated concave portions, thereby regulating their positions.

A machine base 702 is composed of an upper machine base portion 702*a* to which the attaching base 622, the pedestal 703 and a rail-like member 704 are attached, a left machine base portion 702*b* to which the pedestal 616 having the pin 604 attached to it is secured, a right machine base portion 702*c* to which the pedestal 612 is attached, or the like. An adjustment screw 705 for adjusting and making uniform the heights of the tips of the keyboard bodies 603 and 711 is disposed in the pedestal 703. A cushion material 706 made of felt or the like is provided between the adjustment screw 705 and each of the keyboard bodies 603 and 711. In addition, the rail-like member 704 holds the other end of the pin 604 to be a pivotal fulcrum via a cushion member 707 and prevents the keyboard bodies 603 and 711 from rising.

Since the keyboard musical instrument of this eighth embodiment is provided with the regulating portions 713 in the lower parts of the pins 604 to be fulcrums of the keyboard bodies 603 and 711 to hold the keyboard bodies 603 and 711 from the both sides, there is no pin for guiding in the front ends of the keyboard bodies 603 and 711. In addition, the positions of the pins 604 to be fulcrums of the keyboard bodies 603 and 711 are the same for the keyboard body 603 of the white key and the keyboard body 711 of the black key as viewed from the side. The positions of the hammer bodies 607, the escapement members 609 and other members are different for the white key and the black key as described above. However, the hammer body 607 or the like of the keyboard body 711 of the black key are omitted in the figure.

When the keyboard portion 602 is pressed down, the hammer portion 606 of the hammer body 607 strikes the string 605. Operations of the hammer body 607, the coil spring 608, the escapement member 609 and the pivotal member 610 at this point is the same as those in the action mechanism 601 of the seventh embodiment.

Whereas the keyboard instrument of the seventh embodiment is incorporated in a musical instrument main body, that of the eighth embodiment is characterized in that, although it can be manufactured as a musical instrument incorporating a sound source body such as the string 605, it can also be applied to a case where after being manufactured as an apparatus without a sound source body, it is attached to a musical instrument such as a guitar and a glockenspiel in which a sound source body such as a string and a metal plate is exposed and which is played by fingers and a pick or by striking with a drumstick, so as to cover the exposed sound source, and this is used as a keyboard musical instrument.

Figure 12:
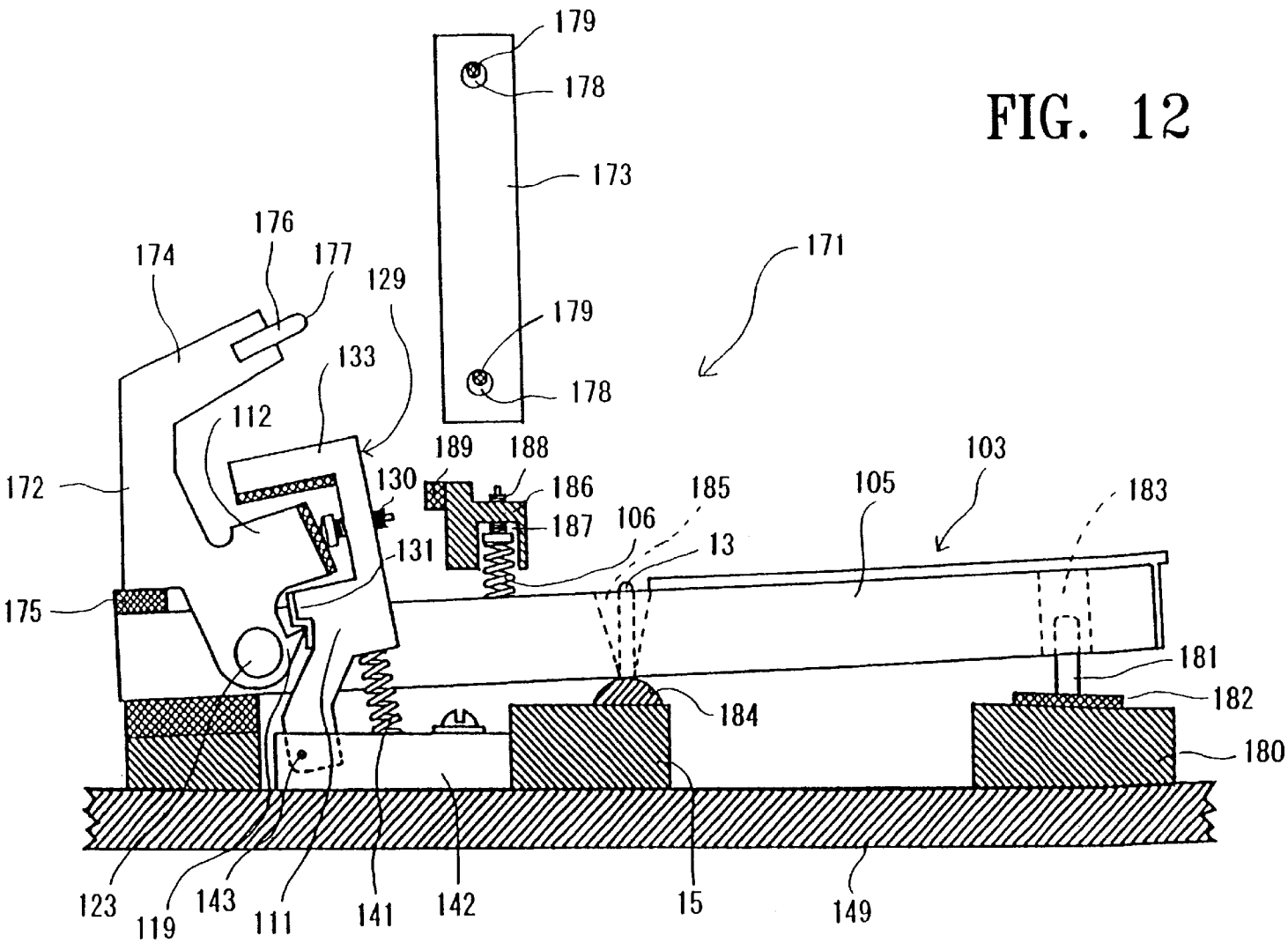
FIG. 12 is a side view illustrating an action mechanism used in a keyboard musical instrument of a fifth embodiment of the present invention.
Figure 13:
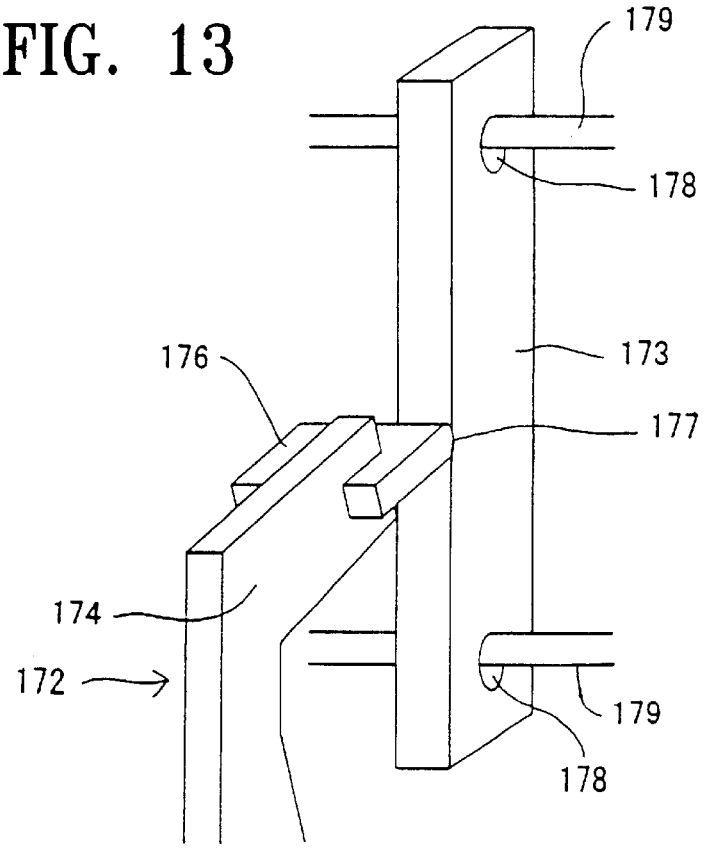
FIG. 13 is an enlarged perspective view of a hammer portion of a hammer body and a part of a sound source body of the action mechanism of FIG. 12.
Figure 47:
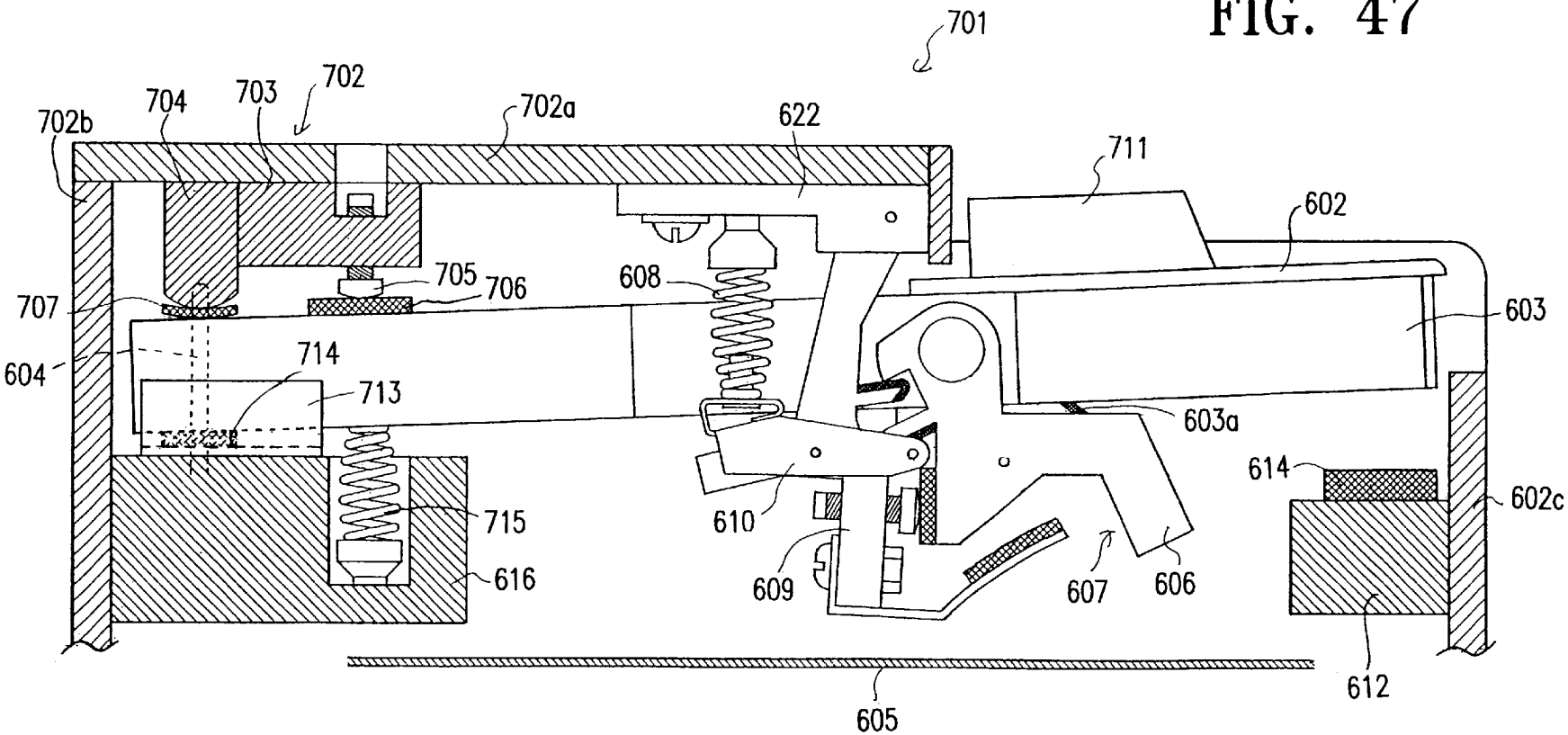
FIG. 47 is a side view showing an action mechanism to be used in a keyboard musical instrument of an eighth embodiment of the present invention.

This eighth embodiment may be configured to arrange the escapement portion 609 and the hammer body 607 to be 180 degrees line symmetrical with respect to the positional relation of FIG. 47 or to cause metal plates 173 vertically arranged as shown in FIG. 12 to collide against the hammer body 607 from either one side. In addition, the eighth embodiment maybe configured without the addition of a mechanism for improving repetition as in the other embodiments (the first to the sixth embodiments).

In addition, although the pushing-out protrusion 632 to be a pushing-out member is provided in the hammer body 607, the adjustment screw 643 to be provided in the escapement member 609 is itself a kind of a pushing-out protrusion. It is thus sufficient to provide a pushing-out member in at least one of the hammer body 607 and the escapement member 609. In addition, a push-out member may not be provided by sacrificing let-off performance a little or improving positional accuracy of the projecting piece 631 and the engaging stepped portion 641.

If the present invention is applied to an electronic musical instrument, it is preferable to dispose a sensor for sounding electronic music in a string striking portion or to change playing volume by detecting an operation speed of the keyboard portion 602 with a speed sensor disposed in its vicinity to detect a string striking speed. Consequently, the keyboard of the electronic musical turns into a kind of a real-touch keyboard and can realize a mechanical feeling despite being an electronic musical instrument.

In addition, two rather than one coil springs 608 as biasing means may be provided to allocate one coil spring for exclusive use for pivoting only the pivotal member 610.

Figure 48:
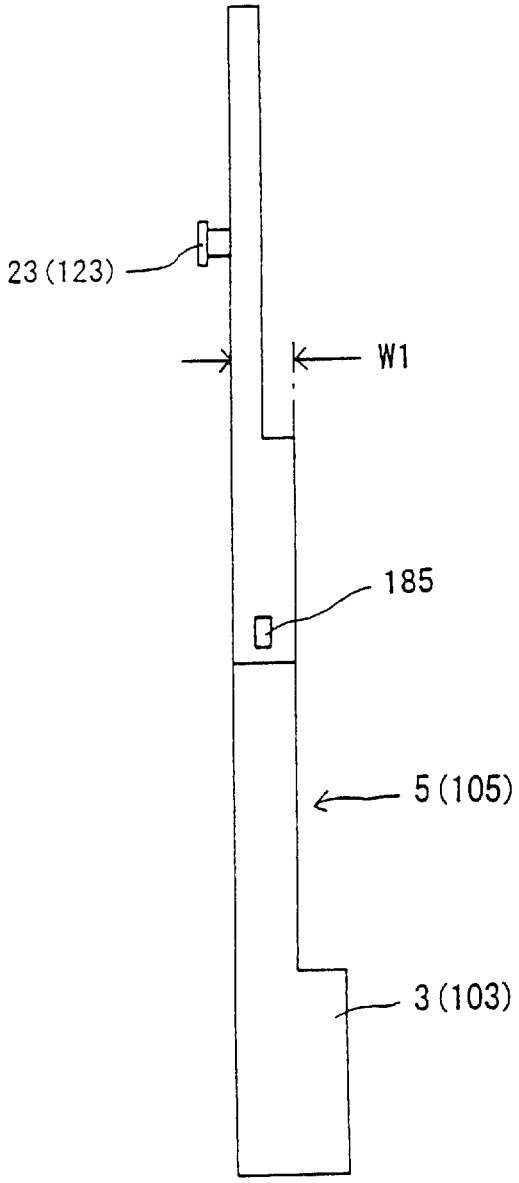
FIG. 48 is a plan view illustrating an example of a modification of the keyboard body.

Further, although each of the above-mentioned embodiments is an example of a preferred embodiment of the present invention, the present invention is not limited to these embodiments, but may be modified in various ways within the scope not departing from the spirit of the present invention. For example, as shown in FIG. 48, in the keyboard bodies 5, 105 and 603, the screw union 23 (123, 638) may be disposed such that the screw union 23 (123, 638) protrudes in the side surface side forming one flat surface in the longitudinal direction. Further, these keyboard bodies 5, 105 and 603 has the width W1 of approximately 10 mm. This width W1 is identical with the width of the keyboard portion 103 in the semitone part, and is the standard in the latitudinal direction of the keyboard bodies 5, 105 and 603.

Figure 49:
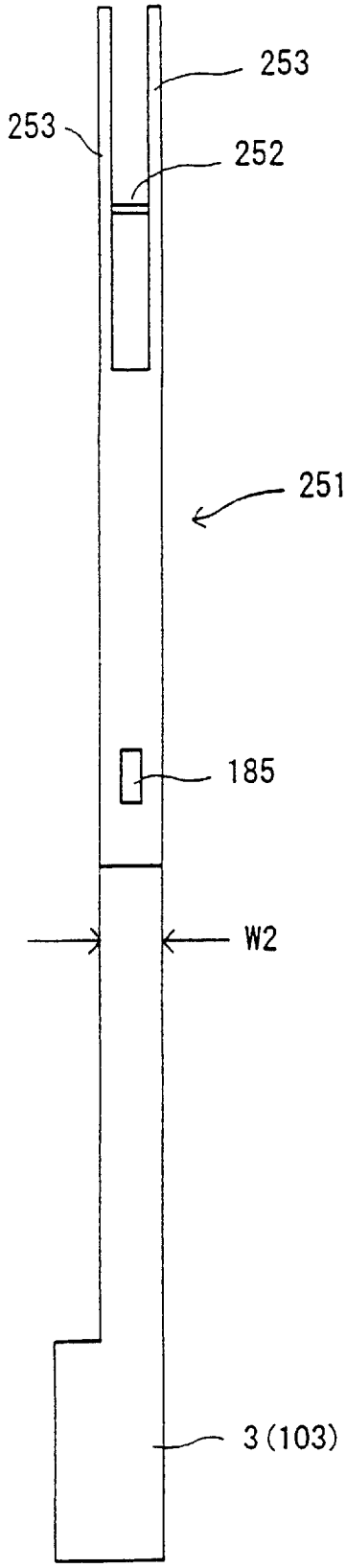
FIG. 49 is a plan view illustrating another example of a modification of the keyboard body.

The structure of the keyboard body may be the one shown in FIG. 49. The keyboard body 251 shown in FIG. 49 is preferably applied to a keyboard musical instrument using a general sized keyboard. In this keyboard body 251, a part corresponding to the screw union 23 (123, 638) is a bridge-like rotational central portion 252 that is laid between and suspends two top end portions 253 forming a fork-like structure. In this keyboard body 251, a hammer body and an escapement member are disposed between both the top end portions 253, and the hammer body is pivotally attached to the rotational central portion 252.

Figure 50A:
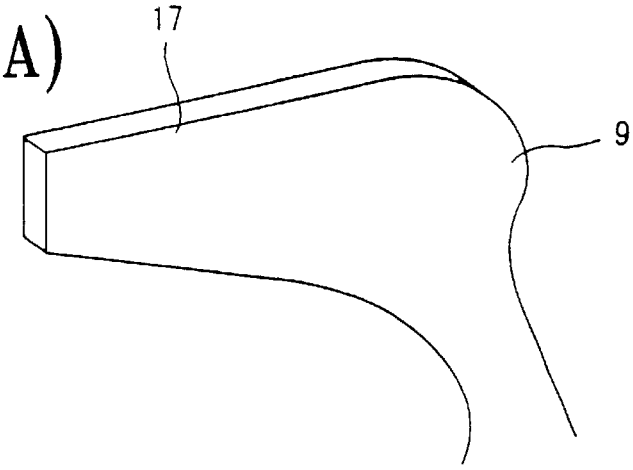
FIG. 50 is a perspective view illustrating various kinds of examples of the top end of the hammer portion.
Figure 50B:
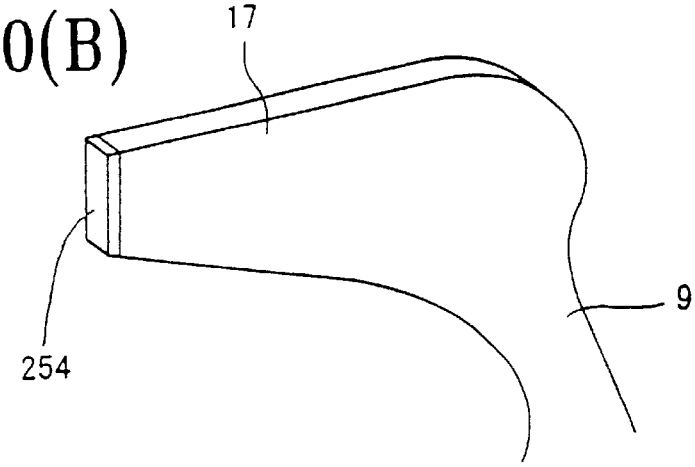
Figure 50C:
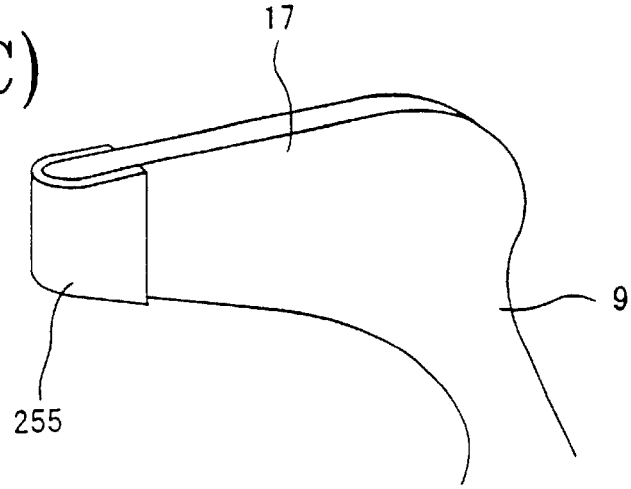

The material of the hammer bodies 9, 67, 109, 172, 202 and 607 is preferably wood, but may be other materials such as synthetic resin. In addition, the top end of the hammer portion (the hammer portion 17 is shown as a typical example) of each hammer body (the hammer body 9 is shown as a typical example) may be the same material as that of the hammer body as shown in FIG. 50(A), i.e., the same material as the one used in the first embodiment, but when the quality of sound is desired to be adjusted, a top end portion 254 made of leather or felt may be stuck and fixed as shown in FIG. 50(B). In addition, the top end of the hammer portion of each hammer body may be a covering top end portion 255 that covers the both side surfaces of the top end as shown in FIG. 50(C).

Figure 51A:
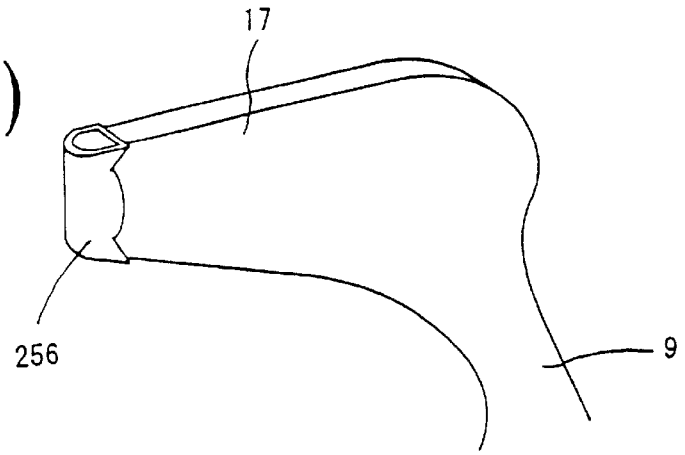
FIG. 51 illustrates examples for attaching rubber to the top end of the hammer portion, in which (A) is a perspective view illustrating the state in which rubber is attached to the top end of the hammer portion; (B) is a view illustrating rubber to be attached to the top end of the hammer portion; and (C) is a perspective view of the top end of the hammer portion.
Figure 51B:
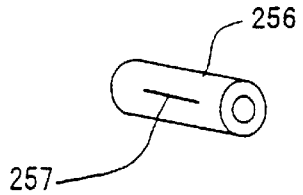
Figure 51C:
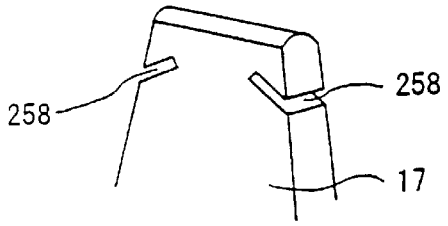

Moreover, rubber 256 may be attached to the top end of the hammer portion of each hammer body as shown in FIG. 51. The rubber 256 is cylindrical and has one slit 257 on it side surface as shown in FIG. 51(B). A notched recessed portion 258 is provided in both sides of the top end of the hammer body 17 such that the rubber 256 does not slip out. Then, when the rubber 256 is attached to the top end of the hammer body 17 by opening the slit 257, the state shown in FIG. 51(A) is attained.

Figure 52:
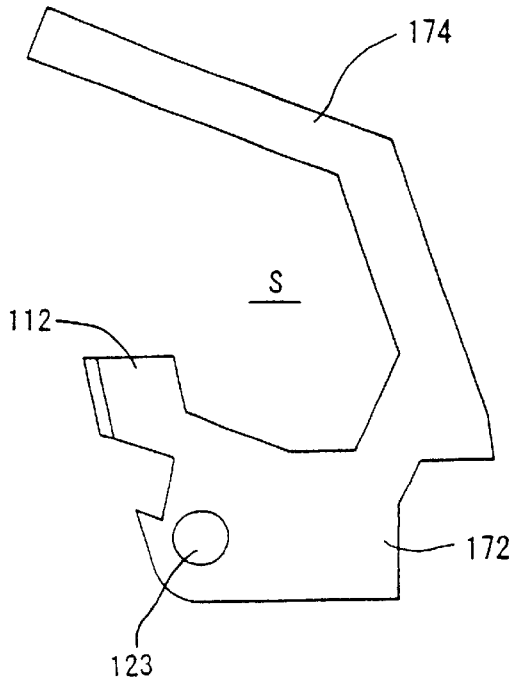
FIG. 52 is a view showing an example of a modification of the hammer body.

Devices of the top end shape of the hammer body or of attaching members such as leather, felt, rubber and the like on the top end portion can be similarly applied to the parts of the engaging stepped portions 31, 131 and 641 where the beak-like projecting pieces 19, 119 and 631 abut. As the shape of the hammer body 172, the hammer portion 174 is made longer and a space S is provided between the hammer portion 174 and the operation block 112, as shown in FIG. 52, such that other parts such as a fixed portion may be disposed in this space S.

Moreover, the shapes of the beak-like projecting pieces 19, 119 and 631 and the engaging stepped portions 31, 131 and 641 may be modified respectively as shown in each drawing of FIG. 53. Further, the shapes of the beak-like projecting piece 119 and the engaging stepped portion 131 are shown as examples in each drawing.

Figure 53A:
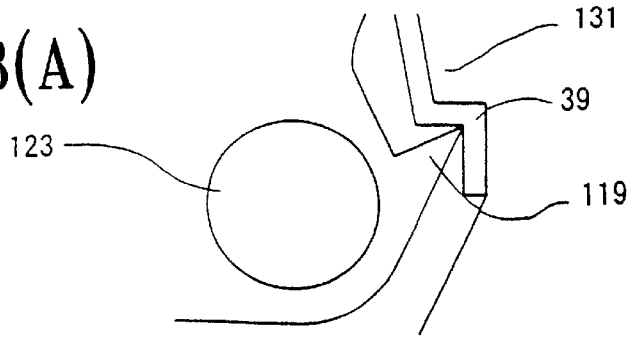
FIG. 53 illustrates various kinds of examples of each engaging part of a beak-like projecting piece of the hammer body and an engaging stepped portion of the escapement member.
Figure 53B:
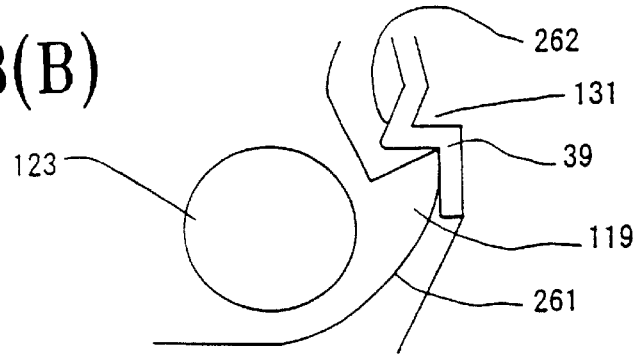

FIG. 53(A) shows a structure in which the top end of the beak-like projecting piece 119 is made triangle and the engaging stepped portion 131 is made step-like, both of which are clearly shown by drawing their appearance with straight lines. FIG. 53(B) shows a structure in which a curved surface portion 261 that is the underside of the beak-like projecting piece 119 forming a convex curved line, and on the other hand, the engaging stepped portion 131 forms an acute angle at the top end portion of FIG. 53(A), and the return sliding surface 39 to be stuck to its surface also made a triangle portion 262 in accordance with the shape.

Figure 53C:
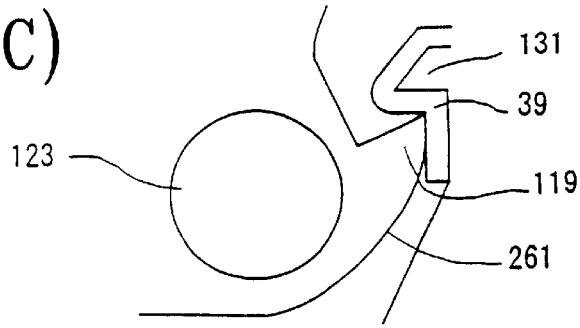
Figure 53D:
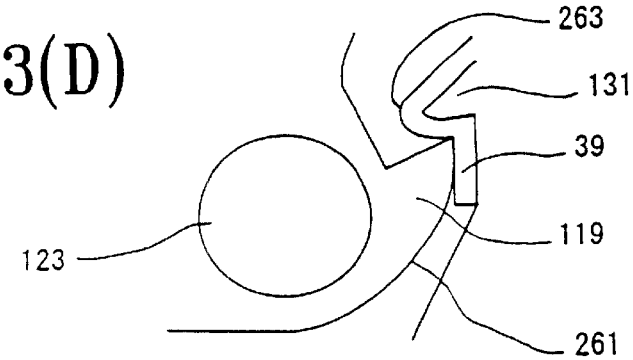
Figure 54:
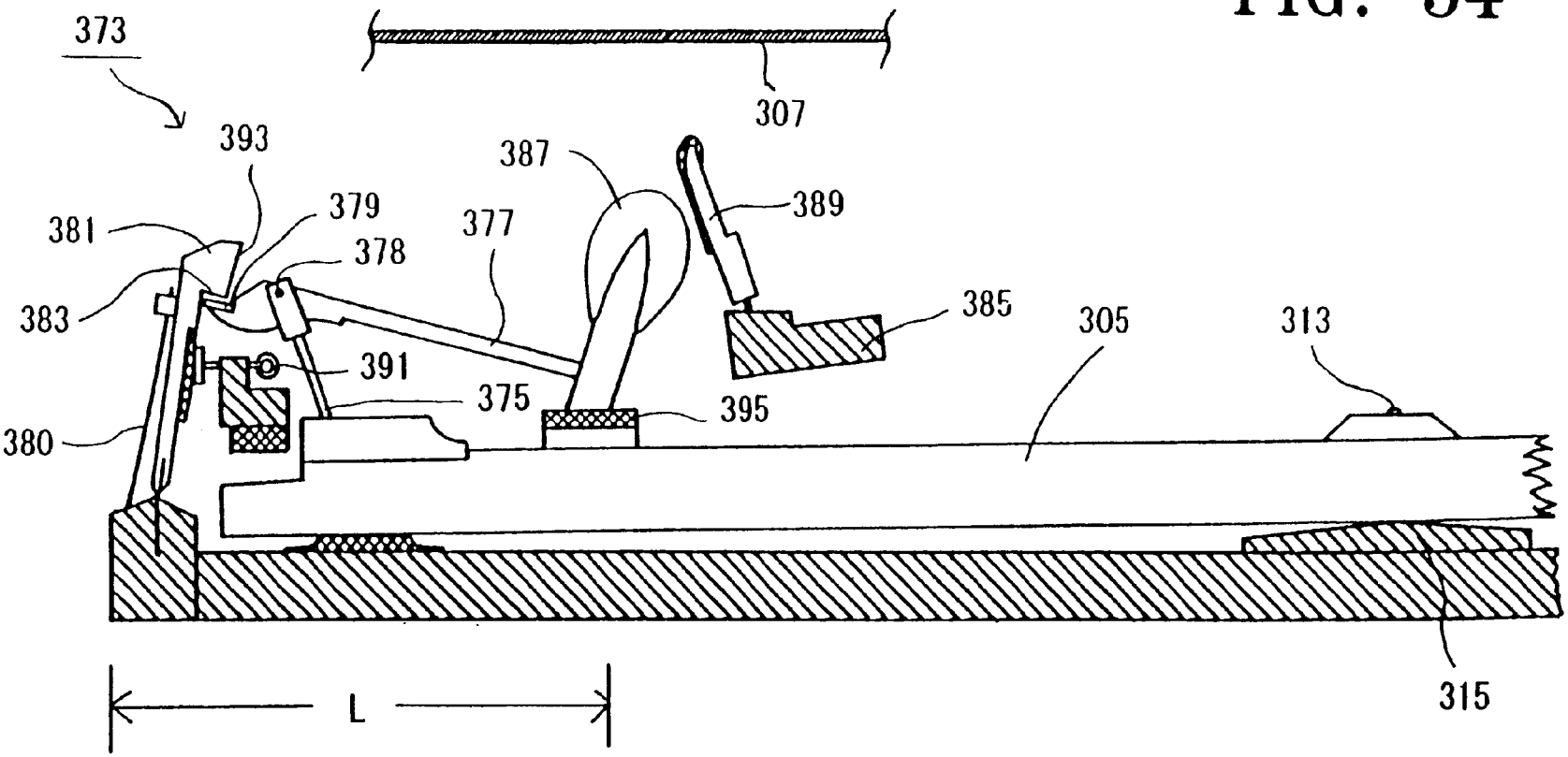
FIG. 54 is a side view illustrating an action mechanism used in a conventional jumping-up keyboard musical instrument and its operation in a stationary state immediately before starting key striking.
Figure 55:
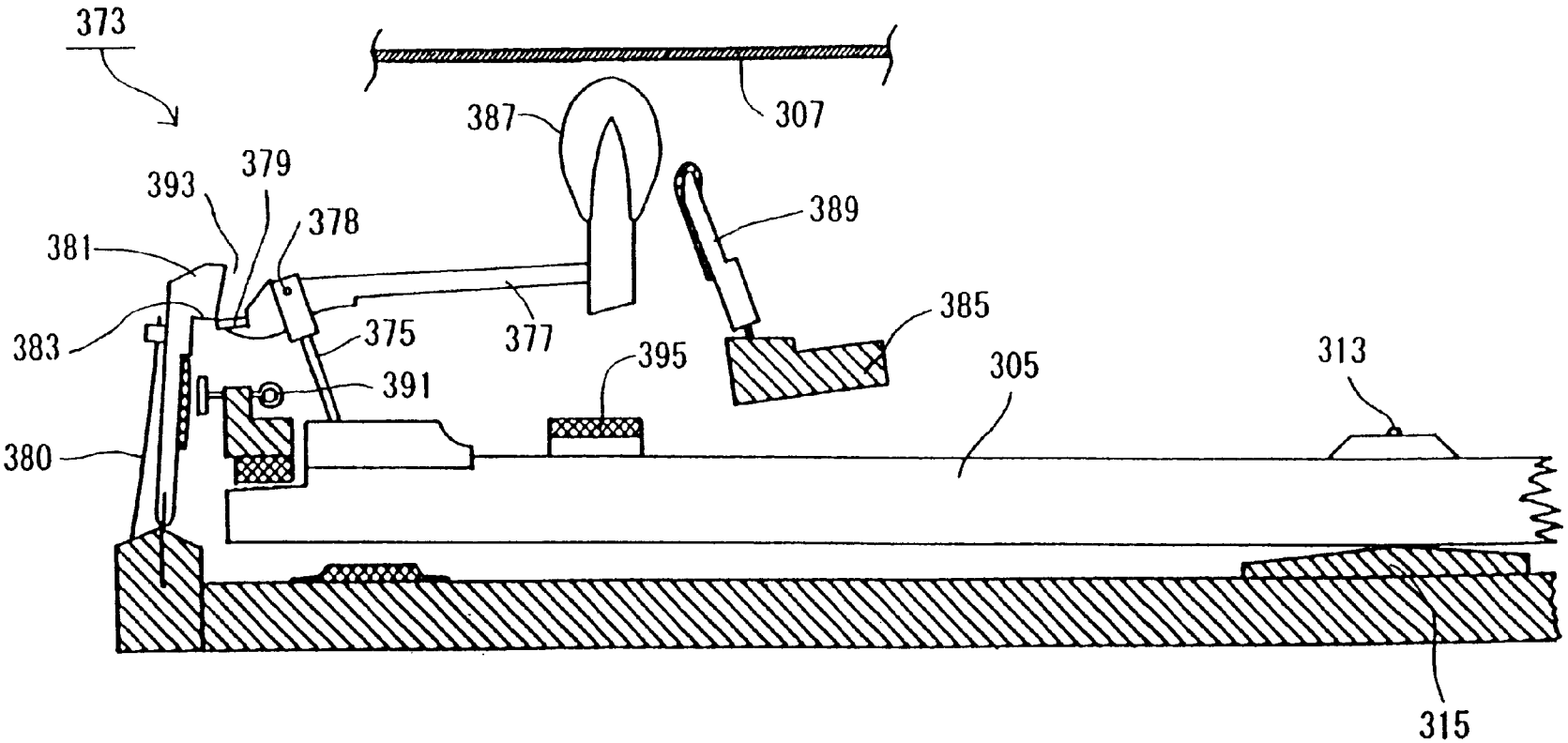
FIG. 55 is a side view illustrating the state immediately before starting string striking in the action mechanism of FIG. 31.
Figure 56:
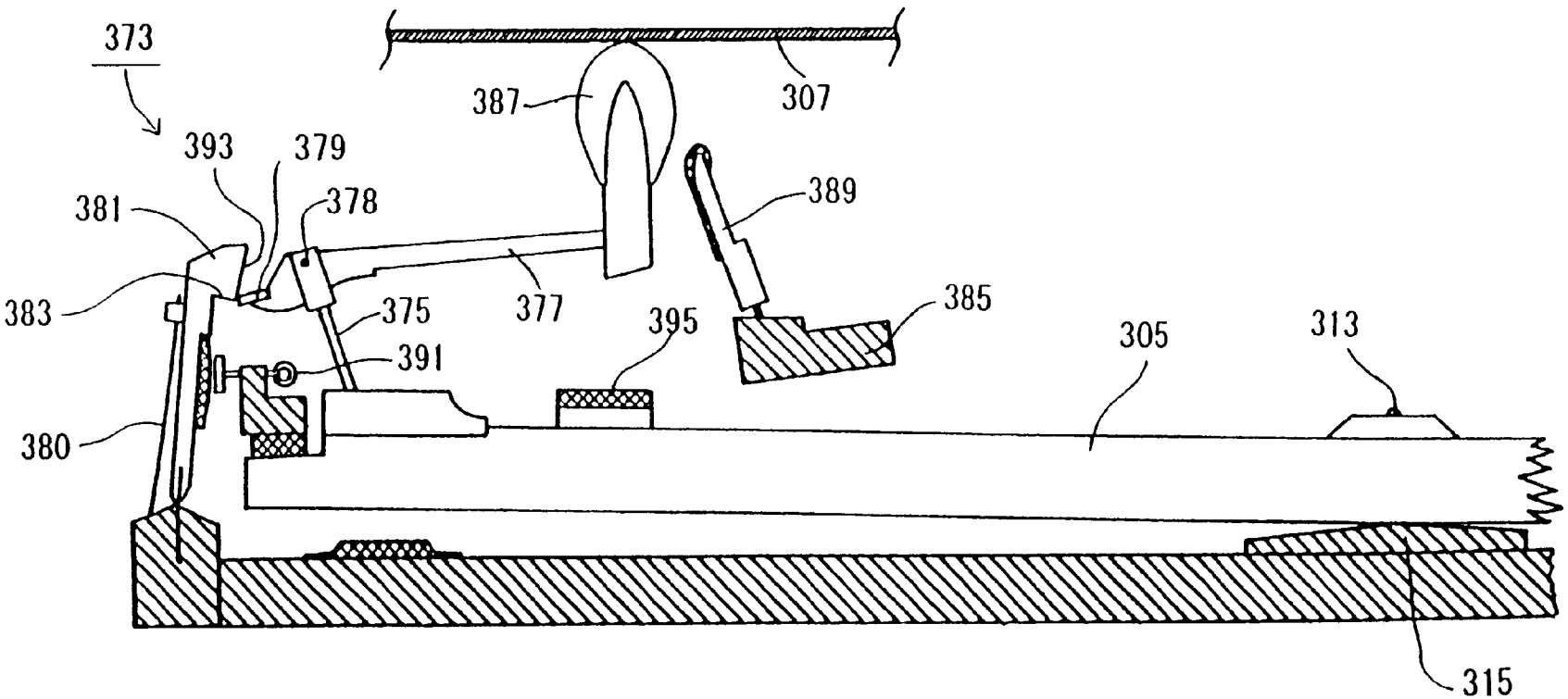
FIG. 56 is a side view showing the state at the time of striking a string in the action mechanism of FIG. 31.
Figure 57:
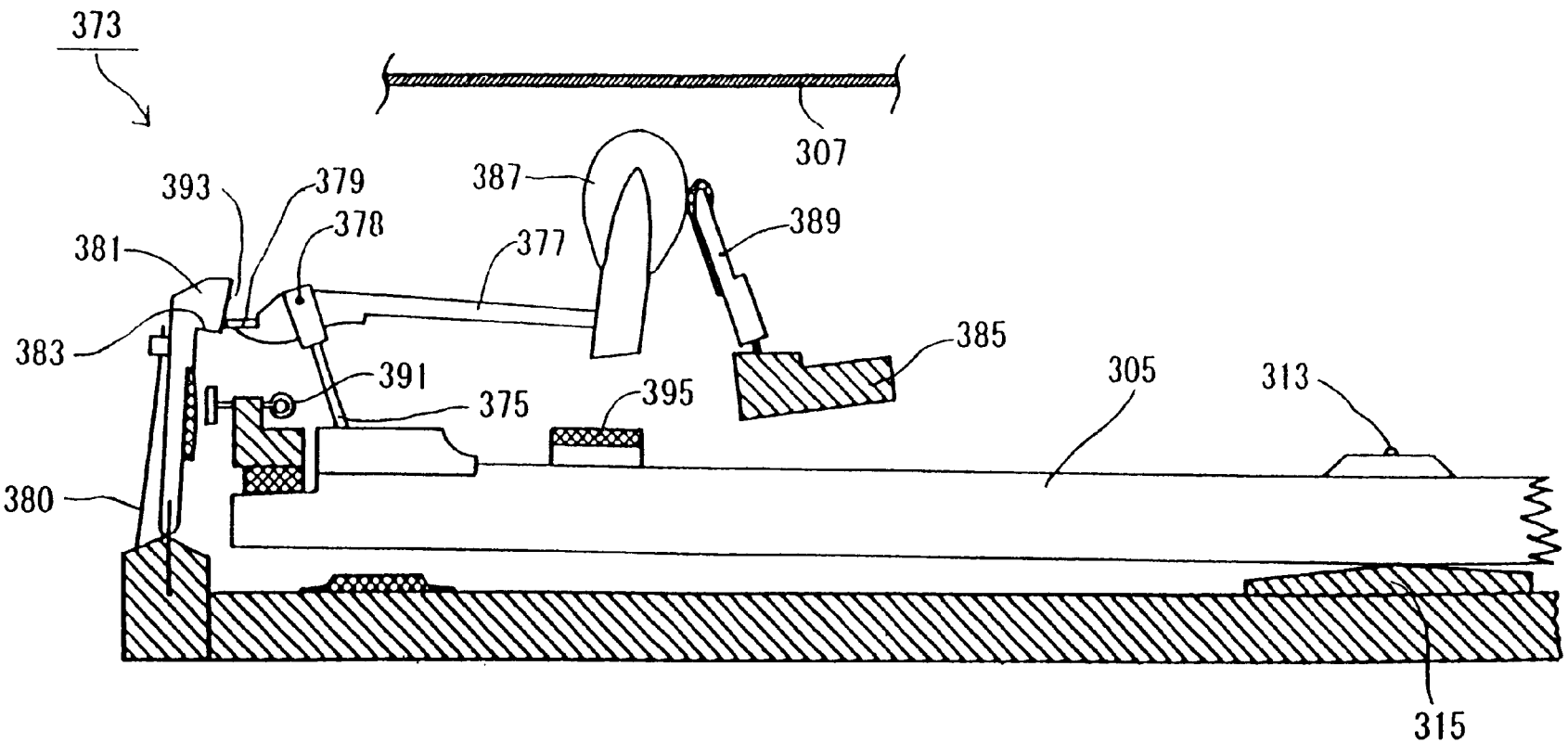
FIG. 57 is a side view illustrating the state in which the force of the hammer body is reduced by a back-check after striking a string in the action mechanism of FIG. 31.

FIG. 53(C) shows a structure in which the beak-like projecting piece 119 has the same shape as that of FIG. 53(B) and the engaging stepped portion 131 is made beak-like. In addition, FIG. 53(D) shows a structure which is different from that of FIG. 53(C), in that the lower surface of the beak-like engaging stepped portion 131 is formed more rounder and a round portion 253 is provided.

Due to the variation of the shapes as shown in FIGS. 53(A) through (D), feeling of play (touch) and the motion of the hammer body (mainly return condition of the hammer body after striking a string) changes. Preferably, these shapes are appropriately modified in accordance with purposes of use, structures of other parts and the like.

Further, the cushion material 175 in the rear upper part of the keyboard body 105 disposed in the action mechanisms 171 and 201 of the fifth and the sixth embodiments, is for easily transmitting the motion of the keyboard body 105 to the hammer bodies 172 and 202, at the same time, for erasing a return sound when the hammer bodies 172 and 202 return to the original positions, and for helping them to return to the stationary state, but the cushion material 175 may be applied to other embodiments.

In addition, in each of the above-mentioned embodiment, a keyboard musical instrument is a portable one, but it may be a larger keyboard musical instrument such as an electronic organ, an upright piano, and a grand piano.

Further, if a damper of a sound generating body is added to each action mechanism in the keyboard musical instrument in each of the above-mentioned embodiment, the method used in the conventional keyboard musical instrument can be adopted without any change. In addition, although the keyboard musical instrument can operate even if the control member attached to the escapement member and the fixing control portion fixed on the machine base are removed. Its motion is not stable and repeated striking is difficult because the hammer body rebounds. However, the control member and the fixing control portion may be removed for a toy, a musical instrument for infants and the like.

In addition, in this embodiment and modification examples, although the arrangement surfaces of the keyboard portions 3, 103 and 602 and the arrangement surface of the string 7, 605 are made parallel and the entire keyboard musical instrument is formed in a flat shape, it is possible to have a keyboard musical instrument of an upright piano type with the string 7, 605 arranged in the perpendicular surface direction with respect to the keyboard portion 3, 103 and 602 (the opposing surface with respect to a performer) by making the hammer body in the present invention to be bent upward from the arm portion, that is, by having the same configuration as that of the fifth embodiment.

In addition, although the string 7, 605 and the bar-like metal plate 173 are used as a sound generating body in each embodiment, sound generating bodies other than these such as that made of glass or a bell may be used as the sound generating body of the present invention. Further, various known conventional shapes and structures may be adopted for the hammer bodies 9, 67, 109, 172, 202 and 607.

In addition, since the touch of performance in letting off the hammer bodies 9, 67, 109, 172, 202 and 607 is exactly the same as that of a general piano in each action mechanism of the present invention, the present invention may be applied to a silent keyboard for practice use by using a cushion instead of the sound generating body, and the present invention may be further applied to an electronic musical instrument by using a sensor for an electronic musical instrument instead of the sound generating body, hence, these configurations belong to the category of the present invention. In addition, other elastic members such as a rubber member or a metal Belleville spring may be used instead of the coil springs 106, 141, 225 and 608. Moreover, although the engaging stepped portions 31, 131 and 641 are formed in a protruding shape in each embodiment, these may be formed in a recessed shape, and the upper inside surface of the recessed portion may be made to have the same function as the lower surface of the engaging stepped portion 31, 131 and 641.

Furthermore, most of the respective improvements of the present invention are not limited to the configuration in which the hammer bodies 9, 67, 109, 172, 202 and 607 is directly attached to the keyboard bodies 5, 105 and 603, but can be applied to the configuration in which the hammer body 377 is attached to the supporting pole 375 as in the conventional keyboard musical instrument.

In addition, each action mechanism can be applied to various other devices such as a device for consecutively turning on and off an electromagnetic relay and an operating portion of an amusement apparatus, in addition to a musical instrument such as a keyboard musical instrument.

As described above, the action mechanism and the keyboard musical instrument in accordance with the present invention can design a height and a depth of an action mechanism portion small while restraining deviation of a position of a striking point and can improve repetition (repeated striking function) while maintaining an advantage that the number of components and the number of assembling steps can be reduced.

Further, a keyboard musical instrument employing this mechanism can be used as a keyboard musical instrument not only in an ordinary performance but also in a concert of professional performers because the tone is stable even if the instrument is one in which sound is generated by the jumping-up of keys due to the decreased dislocation of a striking sound generating point, and thus the quality of performance is improved. In addition, since the action mechanism portion is small in terms of the height and the depth, it can be easily manufactured as a portable keyboard musical instrument. Moreover, since repetition (repeated striking mechanism) is improved despite adopting the above jumping-up structure, the keyboard musical instrument can be used for performing high quality performance.

What is claimed is:

1. An action mechanism, wherein in the longitudinal direction of a keyboard body having a keyboard portion at its one end, a middle part or the other end thereof is swingably held and, at the same time, a base of a hammer body is pivotally attached to the opposite side or the same direction side of said keyboard portion across the holding point of said keyboard body; a beak-like projecting piece is protrudingly provided in a base end of said hammer body, and at the same time, an engaging stepped portion is formed in an escapement member that is always biased toward said beak-like projecting piece of said hammer body, and the pivotally attached portion of said hammer body pivots in accordance with a movement of said keyboard body by a key striking operation of said keyboard portion, and at the same time, said beak-like projecting piece of said hammer body and said engaging stepped portion of said escapement member engage with each other so that said hammer body performs a pivotal operation, and wherein, in at least one of said hammer body and said escapement member, a pushing-out member for pushing out said escapement member to the opposite side with respect to said hammer body in accordance with the pivotal operation of said hammer body to let off the beak-like piece of said hammer body from said engaging stepped portion is provided; a pivotal member that is made engageable and disengageable to and from said hammer body is pivotally attached to said escapement member; biasing means for pivotally biasing said pivotal member in a fixed direction is provided; and said hammer body which has started returning after the pivotal operation is locked by said pivotal member, whereby said engaging stepped portion can re-engage with said beak-like projecting piece before the keyboard portion returns to an initial position of the keyboard portion before the key striking operation.

2. An action mechanism according to claim 1, wherein said escapement member is provided with a restraining member that opposes said hammer body so as to be attachable to and detachable from said hammer body and stops said hammer body at a position apart from a sound source body or a highest pivotal position in a state in which said beak-like projecting piece is let off from said engaging stepped portion.

3. An action mechanism according to claim 1, wherein, at the point when said hammer body starts pivoting, said pivotal member pivots together with said escapement member against an extending biasing force of said biasing means and, immediately before said hammer body strikes a sound source body or immediately before a highest pivotal position, said pivotal member follows the movement of said keyboard body to further pivot after the pivoting of said escapement member is stopped, to thereby further compress said biasing means.

4. An action mechanism according to claim 1, wherein a cylindrical stopping portion for stopping a returning operation of said hammer body is provided to said pivotal member and a base portion on which a roller supporting rod to be coupled to a position parallel with said stopping portion of said pivotal member is mounted during the pivoting is provided in said keyboard body.

5. An action mechanism according to claim 1, wherein a part of said pivotal member is intervened between said biasing means and said escapement member to transmit a biasing force of said biasing means to said escapement member via said pivotal member, whereby said escapement member is always biased toward said hammer body.

6. An action mechanism comprising:

a keyboard body that has a keyboard portion at its one end and is held at the middle part in the longitudinal direction or at the other end so to be made swingable;

a hammer body that has a hammer portion and is pivotally fixed at its base in the opposite side or the same direction side of said keyboard portion across a holding point of said keyboard body; and an escapement member that is always biased toward said hammer body, wherein a projecting piece is provided on the opposite side of said hammer portion across the pivotal fulcrum of said hammer body, an engaging stepped portion for engaging said projecting piece is provided in said escapement member; and said hammer body performs a pivotal operation in a state where said projecting piece of said hammer body and said engaging stepped portion of said escapement member are engaged with each other when the pivotal fulcrum of said hammer body pivots in the striking direction by a key striking operation of said keyboard portion, and wherein a pivotal member that is made engageable and disengageable to and from said hammer body is pivotally attached to said escapement member; biasing means for pivotally biasing said pivotal member in a fixed direction is provided; and said hammer body which has started returning after the pivotal operation is locked by said pivotal member, whereby said engaging stepped portion can re-engage with said beak-like projecting piece before the keyboard portion returns to an initial position of the keyboard portion before the key striking operation.

7. An action mechanism according to claim 3, wherein, in at least one of said hammer body and said escapement member, a pushing-out member for pushing out said escapement member to the opposite side with respect to said hammer body in accordance with the pivotal operation of said hammer body to let off the beak-like piece of said hammer body from said engaging stepped portion is provided.

8. An action mechanism according to claim 6, wherein, at the point when said hammer body starts pivoting, said pivotal member pivots together with said escapement member against an extending biasing force of said biasing means and, immediately before said hammer body strikes a sound source body or immediately before a highest pivotal position, said pivotal member follows the movement of said keyboard body to further pivot after the pivoting of said escapement member is stopped, to thereby further compress said biasing means.

9. An action mechanism according to claim 6, wherein a cylindrical stopping portion for stopping a returning operation of said hammer body is provided to said pivotal member and a base portion on which a roller supporting rod to be coupled to a position parallel with said stopping portion of said pivotal member is mounted during the pivoting is provided in said keyboard body.

10. An action mechanism according to claim 6, wherein a part of said pivotal member is intervened between said biasing means and said escapement member to transmit a biasing force of said biasing means to said escapement member via said pivotal member, whereby said escapement member is always biased toward said hammer body.

11. A keyboard musical instrument, wherein said keyboard musical instrument has an action mechanism as set forth in claim 1.

12. A keyboard musical instrument wherein said keyboard musical instrument has an action mechanism as set forth in claim 6.

* * * * *

UNITED STATES PATENT AND TRADEMARK OFFICE

CERTIFICATE OF CORRECTION

PATENT NO. : 6,545,205 B2
DATED : April 8, 2003
INVENTOR(S) : Yasuhiro Chono

It is certified that error appears in the above-identified patent and that said Letters Patent is hereby corrected as shown below:

Title page,
Item [76], Inventors, change "Room No. 201, Rose Mension 30-21, Takadanobaba 4-Chome," to -- Room No. 205, Green Heights 39-9, Takadanobaba 3-Chome, --.

Signed and Sealed this

Third Day of May, 2005

JON W. DUDAS
*Director of the United States Patent and Trademark Office*

UNITED STATES PATENT AND TRADEMARK OFFICE

CERTIFICATE OF CORRECTION

PATENT NO. : 6,545,205 B2
APPLICATION NO. : 09/978313
DATED : April 8, 2003
INVENTOR(S) : Chono It is certified that error appears in the above-identified patent and that said Letters Patent is hereby corrected as shown below:

Title Page, Item (76), Inventor: Please delete "Room No. 201, Rose Mension 30-21, Takadanobaba 4-chome, Shinjuku-ku, Tokyo 169-0075 (JP)" and insert --11-6, Senjuazuma 1-chome, Adachi-ku, Tokyo 120-0025, Japan--

Signed and Sealed this
Twenty-eighth Day of June, 2011

David J. Kappos

David J. Kappos
*Director of the United States Patent and Trademark Office*